US010741159B2

(12) United States Patent
Magyari

(10) Patent No.: US 10,741,159 B2
(45) Date of Patent: Aug. 11, 2020

(54) ACOUSTIC-ABSORBER SYSTEM AND METHOD

(71) Applicant: Douglas Peter Magyari, Royal Oak, MI (US)

(72) Inventor: Douglas Peter Magyari, Royal Oak, MI (US)

( * ) Notice: Subject to any disclaimer, the term of this patent is extended or adjusted under 35 U.S.C. 154(b) by 364 days.

(21) Appl. No.: 15/873,788

(22) Filed: Jan. 17, 2018

(65) Prior Publication Data

US 2019/0080677 A1 Mar. 14, 2019

Related U.S. Application Data

(60) Provisional application No. 62/556,497, filed on Sep. 10, 2017.

(51) Int. Cl.
*G10K 11/168* (2006.01)
*E04B 1/84* (2006.01)

(52) U.S. Cl.
CPC ..... *G10K 11/168* (2013.01); *E04B 1/84* (2013.01); *E04B 2001/8428* (2013.01);
(Continued)

(58) Field of Classification Search
CPC ..... E04B 1/84; E04B 2001/8414; E04B 2001/8428; E04B 2001/8433;
(Continued)

(56) References Cited

U.S. PATENT DOCUMENTS 1,791,232 A * 2/1931 Borkenstein ..... E04B 1/86 181/293
2,161,708 A * 6/1939 Heerwagen ..... E04B 1/8409 181/291
(Continued)

FOREIGN PATENT DOCUMENTS

CN 102682759 B 7/2014
JP 2002088950 A 3/2002

OTHER PUBLICATIONS

Beranek, Leo, "Analysis of Sabine and Eyring equations and their application to concert hall audience and chair absorption," J. Acoust. Soc. Am., 120 (3), Sep. 2006, pp. 1399-1410.
(Continued)

*Primary Examiner* — Jeremy A Luks
(74) *Attorney, Agent, or Firm* — Kurt L. VanVoorhies

(57) ABSTRACT

An acoustic-absorber system incorporates a plurality of acoustic-baffle assemblies in cooperation with an acoustic cavity. Each acoustic-baffle assembly incorporates a plurality of nested fluted cups, wherein at least one fluted cup of a first type having at least one orifice at at least one radially-inwardly-extending grooved portion is interleaved with at least one fluted cup of a second type having at least one orifice at at least one radially-outwardly-extending ridged portion. Externally-generated soundwaves entering either from the inside of an innermost fluted cup, or from the outside of an outermost fluted cup, travel through the at least one orifice thereof, and along a circuitous path along the gaps between adjacent cups and through at least one orifice of each of other fluted cups from one gap to another, until finally propagating into the acoustic cavity through at least one orifice of the outermost, or innermost, fluted cup for subsequent additional attenuation by destructive interference from phase cancellation within the cavity.

39 Claims, 33 Drawing Sheets

(52) U.S. Cl.
CPC ..... *E04B 2001/8433* (2013.01); *E04B 2001/8438* (2013.01); *E04B 2001/8442* (2013.01)

(58) Field of Classification Search
CPC ..... E04B 2001/8438; E04B 2001/8442; E04B 2001/8471; G10K 11/168
See application file for complete search history.

(56) References Cited

U.S. PATENT DOCUMENTS

| | | | | |
|---|---|---|---|---|
| 3,597,891 | A * | 8/1971 | Martin | B62D 29/04 52/145 |
| 4,787,473 | A | 11/1988 | Fuchs et al. | |
| 5,587,564 | A | 12/1996 | Stief et al. | |
| 5,959,264 | A | 9/1999 | Brück et al. | |
| 6,194,052 | B1 | 2/2001 | Knipstein | |
| 6,554,101 | B2 | 4/2003 | Watanabe et al. | |
| 7,451,855 | B2 | 11/2008 | Wang | |
| 7,654,364 | B2 | 2/2010 | Yamaguchi et al. | |
| 8,312,963 | B2 | 11/2012 | Ogawa et al. | |
| 8,789,651 | B2 | 7/2014 | Kawai et al. | |
| 9,076,428 | B2 | 7/2015 | Kipp et al. | |
| 9,410,403 | B2 * | 8/2016 | Wochner | E21B 41/0007 |
| 9,472,179 | B1 * | 10/2016 | Cai | G10K 11/172 |
| 10,363,726 | B2 * | 7/2019 | Butler | B32B 37/12 |
| 2008/0164090 | A1 | 7/2008 | Wang | |
| 2019/0161157 | A1 * | 5/2019 | Ravise | G10K 11/168 |

OTHER PUBLICATIONS

Navvab, Mojtaba, "Romm acoustic design, measurement and simulation techniques to reduce hospital noise with patients' environment," 171st Meeting of the Acoustical Society of America, Salt Lake City, Utah, May 23-27, 2017, 14 pages.

International Search Report and Written Opinon of International Searching Authority (EPO), International Application No. PCT/US2018/049838, Dec. 20, 2018, 11 pages.

Navvab, Mojtaba, "Ro[m]om acoustic design, measurement and simulation techniques to reduce hospital noise with patients' environment," 171st Meeting of the Acoustical Society of America, Salt Lake City, Utah, May 23-27, 2017, 14 pages.

* cited by examiner

ACOUSTIC-ABSORBER SYSTEM AND METHOD

CROSS-REFERENCE TO RELATED APPLICATIONS

The instant application claims the benefit of prior U.S. Provisional Application Ser. No. 62/556,497 filed on 10 Sep. 2017, which is incorporated by reference herein in its entirety.

DESCRIPTION OF EMBODIMENT(S)

Figure 1:
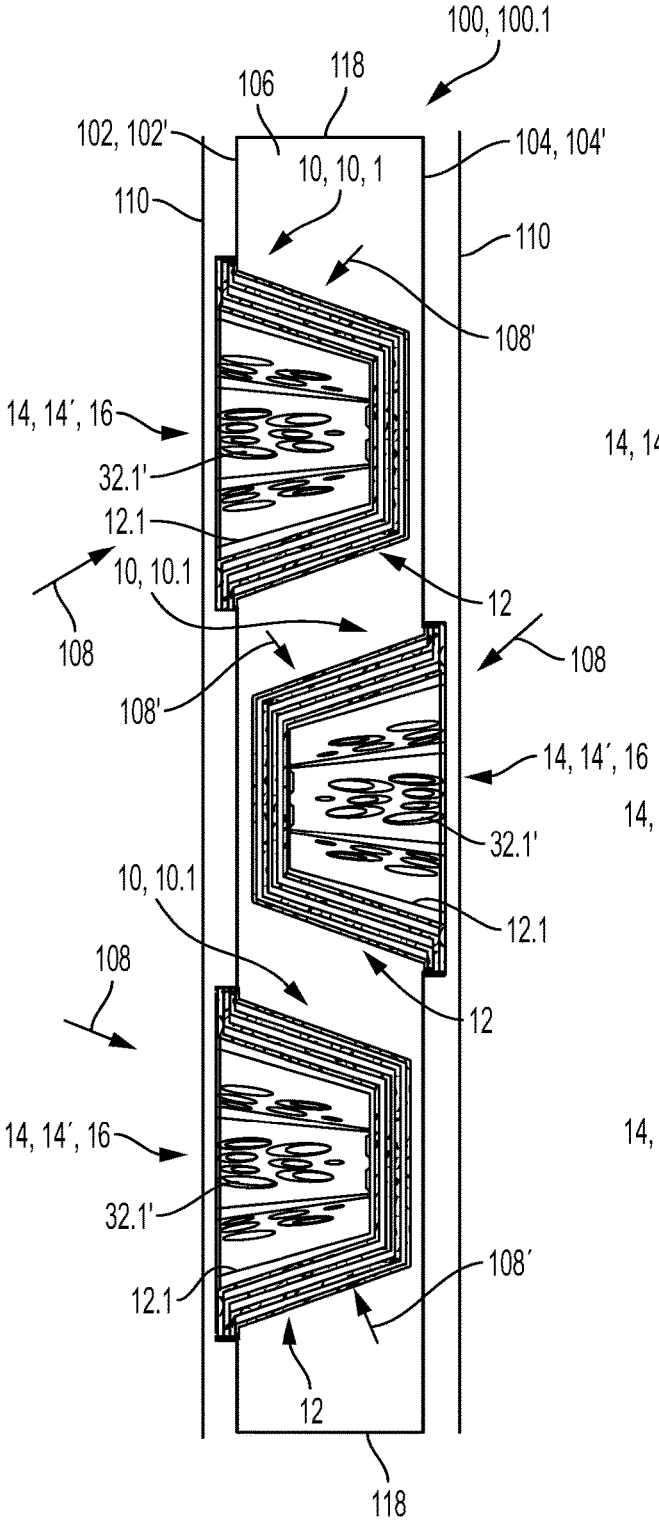
FIG. 1 illustrates a first embodiment of a first aspect of an acoustic-absorber system incorporating a plurality of acoustic-baffle assemblies in cooperation with an associated acoustic cavity, wherein each acoustic-baffle assembly is in accordance with a first aspect, and the first aspect of the acoustic-absorber system provides for absorbing sound-waves impinging upon either of the opposing faces thereof.

Referring to FIG. 1, a first aspect 100.1 of an associated acoustic-absorber system 100, 100.1 incorporates a plurality of acoustic-baffle assemblies 10—each in accordance with a first aspect 10.1—that are mounted on, and extend through, acoustically opaque face panels 102, 104 that bound an associated acoustic cavity 106, and that define corresponding opposing faces 102', 104' of the acoustic cavity 106.

Each acoustic-baffle assembly 10, 10.1 comprises a set of nested, fluted-frustoconical cups 12, wherein a mouth 14 at an open end 14' of the innermost (first) fluted-frustoconical cup 12.1 defines an acoustic inlet 16 of the acoustic-baffle assembly 10, 10.1. The acoustic-baffle assemblies 10 are oriented so that the corresponding associated acoustic inlets 16 face outwardly from the faces 102', 104' of the acoustically opaque face panels 102, 104 of the acoustic cavity 106, so as to provide for receiving soundwaves 108 from outside the acoustic cavity 106 from either side thereof—for example, through an acoustically-transparent covering 110—and directing those soundwaves 108 into the acoustic cavity 106, the latter of which provides for an acoustic attenuation of the soundwaves 108 therewithin.

Figure 2:
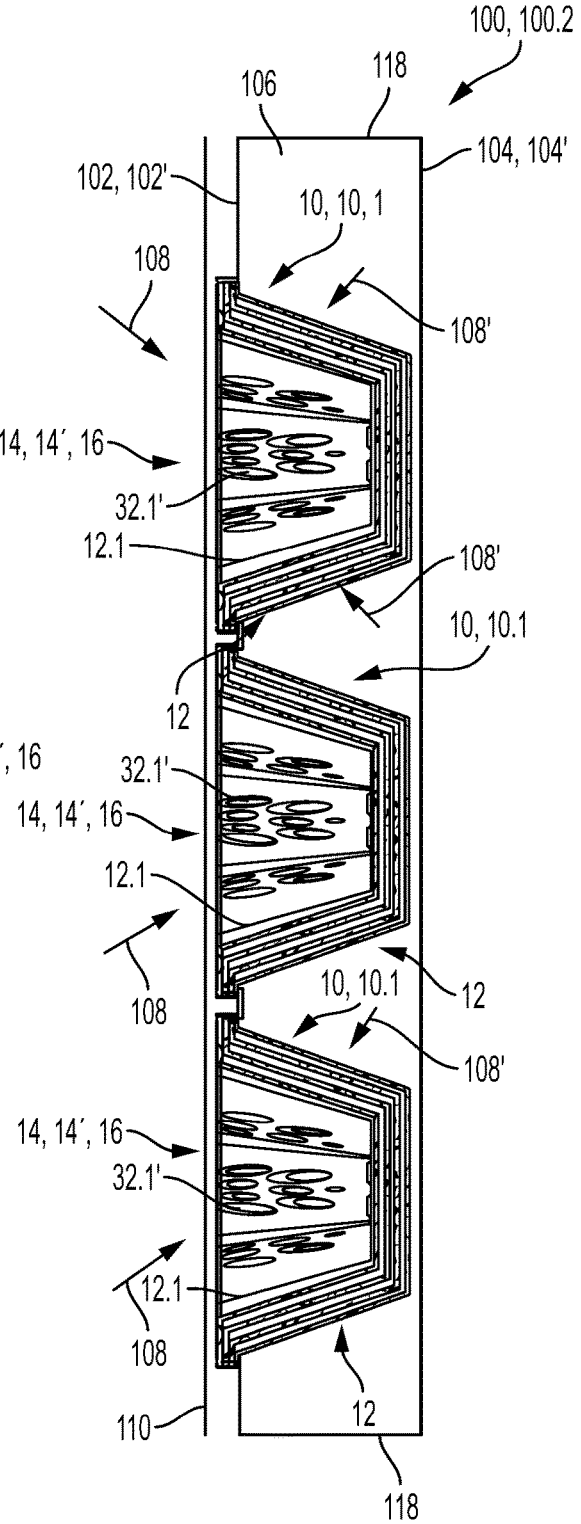
FIG. 2 illustrates a first embodiment of a second aspect of an acoustic-absorber system incorporating a plurality of acoustic-baffle assemblies in cooperation with an associated acoustic cavity, wherein each acoustic-baffle assembly is in accordance with the first aspect, and the second aspect of the acoustic-absorber system provides for absorbing sound-waves impinging upon only one of the opposing faces thereof.
Figure 3:
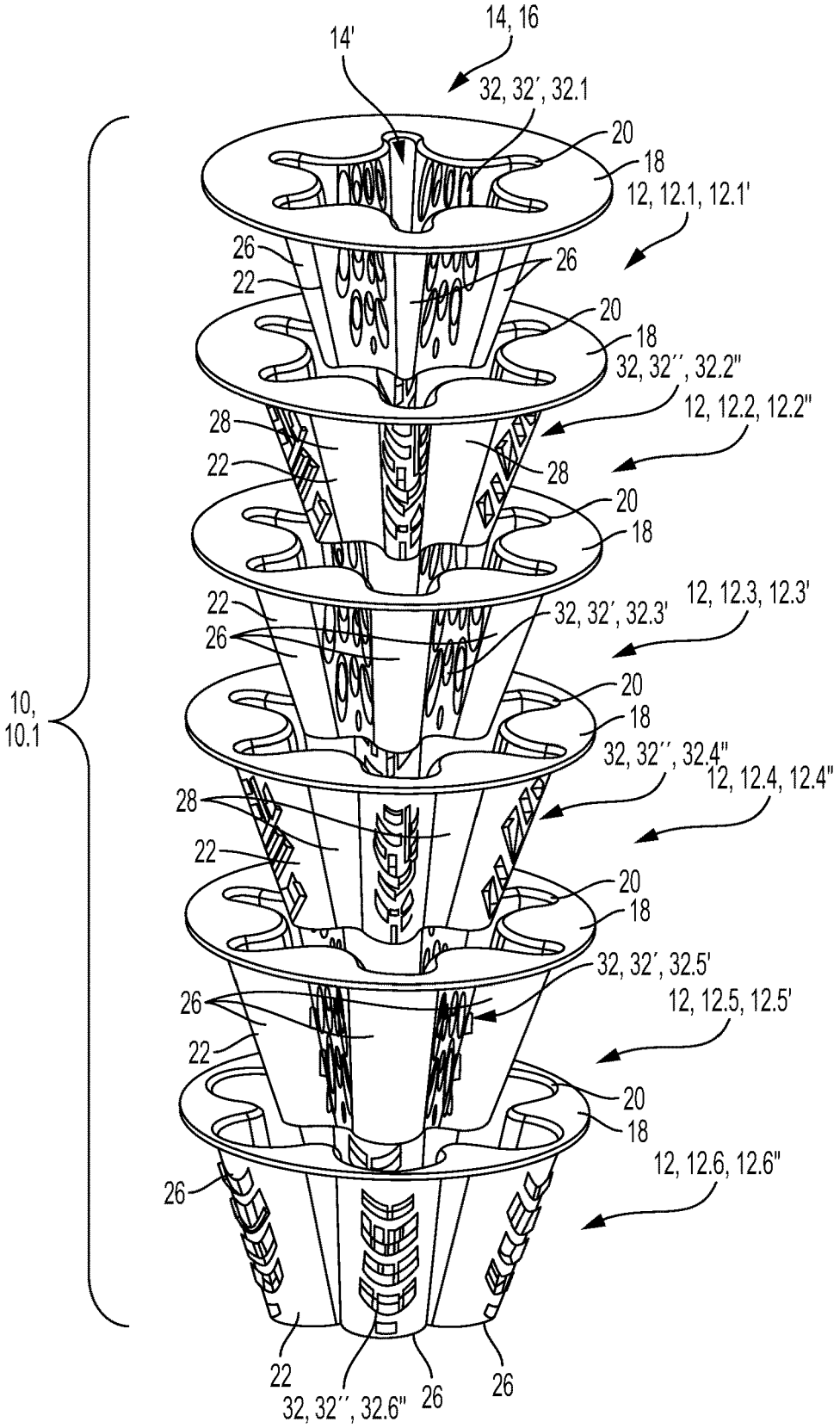
FIG. 3 illustrates an isometric, exploded view of a first aspect of the acoustic-baffle assembly incorporated in FIGS. 1 and 2.
Figure 4:
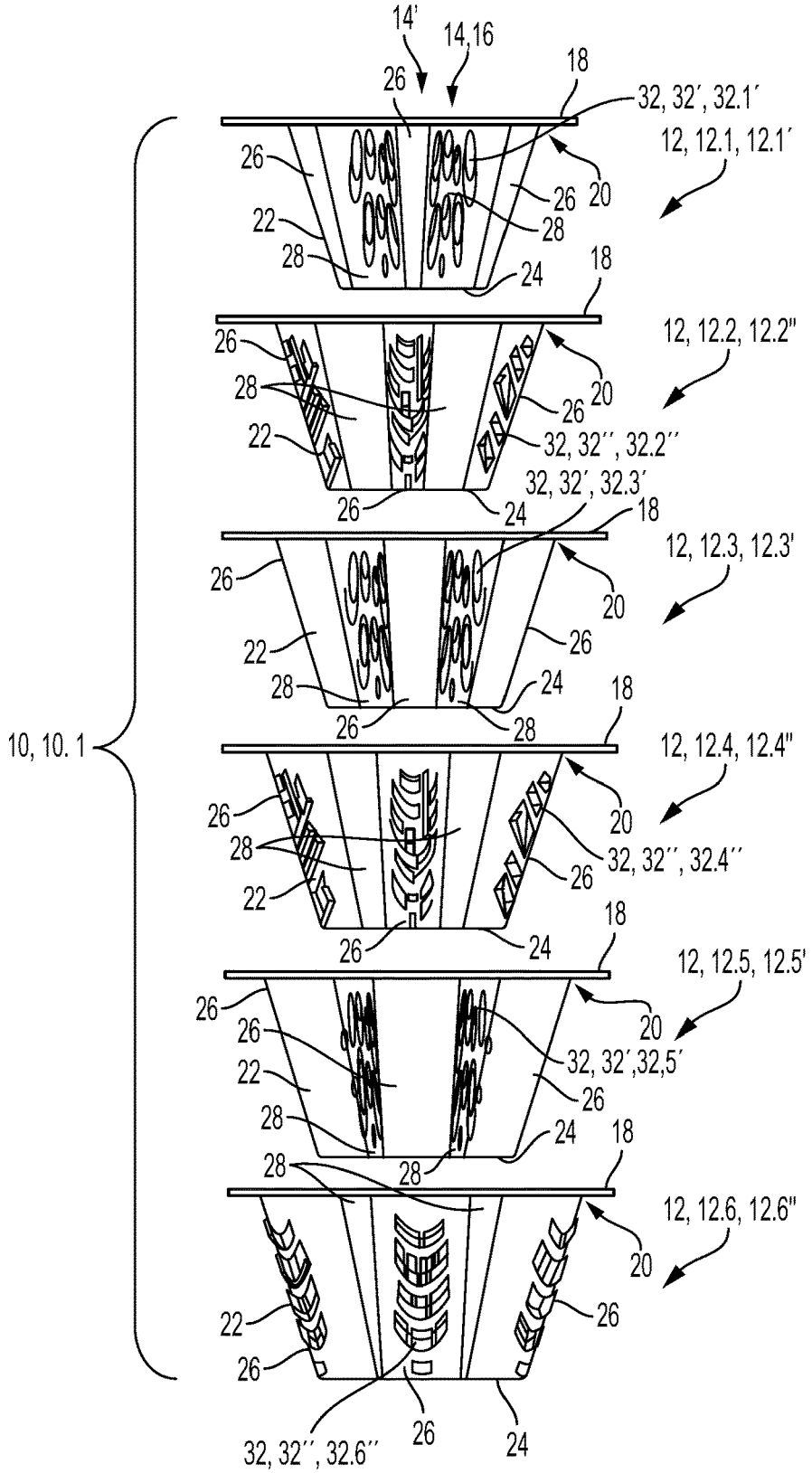
FIG. 4 illustrates a side, exploded view of the first-aspect acoustic-baffle assembly illustrated in FIG. 3 and incorporated in FIGS. 1 and 2.

Alternatively, referring to FIG. 2, a second aspect of an associated acoustic-absorber system 100, 100.2 is similar to the above-described first aspect 100.1, except that each of the associated acoustic-baffle assemblies 10 are mounted on, and extend through, only one of the acoustically opaque face panels 102 that bound an associated acoustic cavity 106, so as to provide for receiving soundwaves 108 from outside the acoustic cavity 106 from one side thereof, and directing those soundwaves 108 into the acoustic cavity 106, the latter of which provides for the acoustic attenuation of the soundwaves 108 therewithin.

Referring to FIGS. 3-16*d*, in accordance with the first aspect 10.1, each acoustic-baffle assembly 10, 10.1 incorporates a plurality of nested fluted-frustoconical cups 12—for example, in accordance with a first embodiment, fluted-frustoconical cups 12, 12.1, 12.2, 12.3, 12.4, 12.5, 12.6, —each of which comprises: an associated radially-extending flange portion 18 around a corresponding rim portion 20 of the fluted-frustoconical cup 12, a conically-tapered fluted-side-wall portion 22, and a base portion 24, wherein the conically-tapered fluted-side-wall portion 22 tapers inward from the rim portion 20 to the base portion 24, the latter two of which each have a fluted profile which is the same as that of the conically-tapered fluted-side-wall portion 22 at either respective end thereof. As used herein, the term fluted-frustoconical refers to frustum of a modified conical solid, wherein the associated conical surface portion thereof is modified to be fluted; and the term fluted-frustoconical cup refers a shell object for which the outer surfaces of the associated base and side-wall portions nominally correspond to the corresponding outer surfaces of an associated frustum of an associated fluted cone. The conically-tapered fluted-side-wall portion 22 comprises radially-outwardly-extending ridged portions 26 and corresponding radially-inwardly-extending grooved portions 28, each azimuthally interleaved with respect to each other, wherein the terms "ridged", "fluted" and "grooved" are with respect to the outside of the conically-tapered fluted-side-wall portion 22, recognizing that for a thin-shelled conically-tapered fluted-side-wall portion 22, an external "ridge" also defines a corresponding internal "groove", and an external "groove" also defines a corresponding internal "ridge". More particularly, for each external radially-outwardly-extending ridged portion 26 on the outside of the conically-tapered fluted-side-wall portion 22 there is a corresponding azimuthally-co-located internal radially-outwardly-extending grooved portion 26' on the corresponding interior side of the conically-tapered fluted-side-wall portion 22, and for each external radially-inwardly-extending grooved portion 28 there is a corresponding azimuthally-co-located internal radially-inwardly-extending ridged portion 28' on the corresponding interior side of the conically-tapered fluted-side-wall portion 22. For future reference, unless otherwise indicated, the terms "ridge", "ridged", "flute", "fluted", "groove" and "grooved" will refer to external, rather than internal, features. Although FIGS. 3-16*d* illustrate acoustic-baffle assemblies 10, 10.1 having six radially-outwardly-extending ridged portions 26 and six radially-inwardly-extending grooved portions 28, generally, the number of radially-outwardly-extending ridged portions 26 and radially-inwardly-extending grooved portions 28 would each be typically between three and eight.

The plurality of fluted-frustoconical cups 12, 12.1, 12.2, 12.3, 12.4, 12.5, 12.6 are nested with respect to one another in the acoustic-baffle assembly 10, 10.1. In one set of embodiments, the fluted-frustoconical cups 12, 12.1, 12.2, 12.3, 12.4, 12.5, 12.6 are shaped and sized so that the gaps 30 between adjacent fluted-frustoconical cups 12, 12.1, 12.2, 12.3, 12.4, 12.5, 12.6—both between adjacent conically-tapered fluted-side-wall portions 22 and between adjacent base portions 24—are substantially uniform, for example, between 0.5 mm (0.02 in.) and 2.5 mm (0.1 in.), depending upon other constraints, with the second fluted-frustoconical cup 12.2 surrounding the innermost (first) fluted-frustoconical cup 12.1 and surrounded by the third fluted-frustoconical cup 12.3, with the fourth fluted-frustoconical cup 12.4 surrounding the third fluted-frustoconical cup 12.3 and surrounded by the fifth fluted-frustoconical cup 12.5, and with the outermost (sixth) fluted-frustoconical cup 12.6 surrounding the fifth fluted-frustoconical cup 12.5. Although the embodiments of the acoustic-baffle assembly 10, 10.1 illustrated in FIGS. 1-15*d* each incorporate six fluted-frustoconical cups 12, generally between three and six fluted-frustoconical cups 12 will be sufficient, with five having been found to provide good overall performance.

Figure 6C:
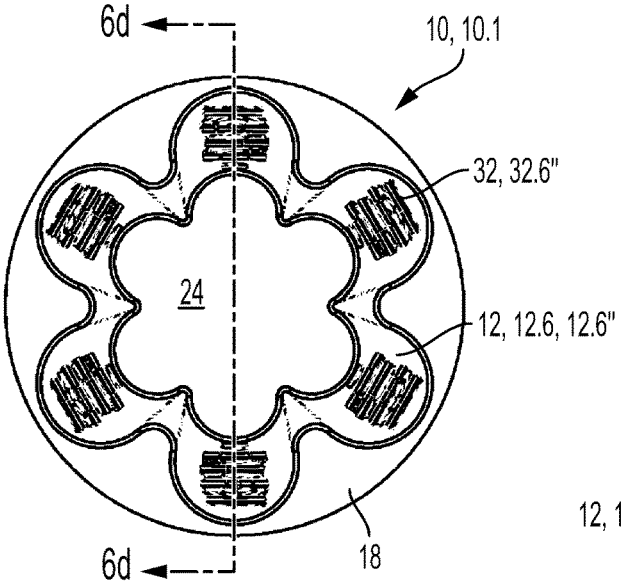
FIGS. 6*a*-6*d* respectively illustrate a side view, a transverse-cross-sectional view, a top view, and a radial-cross-sectional view of the first-aspect acoustic-baffle assembly illustrated in FIGS. 3-5 and incorporated in FIGS. 1 and 2.
Figure 6D:
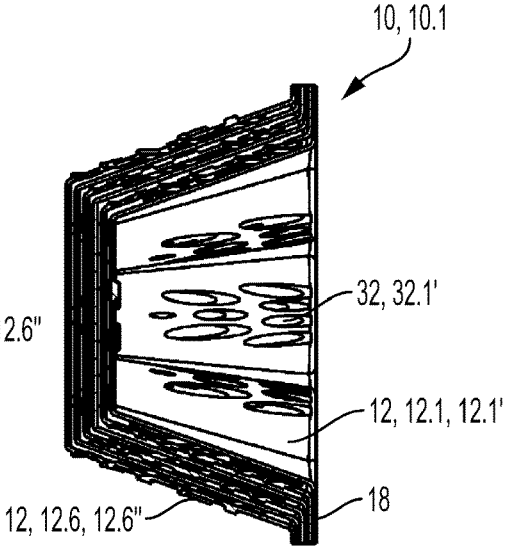
Figure 6B:
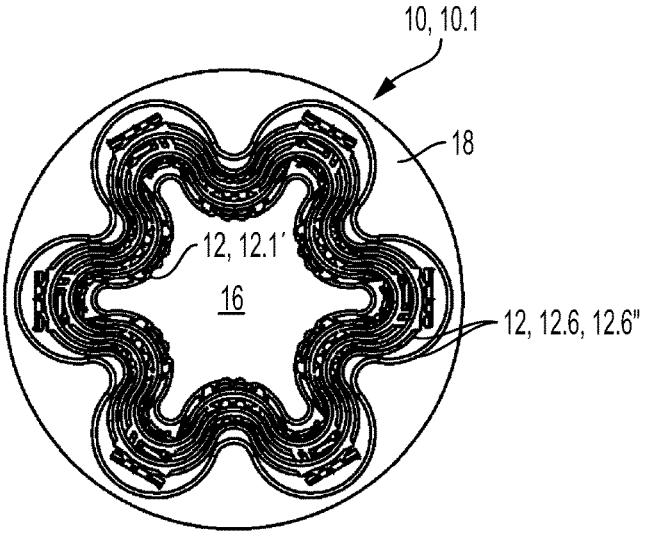
Figure 6A:
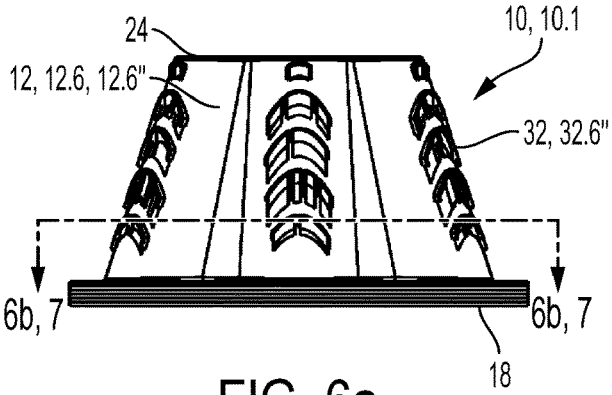
Figure 5:
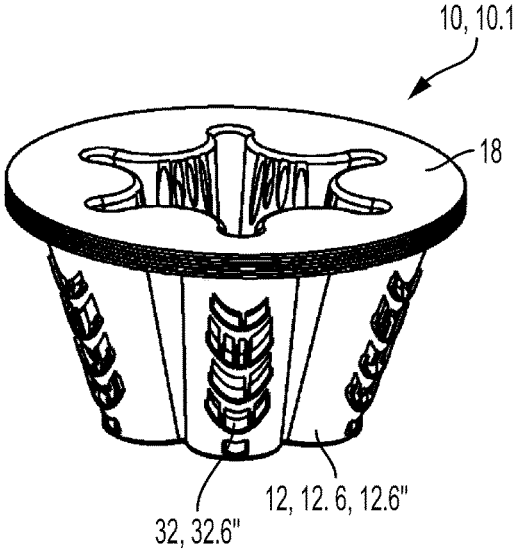
FIG. 5 illustrates an isometric view of the first-aspect acoustic-baffle assembly illustrated in FIGS. 3 and 4 and incorporated in FIGS. 1 and 2.
Figure 7:
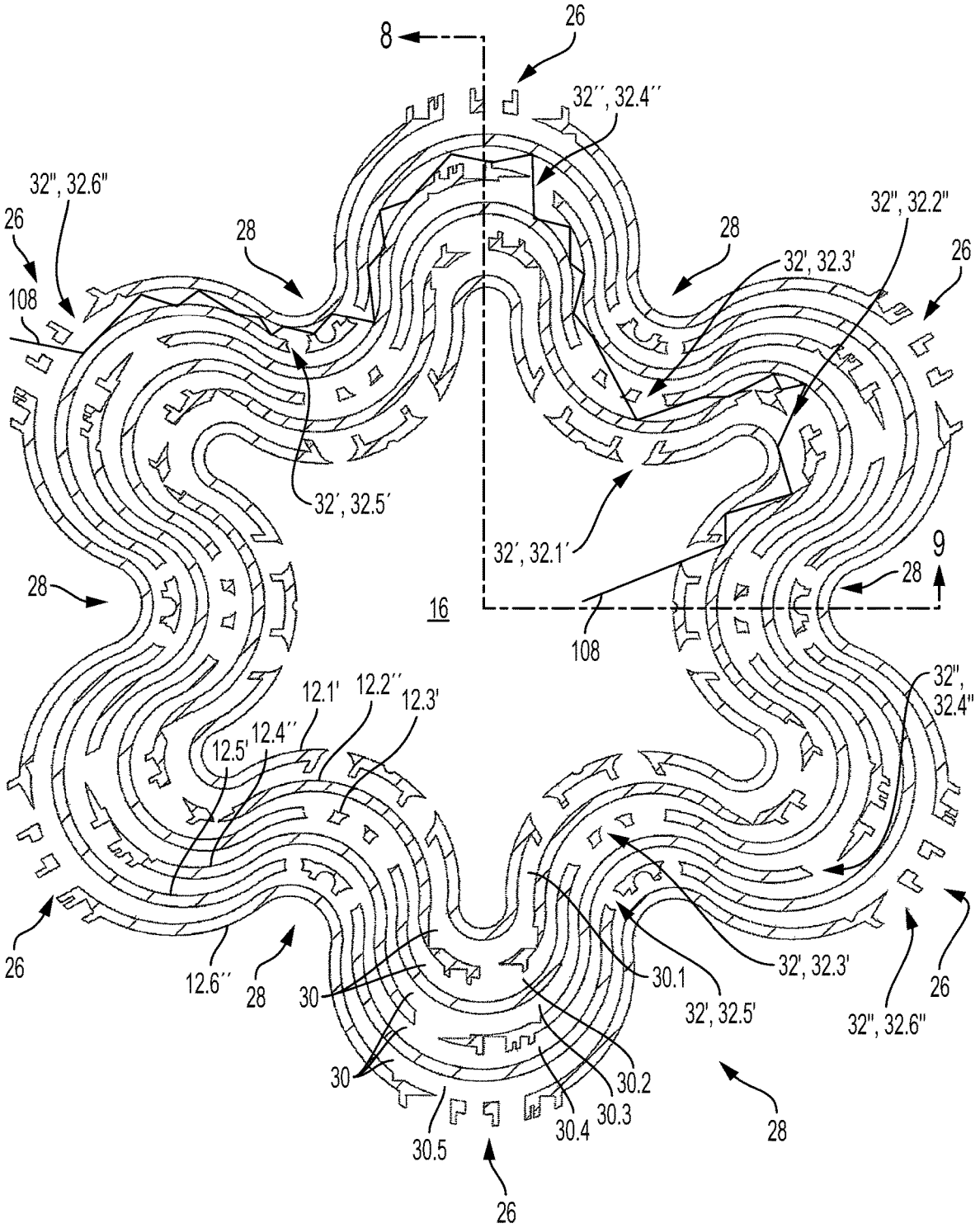
FIG. 7 illustrates an expanded transverse-cross-sectional view—corresponding to FIG. 6*b*—of the first-aspect acoustic-baffle assembly illustrated in FIGS. 3-6*d*, 8 and 9 and incorporated in FIGS. 1 and 2.
Figure 8:
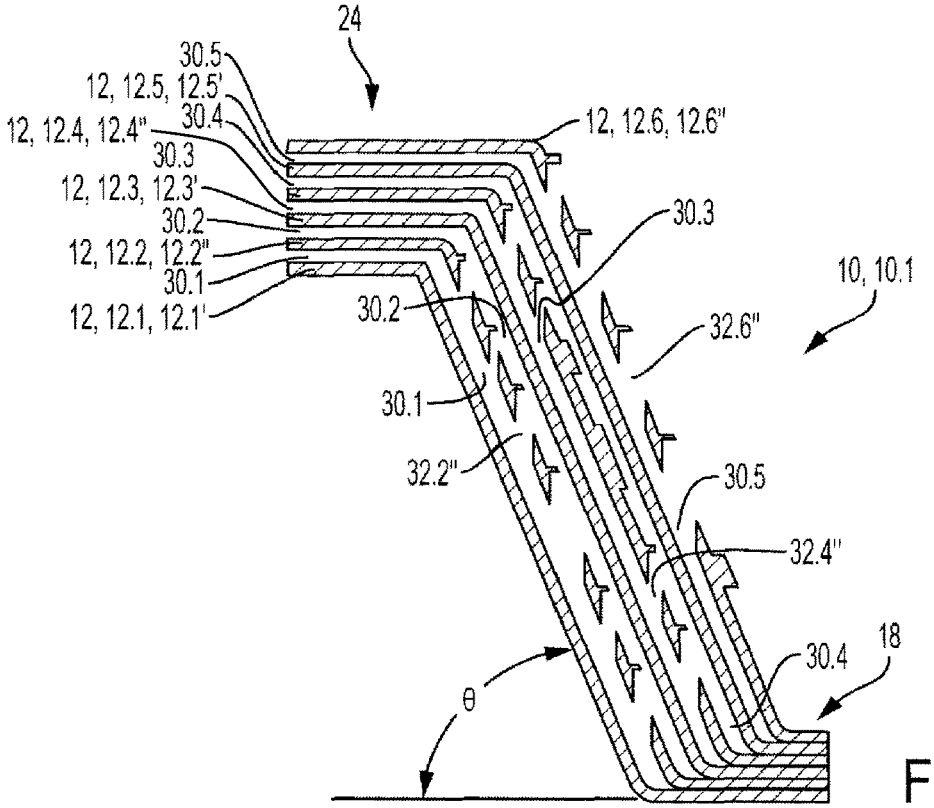
FIG. 8 illustrates a first expanded radial cross-section through a ridged portion of the first-aspect acoustic-baffle assembly illustrated in FIGS. 3-7 and incorporated in FIGS. 1 and 2.
Figure 9:
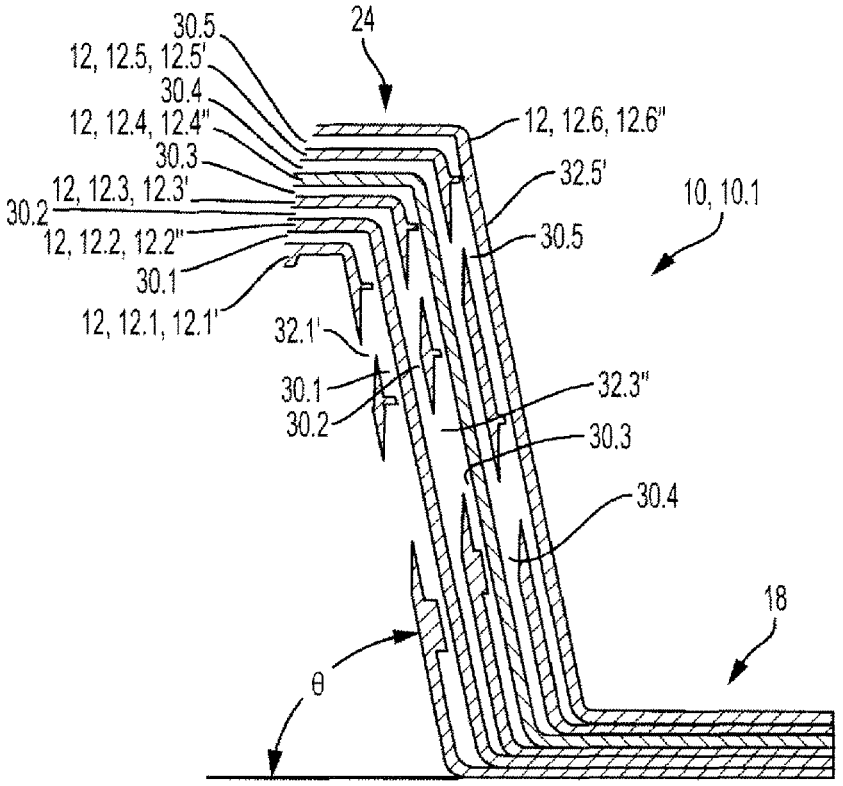
FIG. 9 illustrates a second expanded radial cross-section through a grooved portion of the first-aspect acoustic-baffle assembly illustrated in FIGS. 3-7 and incorporated in FIGS. 1 and 2.

As illustrated in FIGS. 5-6*d*, in one set of embodiments the outside diameters of the flange portions 18 of each of the first 12.1, second 12.2, third 12.3, fourth 12.4, fifth 12.5 and sixth 12.6 fluted-frustoconical cups are substantially the same so as to provide for readily centering the set of fluted-frustoconical cups 12, 12.1, 12.2, 12.3, 12.4, 12.5, 12.6 with respect to one another when nested together. Furthermore, adjacent flange portions 18 may incorporate corresponding features that provide for azimuthally—and possibly also radially—keying adjacent fluted-frustoconical cups 12, 12.1, 12.2, 12.3, 12.4, 12.5, 12.6 with respect to one another. For example, these features may be stamped as a combined plug and socket element into each of the flange portions 18 of each of the fluted-frustoconical cups 12, 12.1, 12.2, 12.3, 12.4, 12.5, 12.6 that are formed by stamping, deep drawings, or additive manufacturing, wherein one or more plug portions of one flange portion 18 of one fluted-frustoconical cups 12 would engage with corresponding one or more mating socket portions of an adjacent flange portion 18 of an adjacent fluted-frustoconical cup 12.

The conically-tapered fluted-side-wall portions 22 of the fluted-frustoconical cups 12 incorporate specifically-shaped orifices 32 therethrough at associated specific locations that provide for soundwaves 108 to propagate therethrough from one gap 30 to another on both sides of each conically-tapered fluted-side-wall portion 22. More particularly, every other fluted-frustoconical cup 12, 12.1, 12.3, 12.5 in the acoustic-baffle assembly 10, 10.1 incorporates a first class of orifices 32' of a first shape 34.1 at a first class of locations 36.1, and the remaining every other fluted-frustoconical cup 12, 12.2, 12.4, 12.6 in the acoustic-baffle assembly 10, 10.1 incorporates a second class of orifices 32" of a second shape 34.2 at second class of locations 36.2, wherein, in accordance with one set of embodiments, the first 34.1 and second 34.2 shapes are different from one another, and the first 36.1 and second 36.2 classes of locations are azimuthally offset from one another, so as to force the soundwaves 108 to travel along a serpentine path 38 in order to pass through the acoustic-baffle assembly 10, 10.1, successively from one gap 30 to another. Alternatively, the first 34.1 and second 34.2 shapes could be the same for each of the fluted-frustoconical cups 12, 12.1, 12.2, 12.3, 12.4, 12.5, 12.6, i.e. so as to be the same for each layer of the acoustic-baffle assembly 10, 10.1. Generally, the first 34.1 and second 34.2 shapes could be either similar or different, the first shape 34.1 could be different for some or each associated every other fluted-frustoconical cup 12, 12.1, 12.3, 12.5 in the acoustic-baffle assembly 10, 10.1, and the second shape 34.2 could be different for some or each associated remaining every other fluted-frustoconical cup 12, 12.2, 12.4, 12.6 in the acoustic-baffle assembly 10, 10.1.

Generally, the number, size and shape of the orifices 32 at either the radially-outwardly-extending fluted portions 26 or the radially-inwardly-extending grooved portions 28 is not limiting. For example, not every radially-outwardly-extending fluted portion 26 or radially-inwardly-extending grooved portion 28 need necessarily incorporate an orifice 32—provided that at least one does for each fluted-frustoconical cup 12, 12.2, 12.4, 12.6, —and for each radially-outwardly-extending fluted portion 26 or radially-inwardly-extending grooved portion 28 that does, there could be one or more orifices 32, and the one or more orifices 32 could be of a variety of sizes or shapes, or could be uniformly sized and shaped. A class of orifices 32', 32" refers to a set of orifices 32 at an associated class of locations 36.1, 36.2. For example, the first class of orifices 32' refers to the set of orifices 32 at the corresponding first class of locations 36.1, for example, proximate to the azimuthal centers of the radially-inwardly-extending grooved portions 28, and the second class of orifices 32" refers to the set of orifices 32 at the corresponding second class of locations 36.2, for example, proximate to the azimuthal centers of the radially-outwardly-extending fluted portions 26. The individual orifices 32 within each class of orifices 32', 32" could have a variety of shapes or sizes at a particular associated radially-outwardly-extending fluted portion 26 or at a particular radially-outwardly-extending fluted portion 26, or from one associated radially-outwardly-extending fluted portion 26 or radially-outwardly-extending fluted portions 26 to another, or from one fluted-frustoconical cup 12, 12.2, 12.4, 12.6 to another.

More particularly, referring to FIGS. 3, 4, 7, 10*a*-10*d*, 12*a*-12*d* and 14*a*-14*d*, in accordance with the first class of orifices 32', the associated first shape 34.1 is generally a stretched circular shape, and the associated first class of locations 36.1 are proximate to the azimuthal centers of the radially-inwardly-extending grooved portions 28 of the conically-tapered fluted-side-wall portion 22 of the associated fluted-frustoconical cup 12, 12.1', 12.3', 12.5'. Furthermore, referring to FIGS. 3, 4, 7, 11*a*-11*d*, 13*a*-13*d* and 15*a*-15*d*, in accordance with the second class of orifices 32", the associated second shape 34.2 is generally a stretched rectangular shape, and the associated second class of locations 36.2 are proximate to the azimuthal centers of the radially-outwardly-extending ridged portions 26 of the conically-tapered fluted-side-wall portion 22 of the associated fluted-frustoconical cup 12, 12.2", 12.4", 12.6". The term "stretched circular shape" refers to a shape that would result from forming the fluted-frustoconical cups 12 from a planar sheet of material—that was punched with circular orifices prior to forming—by a deep-drawing process, or by a simulation thereof. Similarly, the term "stretched rectangular shape" refers to a shape that would result from forming the fluted-frustoconical cups 12 from a planar sheet of material—that was punched with rectangular orifices prior to forming—by a deep-drawing process, or by a simulation thereof.

Alternatively, the orifices 32 could be more simply shaped, for example, having either a circular, elliptical, rectangular, square, or polygonal shape, or some other shape, for example, that can be punched, for example, after first forming the fluted-frustoconical cups 12, 12.1, 12.2, 12.3, 12.4, 12.5, 12.6 by deep-drawing, The number, depth, and shape of the radially-outwardly-extending ridged portions 26 and corresponding radially-inwardly-extending grooved portions 28, in cooperation with the above-described orifices 32, are configured so as to cause the soundwaves 108 propagating therethrough to follow a myriad of tortuous paths therethrough that cause the soundwaves 108 therewithin, and exiting therefrom to an acoustic cavity 106 of the associated acoustic-absorber system 100, 100.1, 100.2, to become phase-scrambled, which in turn results in a substantial attenuation of the amplitudes of the soundwaves 108 within the acoustic cavity 106 of the associated acoustic-absorber system 100, 100.1, 100.2.

More particularly, referring to FIG. 7 and FIGS. 3, 4, 10*a*-10*d* and 11*a*-11*d*, in operation, soundwaves 108 entering the acoustic inlet 16 of the innermost (first) fluted-frustoconical cup 12.1, 12.1' of the acoustic-baffle assembly 10, 10.1 propagate through the first orifices 32.1' thereof—having the first "stretched circular" shape 34.1 and located proximate to the azimuthal centers of the radially-inwardly-extending grooved portions 28—and into a first gap 30.1 between the first 12.1, 12.1' and second 12.2, 12.2" fluted-frustoconical cups of the acoustic-baffle assembly 10, 10.1. The soundwaves 108 then reflect off the inside of the relatively proximate radially-inwardly-extending grooved portions 28 of the second fluted-frustoconical cup 12.2", away from the first orifices 32.1', and along the first gap 30.1 responsive to the curvature of the inside of the relatively proximate radially-inwardly-extending grooved portions 28 of the second fluted-frustoconical cup 12.2. The size of the first gap 30.1 and the local circumferential extent of the first orifices 32.1' are configured so that path of the soundwaves 108 changes by at least 60 degrees—although beneficially at least 90 degrees—as a result of multiple reflections within the first gap 30.1, before exiting therefrom through the second orifices 32.2"—having the second "stretched rectangular" shape 34.2 and located proximate to the azimuthal centers of the radially-outwardly-extending ridged portions 26—of the second fluted-frustoconical cup 12.2".

Referring also to FIGS. 12*a*-12*d*, the soundwaves 108 from the second orifices 32.2" propagate into a second gap 30.2 between the second 12.2" and third 12.3' fluted-frustoconical cups of the acoustic-baffle assembly 10, 10.1. The soundwaves 108 then reflect off the inside of the relatively proximate radially-outwardly-extending ridged portions 26 of the third fluted-frustoconical cup 12.3, 12.3', away from the second orifices 32.2", and along the second gap 30.2 responsive to the curvature of the inside of the relatively proximate radially-outwardly-extending ridged portions 26 of the third fluted-frustoconical cup 12.3, 12.3'. The size of the second gap 30.2 and the local circumferential extent of the second orifices 32.2" are configured so that path of the soundwaves 108 changes by at least 60 degrees—although beneficially at least 90 degrees—as a result of multiple reflections within the second gap 30.2, before exiting therefrom through the third orifices 32.3'—having the first "stretched circular" shape 34.1 and located proximate to the azimuthal centers of the radially-inwardly-extending grooved portions 28—of the third fluted-frustoconical cup 12.3, 12.3'.

Referring also to FIGS. 13*a*-13*d*, the soundwaves 108 from the third orifices 32.3' propagate into a third gap 30.3 between the third 12.3' and fourth 12.4" fluted-frustoconical cups of the acoustic-baffle assembly 10, 10.1. The soundwaves 108 then reflect off the inside of the relatively proximate radially-inwardly-extending grooved portions 28 of the fourth fluted-frustoconical cup 12.4, 12.4", away from the third orifices 32.3', and along the third gap 30.3 responsive to the curvature of the inside of the relatively proximate radially-inwardly-extending grooved portions 28 of the fourth fluted-frustoconical cup 12.4, 12.4". The size of the third gap 30.3 and the local circumferential extent of the third orifices 32.3' are configured so that path of the soundwaves 108 changes by at least 60 degrees—although beneficially at least 90 degrees—as a result of multiple reflections within the third gap 30.3, before exiting therefrom through the fourth orifices 32.4"—having the second "stretched rectangular" shape 34.2 and located proximate to the azimuthal centers of the radially-outwardly-extending ridged portions 26—of the fourth fluted-frustoconical cup 12.4, 12.4".

Referring also to FIGS. 14*a*-14*d*, the soundwaves 108 from the fourth orifices 32.4" propagate into a fourth gap 30.4 between the fourth 12.4" and fifth 12.5' fluted-frustoconical cups of the acoustic-baffle assembly 10, 10.1. The soundwaves 108 then reflect off the inside of the relatively proximate radially-outwardly-extending ridged portions 26 of the fifth fluted-frustoconical cup 12.3, 12.5', away from the fourth orifices 32.4", and along the second gap 30.2 responsive to the curvature of the inside of the relatively proximate radially-outwardly-extending ridged portions 26 of the fifth fluted-frustoconical cup 12.5, 12.5'. The size of the fourth gap 30.4 and the local circumferential extent of the fourth orifices 32.4" are configured so that path of the soundwaves 108 changes by at least 60 degrees—although beneficially at least 90 degrees—as a result of multiple reflections within the fourth gap 30.4, before exiting therefrom through the fifth orifices 32.5'—having the first "stretched circular" shape 34.1 and located proximate to the azimuthal centers of the radially-inwardly-extending grooved portions 28—of the fifth fluted-frustoconical cup 12.5, 12.5' 12.3, 12.3'.

Finally, referring also to FIGS. 15*a*-15*d*, the soundwaves 108 from the fifth orifices 32.5' propagate into a fifth gap 30.5 between the fifth 12.5' and sixth 12.6" fluted-frustoconical cups of the acoustic-baffle assembly 10, 10.1. The soundwaves 108 then reflect off the inside of the relatively proximate radially-inwardly-extending grooved portions 28 of the outermost (sixth) fluted-frustoconical cup 12.6, 12.6", away from the fifth orifices 32.5', and along the fifth gap 30.5 responsive to the curvature of the inside of the relatively proximate radially-inwardly-extending grooved portions 28 of the outermost (sixth) fluted-frustoconical cup 12.6, 12.6". The size of the fifth gap 30.5 and the local circumferential extent of the fifth orifices 32.5' are configured so that path of the soundwaves 108 changes by at least 60 degrees—although beneficially at least 90 degrees—as a result of multiple reflections within the fifth gap 30.5, before exiting therefrom through the sixth orifices 32.6"—having the second "stretched rectangular" shape 34.2 and located proximate to the azimuthal centers of the radially-outwardly-extending ridged portions 26—of the outermost (sixth) fluted-frustoconical cup 12.6, 12.6", and into an acoustic cavity 106 of the associated acoustic-absorber system 100, 100.1, 100.2.

Accordingly, the soundwaves 108 entering the acoustic-baffle assembly 10, 10.1 undergo multiple reflections and travel along a myriad of different paths of different associated path lengths within the acoustic-baffle assembly 10, 10.1, which results in substantial smearing or scrambling of the phase thereof, causing substantial attenuation of the amplitude thereof as a result of destructive interference caused by associated phase cancelation either within the acoustic-baffle assembly 10, 10.1 or within the acoustic cavity 106 of the associated acoustic-absorber system 100, 100.1, 100.2.

Referring again to FIG. 1 or 2, soundwaves 108 exiting the acoustic-baffle assemblies 10, 10.1 in various directions then enter the acoustic cavity 106, resulting in a further myriad of addition reflections therein, which causes additional phase smearing or scrambling of the soundwaves 108 therein, and associated destructive interference thereof. Reverse-directed soundwaves 108' from within the acoustic cavity 106 are also free to enter the sixth orifices 32.6" of the outermost (sixth) fluted-frustoconical cups 12.6 of the acoustic-baffle assemblies 10, and will experience additional phase smearing or phase scrambling, and associated destructive interference by phase cancellation, but these reverse-directed soundwaves 108' will have been substantially attenuated by action of the acoustic cavity 106 prior to entering the sixth orifices 32.6" of the outermost (sixth) fluted-frustoconical cups 12.6 of the acoustic-baffle assemblies 10. In addition to their scrambling effect, the acoustic-baffle assemblies 10 have sufficient openness to provide for soundwaves 108 to readily enter the acoustic cavity 106, which provides for destructive interference by phase cancellation, but also provides for sufficiently constraining the soundwaves 108 therewithin for a sufficient period of time to provide for the destructive interference from phase cancelation to occur.

In accordance with one set of embodiments, for each fluted-frustoconical cup 12, the total area of the associated orifices 32 thereof is between 20% and 50% of the area of the footprint of the associated acoustic-baffle assembly 10—for example, approximately 50% of the area of the footprint, —the latter of which is defined by the area of a square that circumscribes the flange portions 18 of the fluted-frustoconical cups 12, 12.1, 12.2, 12.3, 12.4, 12.5, 12.6. For example, if the outside diameter of the rim portions 20 of the fluted-frustoconical cups 12, 12.1, 12.2, 12.3, 12.4, 12.5, 12.6 is given by D, then the total area of the orifices 32 of each fluted-frustoconical cup 12, 12.1, 12.2, 12.3, 12.4, 12.5, 12.6, is approximately $D^2/2$. The absorption frequency range of the acoustic-absorber system 100 is responsive to the size(s) and shape(s) of the orifices 32, and the distribution thereof, on each fluted-frustoconical cup 12 (or generally, each cup 12 accounting for other aspects or embodiments thereof). For example, relatively-smaller orifices 32 of substantially uniform size and shape would typically exhibit a relatively narrow frequency response, whereas relatively-larger orifices 32 of varied shapes—possibly in combination with relatively-smaller orifices 32—would typically exhibit a relatively wider frequency response. If total area of the orifices 32 of each fluted-frustoconical cup 12 (or cup 12 generally) is about 50%—a typical practical, but otherwise not limiting, upper bound, wherein a larger percentage of open area would be expected to be beneficial subject to a sufficient amount of redirection and mixing of the soundwaves 108 within the acoustic-baffle assembly 10—of the footprint area, then the attenuation spectrum approaches linearity, i.e. relatively constant attenuation over a relatively-wide frequency range. Accordingly, the relatively large total area of the orifices 32 provides for soundwaves 108 to freely pass therethrough to either enter or exit the acoustic cavity 106, thereby preventing the acoustic cavity 106 from acting as a closed, Helmholtz resonator. The net efficiency—i.e. a measure of the extent to which soundwaves 108 are absorbed, also referred to as a sound absorption coefficient, the latter of which is given by the ratio of the absorbed sound intensity to the incident sound intensity—of the acoustic-baffle assembly 10 is determined by the smallest net opening area of any one layer, i.e. of any one fluted-frustoconical cup 12, 12.1, 12.2, 12.3, 12.4, 12.5, 12.6 thereof. The net efficiency of the panel is improved by the panel having enough openings to allow the soundwaves to travel into the cavity. If the openings are too small, or not of a high enough percentage of the footprint of the cone area, the panel will simply act as a reflector. For example, if most of the layers have a 50% opening area, but one layer has a 40% opening area—for each of the acoustic-baffle assemblies 10 of the absorber system 100, 100.1, 100.2—the net performance of the associated acoustic absorber system 100, 100.1, 100.2 would be expected to diminish by at least 20%. Accordingly, it is beneficial to net sound absorption efficiency for each of the layers to have approximately the same opening area. Generally, the attenuation of relatively lower frequency components of the soundwaves 108 is accomplished principally by action of the acoustic cavity 106, whereas the attenuation of relatively higher frequency components of the soundwaves 108 is accomplished principally by action of the acoustic baffle assemblies 10. Accordingly, the incorporation of relatively sub-optimal acoustic baffle assemblies 10—for example, comprising a relatively fewer number of fluted frustoconical cups 12, or of a lower height—in an acoustic absorber system 100, 100.1, 100.2 will have a greater detrimental effect on the attenuation of relatively-higher-frequency acoustic components than on the attenuation of relatively-lower-frequency acoustic components.

The associated above-defined sound-scrambling action of the acoustic-baffle assembly 10 is provided for by the following features thereof: a) there is total sufficient series opening area of the associated orifices 32 thereof so as to provide for the soundwaves 108 to readily propagate therethough from the associated acoustic inlet 16 thereof, and into the associated acoustic cavity 106 of the associated acoustic-absorber system 100, and b) the associated tortuous, serpentine path 38 that the soundwaves 108 follow therethrough is sufficiently convoluted that there is no straight-line path for the soundwaves 108 to travel from one layer between adjacent fluted-frustoconical cups 12 to an associated adjacent layer, but instead, the tortuous, serpentine path 38 provides for redirecting the soundwaves 108 by at least 60 degrees—although beneficially at least 90 degrees—within the one layer before propagating through one or more orifices 32 to the adjacent layer, wherein the series opening area of each acoustic-baffle assembly 10, 10.1 is the total area of the orifices 32 of the associated fluted-frustoconical cup 12 having the minimum total area with respect to other fluted-frustoconical cups 12 of the same acoustic-baffle assembly 10, 10.1.

In one set of embodiments, the height (i.e. axially-projected distance from the rim portions 20 to the base portion 24) of the fluted-frustoconical cups 12 is sufficient so that the associated conically-tapered fluted-side-wall portions 22 can accommodate a sufficient number of orifices 32 of a sufficient distribution of sizes and shapes to satisfy the overall area metric (i.e. substantially the same total opening area for each fluted-frustoconical cup 12, that total opening area being about 50% of the associated footprint area, i.e. the "openness" metric), and with the orifices 32 located and oriented so as to provide for the above-defined sufficiently convoluted, tortuous, serpentine path 38, so as to provide for an associated acoustic-absorber system 100 that provides for a relatively linear absorption characteristic over a substantially full acoustic spectrum. In addition to the "openness" metric and the desired acoustic frequency absorption range, the height of the fluted-frustoconical cups 12 is also responsive to the range of diameters of the associated fluted-frustoconical cups 12, and the thickness of the material thereof. As a result, for example, in one set of embodiments, a practical range of the height of the acoustic-baffle assembly 10, 10.1 is, for example, typically between about 50 mm (2 inches) tall and 200 mm (8 inches) tall. For example, in one embodiment, the acoustic-baffle assembly 10, 10.1, the height of the acoustic-baffle assembly 10, 10.1 is about 100 mm, and the diameter is about 150 mm. For example, an acoustic-absorber system 100 with 50 mm high acoustic-baffle assemblies 10 would likely not attenuate relatively low frequencies as well as an acoustic-absorber system 100 with 100 mm high acoustic-baffle assemblies 10. In accordance with another set of embodiments, the height of the acoustic-baffle assembly 10, 10.1 is considerably shorter, for example, as short as about 10 mm, as might be utilized for acoustic tiles or wall coverings, for example, for architectural use (e.g. walls or ceilings), automotive use (e.g. headliners or door panels), or for appliances (e.g. vacuum cleaners). The overall height and diameter of the acoustic-baffle assembly 10, 10.1 could be greater than the above-stated typical range, provide that the gaps 30 between adjacent layers and the location, size and shapes of the associated orifices 32 are, in combination, sufficient to provide for sufficient deflections and scattering of the soundwaves 108 propagating through the acoustic-baffle assembly 10, 10.1 so that the soundwaves 108 exiting the acoustic-baffle assembly 10, 10.1 into the acoustic cavity 106 of the acoustic absorber system 100, 100.1, 100.2 are sufficiently phase-scrambled by the acoustic-baffle assembly 10, 10.1 so as to become attenuated within the acoustic cavity 106.

The angle of inclination θ of the conically-tapered fluted-side-wall portion 22 of the fluted-frustoconical cups 12 is determined by the same above-described geometrical constraints, being less about 90 degrees from the device's entrance surface if the acoustic-baffle assembly 10 is to be assembled from pre-formed fluted-frustoconical cups 12, and greater than or equal to about 45 degrees. For example, for one set of embodiments, depending upon the particular fluted-frustoconical cup 12, 12.1, 12.2, 12.3, 12.4, 12.5, 12.6, the angle of inclination θ ranges from 80 degrees to 65 degrees.

Figure 10D:
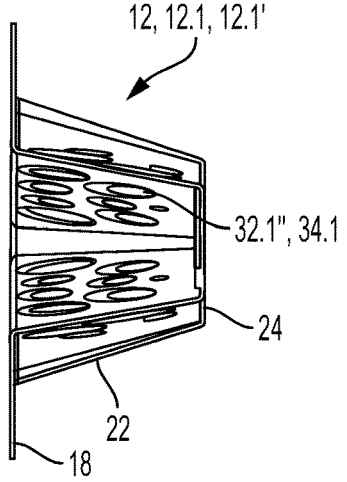
FIGS. 10*a*-10*d* respectively illustrate a bottom view, a first radial-cross-sectional view, a top view, and a second radial-cross-sectional view of a first embodiment of an inner-most, first fluted-frustoconical cup of the first-aspect acoustic-baffle assembly illustrated in FIGS. 3-9 and incorporated in FIGS. 1 and 2, wherein the first radial cross-section is through opposing ridged portions, and the second radial cross-section is through opposing grooved portions.
Figure 10C:
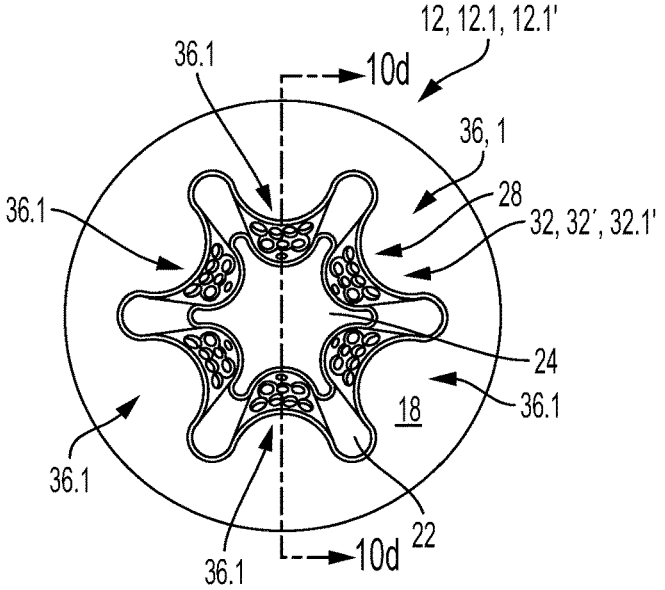
Figure 10B:
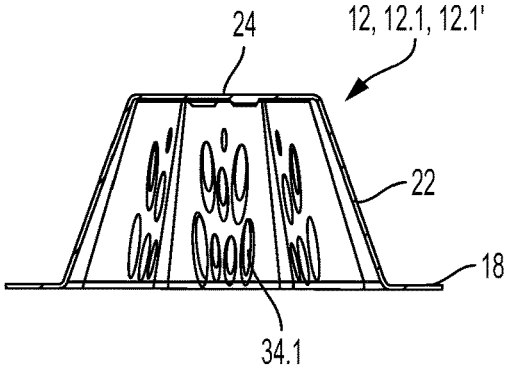
Figure 10A:
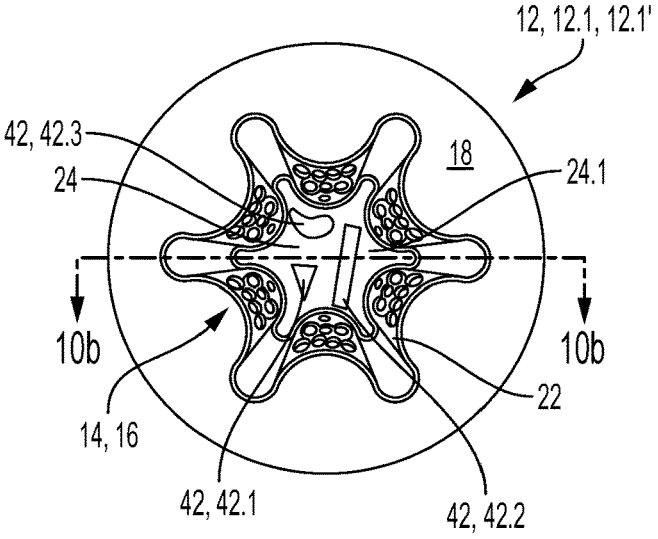
Figure 11D:
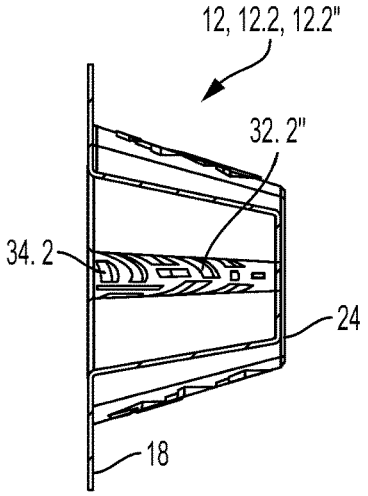
FIGS. 11*a*-11*d* respectively illustrate a bottom view, a first radial-cross-sectional view, a top view, and a second radial-cross-sectional view of a second fluted-frustoconical cup of the first-aspect acoustic-baffle assembly illustrated in FIGS. 3-9 and incorporated in FIGS. 1 and 2, wherein the first radial cross-section is through opposing ridged portions, the second radial cross-section is through opposing grooved portions, and the second fluted-frustoconical cup surrounds the first fluted-frustoconical cup in the first-aspect acoustic-baffle assembly.
Figure 11C:
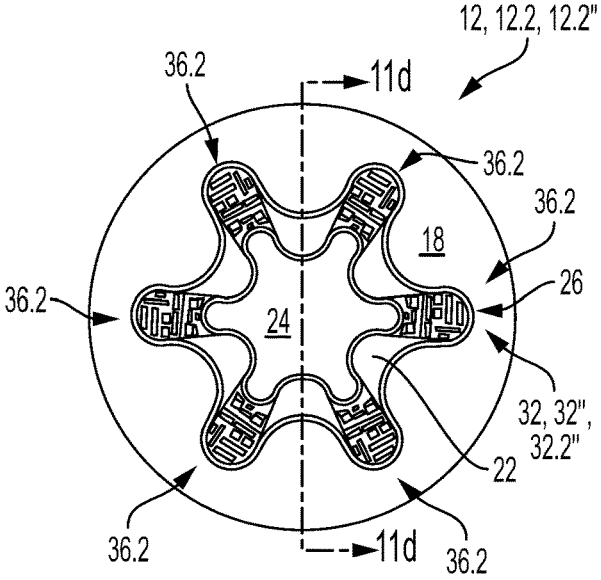
Figure 11B:
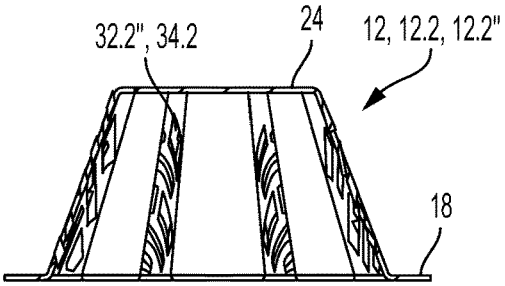
Figure 11A:
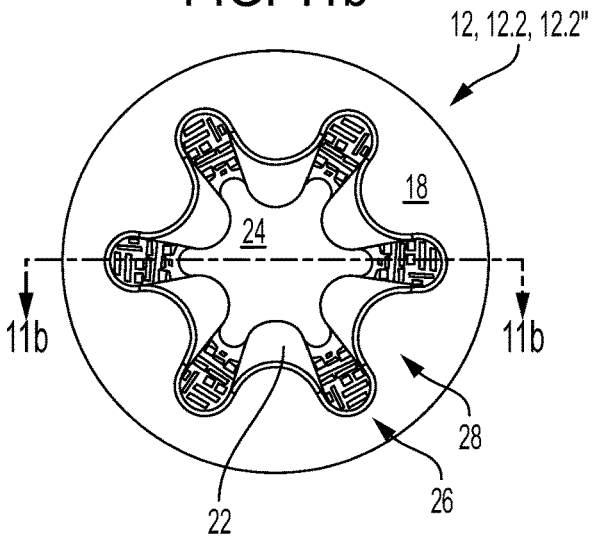
Figure 12D:
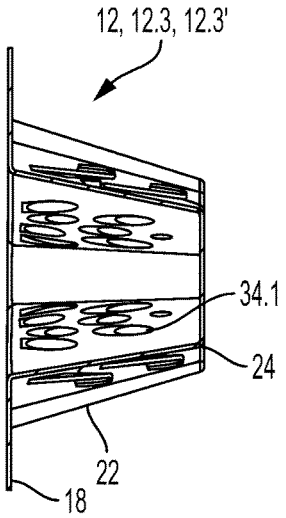
FIGS. 12*a*-12*d* respectively illustrate a bottom view, a first radial-cross-sectional view, a top view, and a second radial-cross-sectional view of a third fluted-frustoconical cup of the first-aspect acoustic-baffle assembly illustrated in FIGS. 3-9 and incorporated in FIGS. 1 and 2, wherein the first radial cross-section is through opposing ridged portions, the second radial cross-section is through opposing grooved portions, and the third fluted-frustoconical cup surrounds the second fluted-frustoconical cup in the first-aspect acoustic-baffle assembly.
Figure 12C:
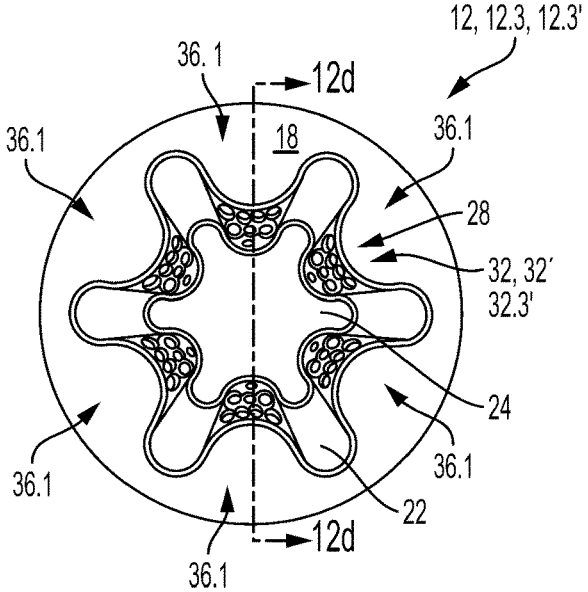
Figure 12B:
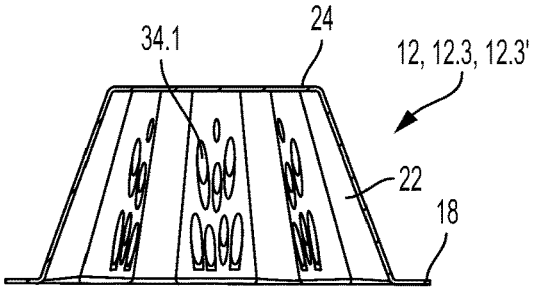
Figure 12A:
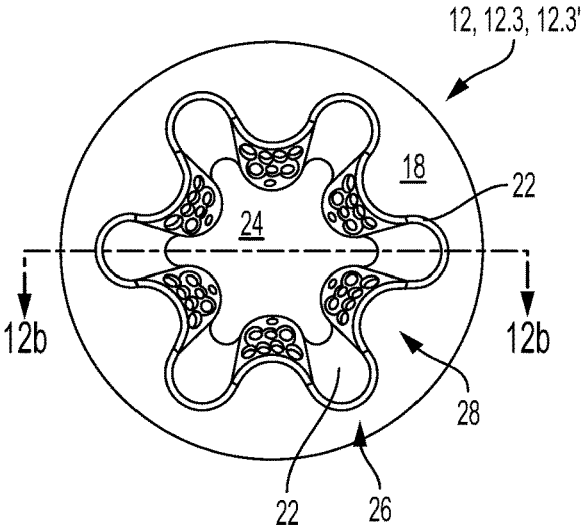
Figure 13D:
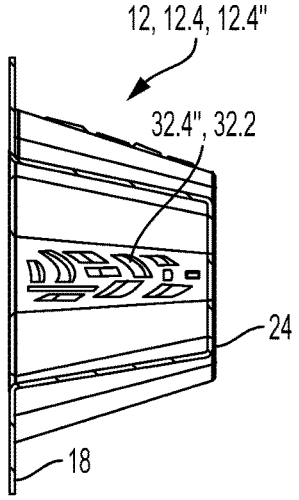
FIGS. 13*a*-13*d* respectively illustrate a bottom view, a first radial-cross-sectional view, a top view, and a second radial-cross-sectional view of a fourth fluted-frustoconical cup of the first-aspect acoustic-baffle assembly illustrated in FIGS. 3-9 and incorporated in FIGS. 1 and 2, wherein the first radial cross-section is through opposing ridged portions, the second radial cross-section is through opposing grooved portions, and the fourth fluted-frustoconical cup surrounds the third fluted-frustoconical cup in the first-aspect acoustic-baffle assembly.
Figure 13C:
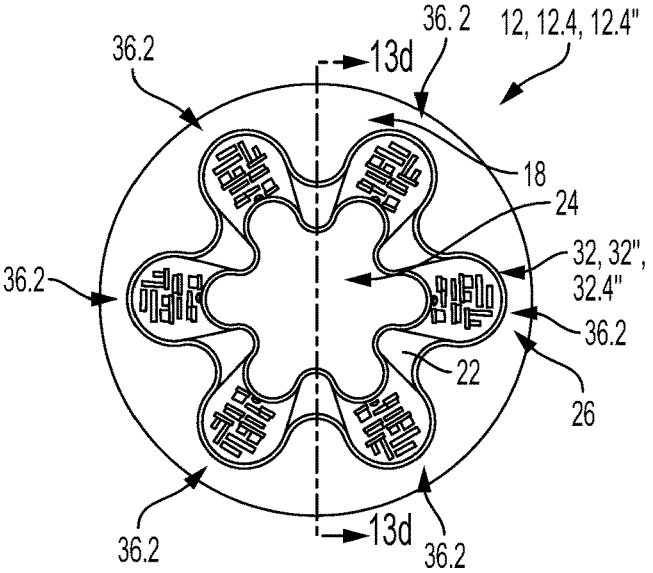
Figure 13B:
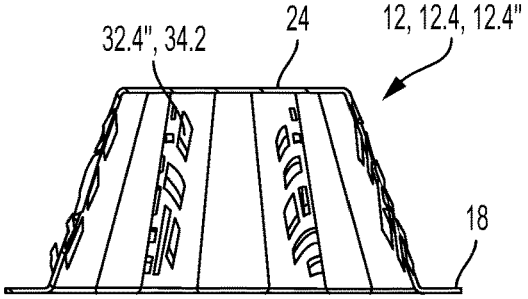
Figure 13A:
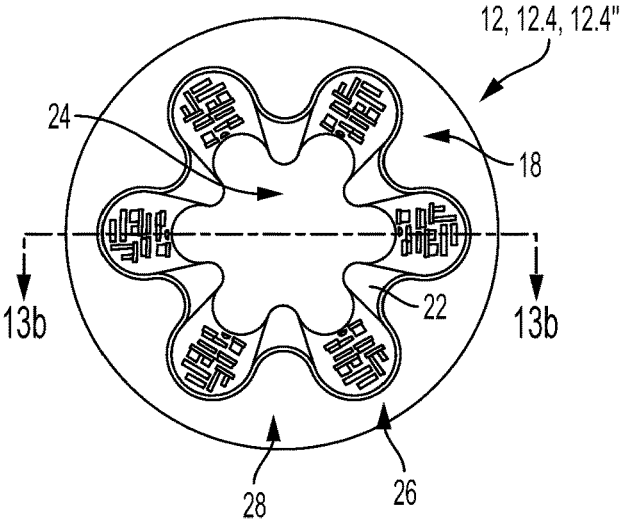
Figure 14D:
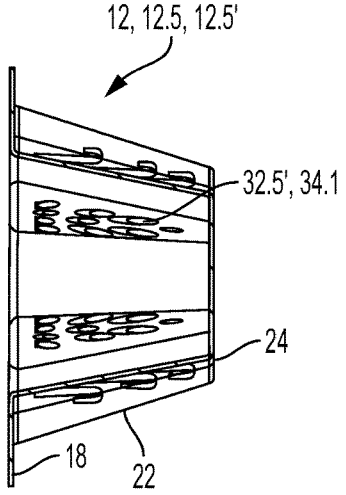
FIGS. 14*a*-14*d* respectively illustrate a bottom view, a first radial-cross-sectional view, a top view, and a second radial-cross-sectional view of a fifth fluted-frustoconical cup of the first-aspect acoustic-baffle assembly illustrated in FIGS. 3-9 and incorporated in FIGS. 1 and 2, wherein the first radial cross-section is through opposing ridged portions, the second radial cross-section is through opposing grooved portions, and the fifth fluted-frustoconical cup surrounds the fourth fluted-frustoconical cup in the first-aspect acoustic-baffle assembly.
Figure 14C:
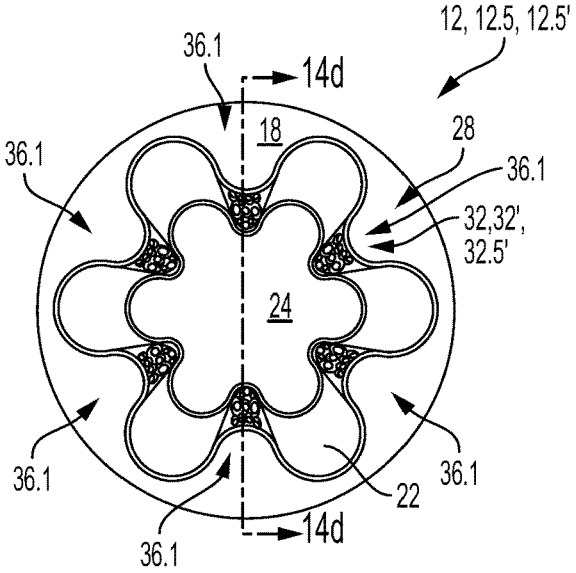
Figure 14B:
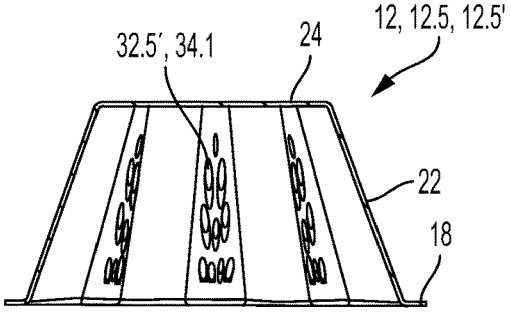
Figure 14A:
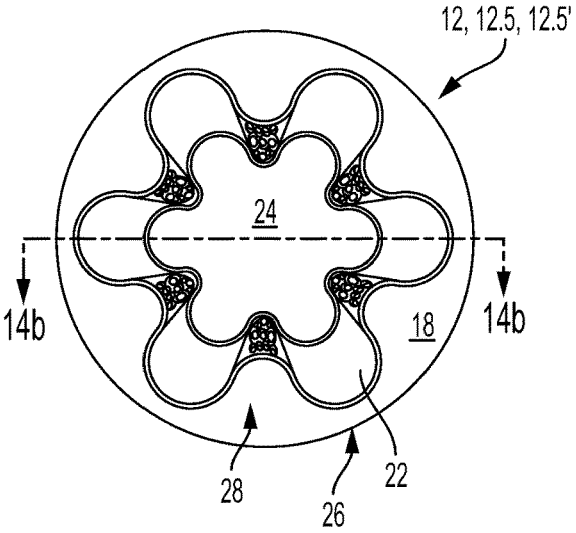
Figure 15D:
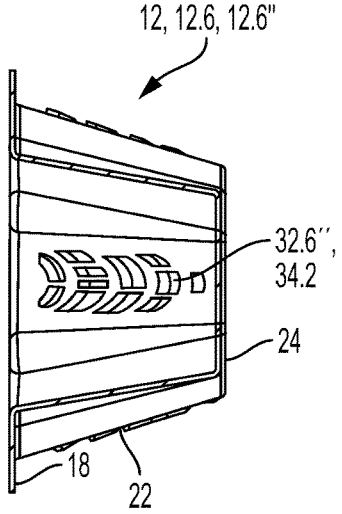
FIGS. 15*a*-15*d* respectively illustrate a bottom view, a first radial-cross-sectional view, a top view, and a second radial-cross-sectional view of an outer-most, sixth fluted-frustoconical cup of the first-aspect acoustic-baffle assembly illustrated in FIGS. 3-9 and incorporated in FIGS. 1 and 2, wherein the first radial cross-section is through opposing ridged portions, the second radial cross-section is through opposing grooved portions, and the sixth fluted-frustoconical cup surrounds the fifth fluted-frustoconical cup in the first-aspect acoustic-baffle assembly.
Figure 15C:
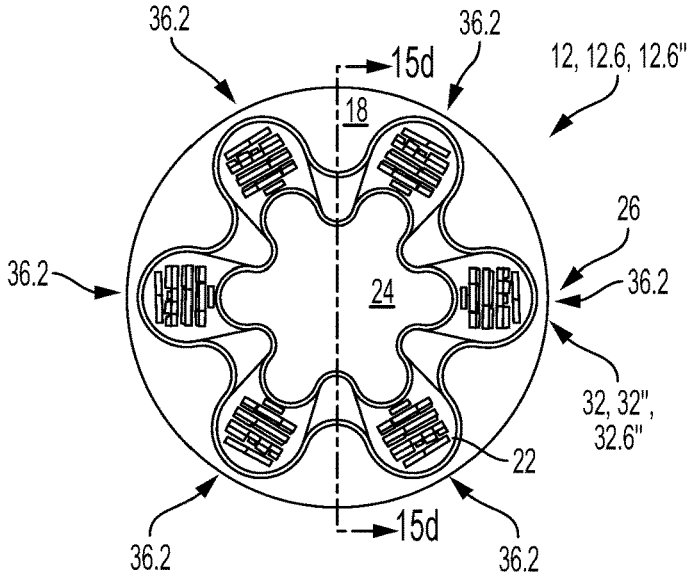
Figure 15B:
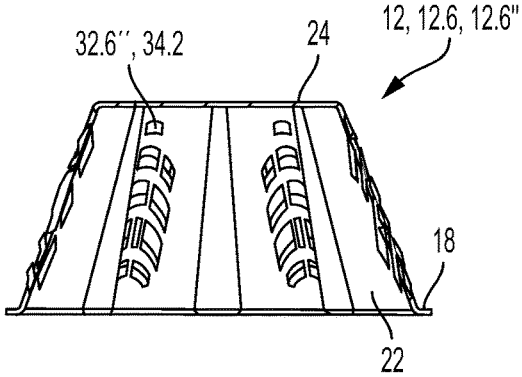
Figure 15A:
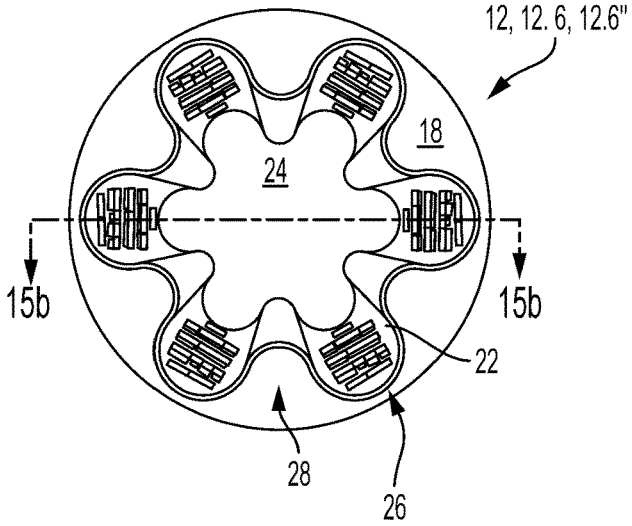
Figure 16D:
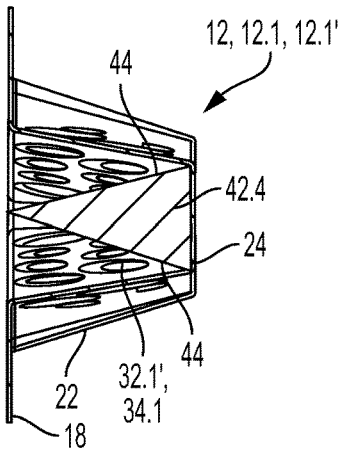
FIGS. 16*a*-16*d* respectively illustrate a bottom view, a first radial-cross-sectional view, a top view, and a second radial-cross-sectional view of a second embodiment of an inner-most, first fluted-frustoconical cup of the first-aspect acoustic-baffle assembly incorporating a fluted-segmented-conical-concave reflector to direct soundwaves into the orifices of the conically-tapered fluted-side-wall portion of the first fluted-frustoconical cup wherein the first radial cross-section is through opposing ridged portions, and the second radial cross-section is through opposing grooved portions.
Figure 16C:
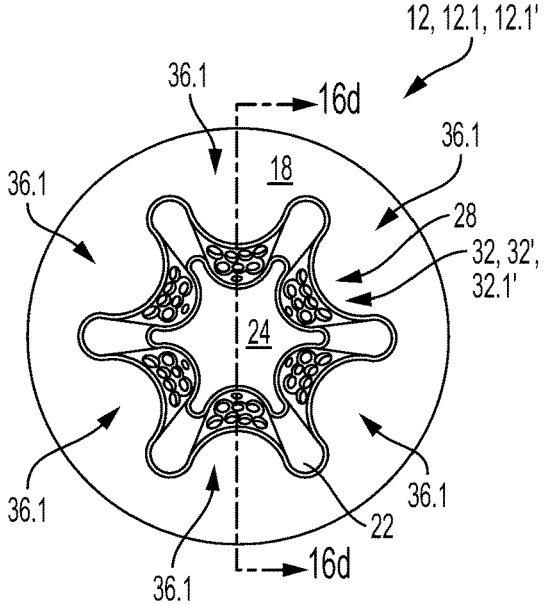
Figure 16B:
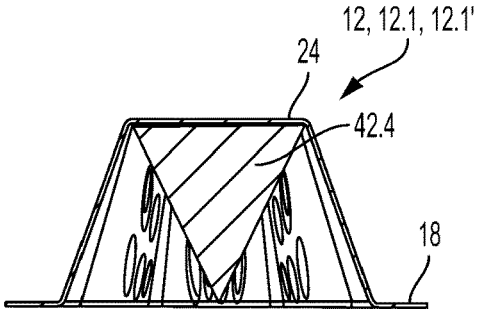
Figure 16A:
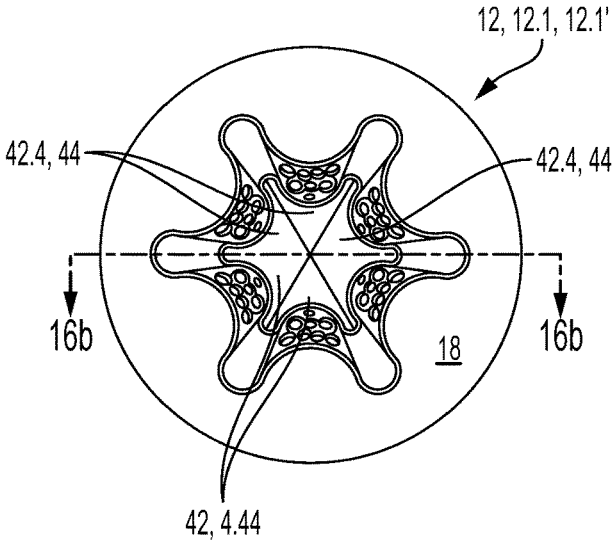

Referring to FIG. 10*a*, in one set of embodiments, the externally-exposed inside surface 24.1 of the base portion 24 of the innermost (first) fluted-frustoconical cup 12.1 is augmented with one or more raised features 42 that provide for at least partially scattering an incoming soundwave 108, so as to mitigate against a direct reflection thereof out of the acoustic inlet 16 of the acoustic-baffle assembly 10, 10.1. For example, in accordance with a first embodiment illustrated in FIG. 10*a*, the raised features 42 include a triangular-shaped scatterer 42.1, a rectangular-shaped scatterer 42.2, and a kidney-shaped scatterer 42.3.

Referring to FIGS. 16*a*-16*d*, in accordance with a second embodiment of the innermost (first) fluted-frustoconical cup 12.1, 12.1', the raised feature 42 comprises a central, fluted-segmented-conical-concave reflector 42.4 incorporating a plurality of concave tapered surfaces 44 in one-to-one azimuthal correspondence with the associated first class of locations 36.1 of the associated first class of orifices 32.1' of the innermost (first) fluted-frustoconical cup 12.1, 12.1', wherein each concave tapered surface 44 provides for focusing incoming soundwaves 108 into a corresponding associated subset of first orifices 32.1' of the innermost (first) fluted-frustoconical cup 12.1, 12.1', which also provides for mitigating against a direct reflection of incoming soundwaves 108 out of the acoustic inlet 16 of the acoustic-baffle assembly 10, 10.1. Notwithstanding the central, fluted-segmented-conical-concave reflector 42.4 is illustrated as a solid element, it should be understood that this could alternatively be constructed as a hollow shell, similar to the associated innermost (first) fluted-frustoconical cup 12.1, 12.1'.

Figure 17C:
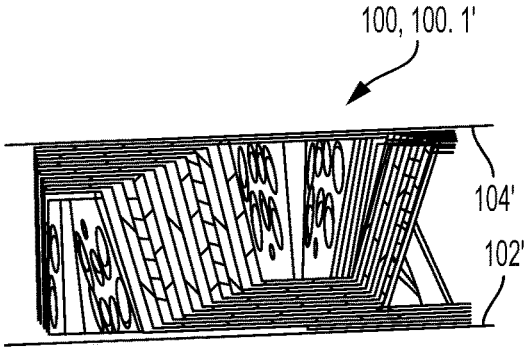
FIGS. 17*a*-17*c* respectively illustrate a plan view and first and second longitudinal-cross-sectional views of first-aspect acoustic baffles associated with a second embodiment of the first aspect of an acoustic-absorber system, absent the associated acoustic cavity.
Figure 17B:
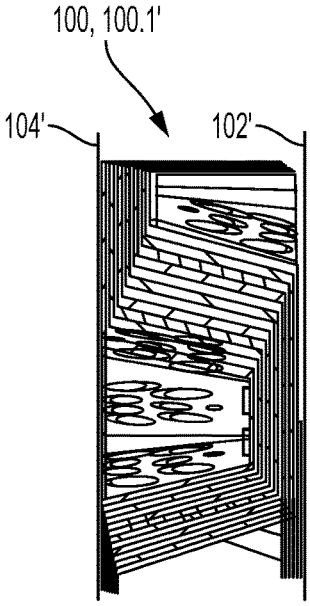
Figure 17A:
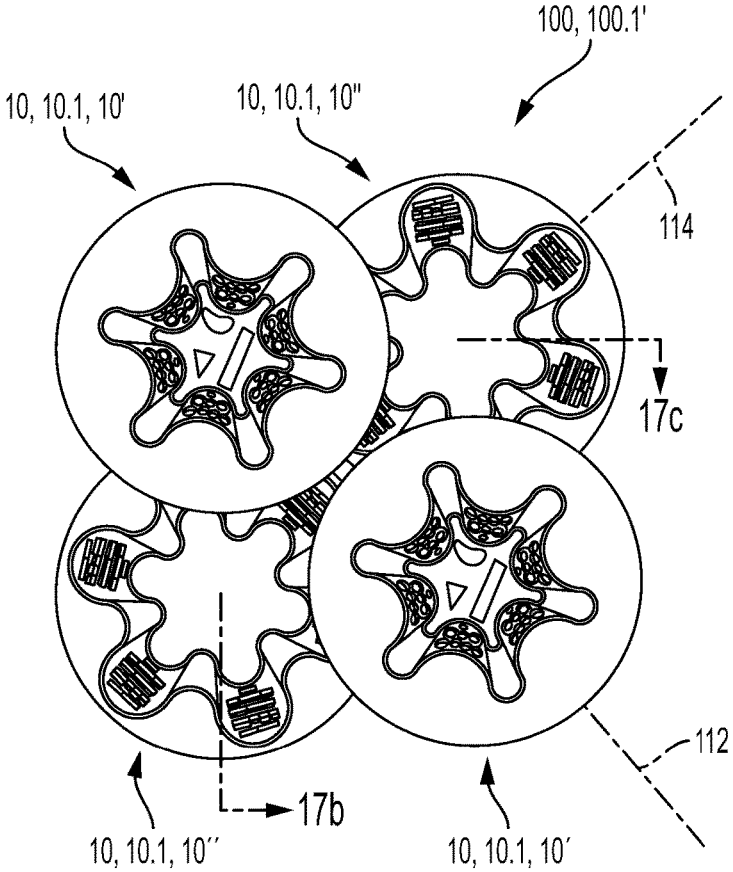

Referring to FIGS. 17*a*-17*c*, in accordance with a second embodiment of the first aspect of an acoustic-absorber system 100, 100.1', the associated acoustic-baffle assemblies 10 associated with different faces 102', 104' of an associated acoustic cavity 106 are relatively closely packed with respect to one another, for example, with the acoustic-baffle assemblies 10' associated with the first face 102' of the acoustic cavity 106 distributed along a first direction 112 and the acoustic-baffle assemblies 10" associated with the second face 104' of the acoustic cavity 106 distributed along a second direction 114, with pairs of acoustic-baffle assemblies 10', 10" associated with different faces 102', 104' spanning one another, and pairs of acoustic-baffle assemblies 10', 10" associated with the same face 102', 104' relatively close to one another to the extent possible in cooperation with the acoustic-baffle assemblies 10", 10' of the other face 104', 102'.

Referring to FIGS. 18-21, in accordance with a second aspect 10.2, an acoustic-baffle assembly 10, 10.2 incorporates a nested plurality of fluted-conical cups 46, each of which comprises radially-outwardly-extending ridged portions 26 and corresponding radially-inwardly-extending grooved portions 28, each azimuthally interleaved with respect to each other, and which incorporate specifically-shaped orifices 48 therethrough at associated specific locations that provide for soundwaves 108 to propagate into and through the acoustic-baffle assembly 10, 10.2 along convoluted tortuous, serpentine paths 38 similar to that descripted hereinabove for the first aspect of the acoustic-baffle assembly 10, 10.1. so as to similarly provide for scrambling the soundwaves 108, 108' propagating therethrough.

Figure 18:
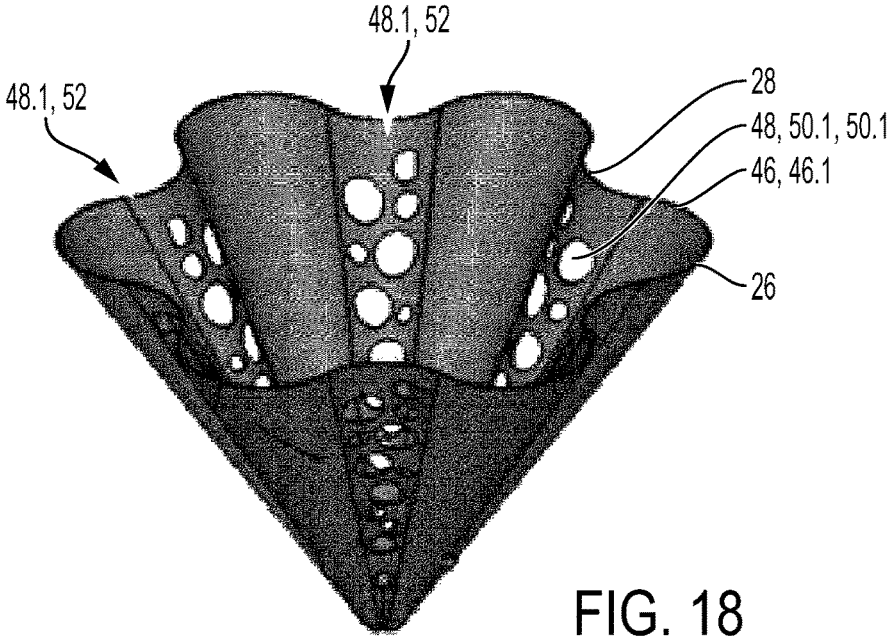
FIG. 18 illustrates a first fluted-conical cup of a second aspect of an acoustic-baffle assembly.
Figure 19:
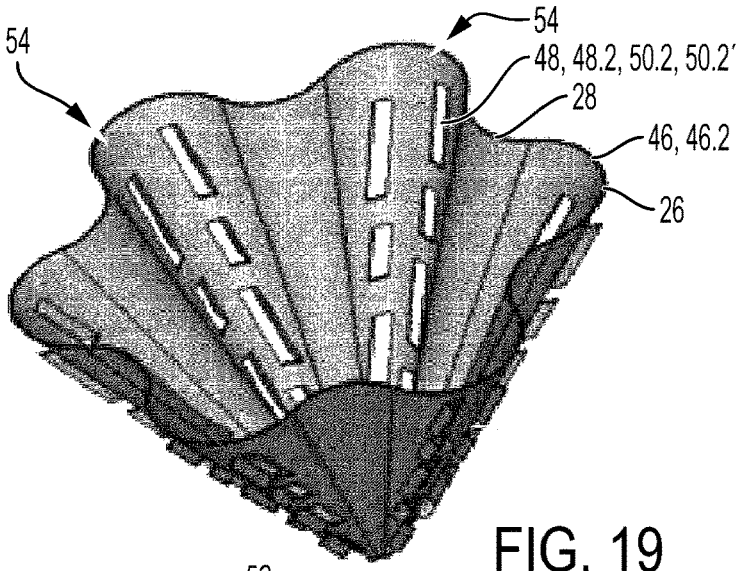
FIG. 19 illustrates a second fluted-conical cup of the second-aspect acoustic-baffle assembly, wherein the second fluted-conical cup surrounds the first fluted-conical cup in the second-aspect acoustic-baffle assembly.
Figure 20:
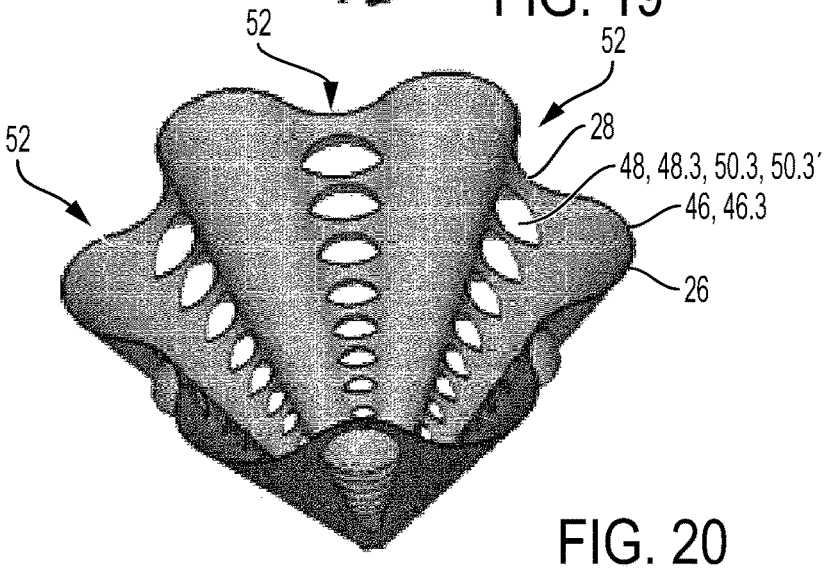
FIG. 20 illustrates a third fluted-conical cup of the second-aspect acoustic-baffle assembly, wherein the third fluted-conical cup surrounds the second fluted-conical cup in the second-aspect acoustic-baffle assembly.

Referring to FIG. 18, an innermost (first) fluted-conical cup 46.1 incorporates a first set of orifices 48.1 of a first shape 50.1—for example, a circular shape 50.1'—at a first class of locations 52. Referring to FIG. 19, a second fluted-conical cup 46.2 incorporates a second set of orifices 48.2 of a second shape 50.2—for example, a longitudinally-oriented rectangular shape 50.2'—at a second class of locations 54. Referring to FIG. 20, a third fluted-conical cup 46.3 incorporates a third set of orifices 48.3 of a third shape 50.3—for example, a transversely-oriented elliptical shape 50.3'—at the first class of locations 52, wherein the first 50.1, second 50.2 and third 50.3 shapes are different from one another, and the first 52 and second 54 classes of locations are azimuthally offset relative to each other. More particularly, the associated first class of locations 52 are proximate to the azimuthal centers of the radially-inwardly-extending grooved portions 28 of the associated fluted-conical cups 46, 46.1, 46.3, and the associated second class of locations 54 are proximate to the azimuthal centers of the radially-outwardly-extending ridged portions 26 of the associated fluted-conical cup 46, 46.2.

Figure 21:
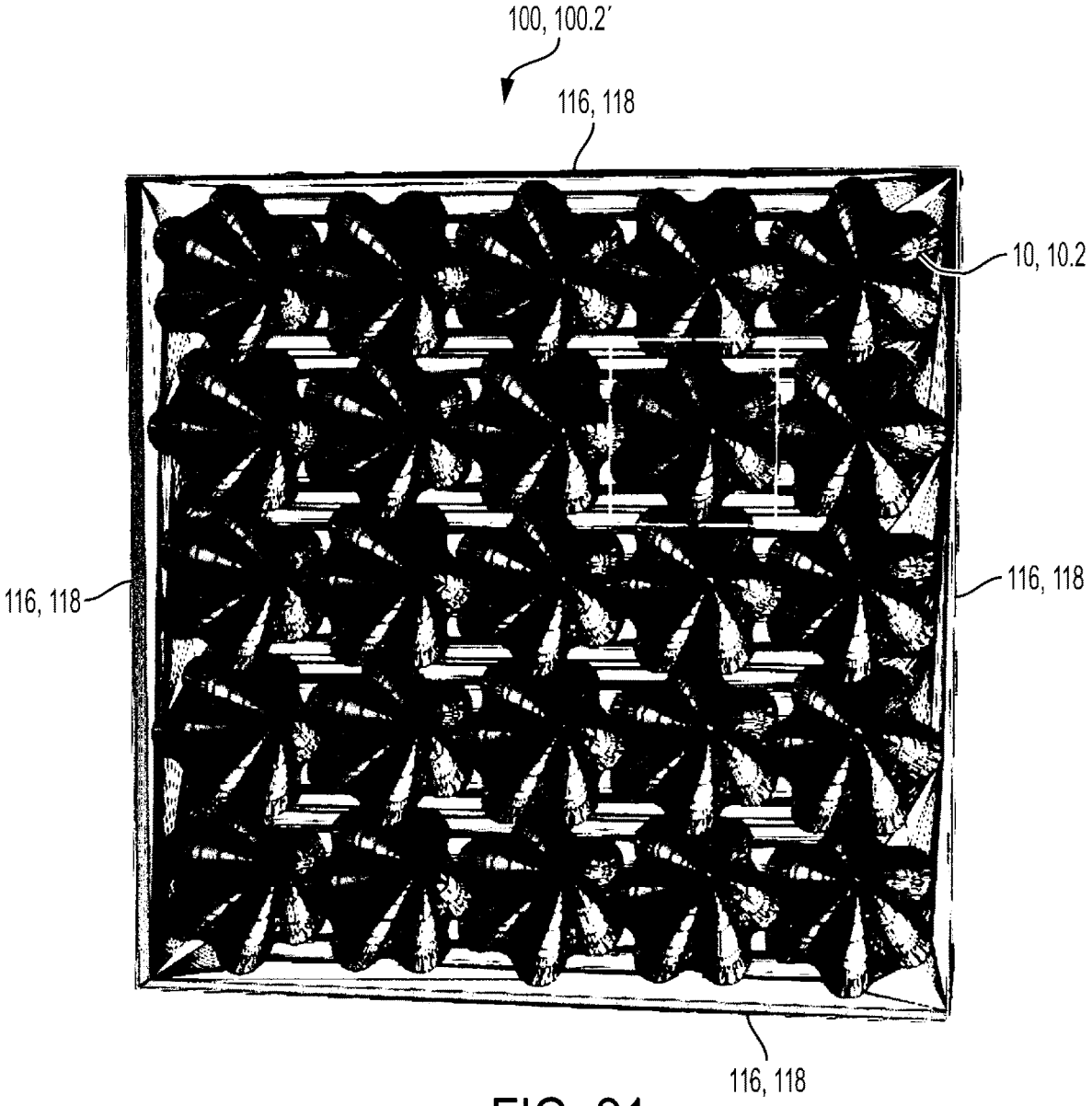
FIG. 21 illustrates a second embodiment of the second aspect of an acoustic-absorber system incorporating a plurality of second-aspect acoustic-baffle assemblies in cooperation with an associated acoustic cavity, with one of the face panels of the acoustic cavity removed.
Figure 22:
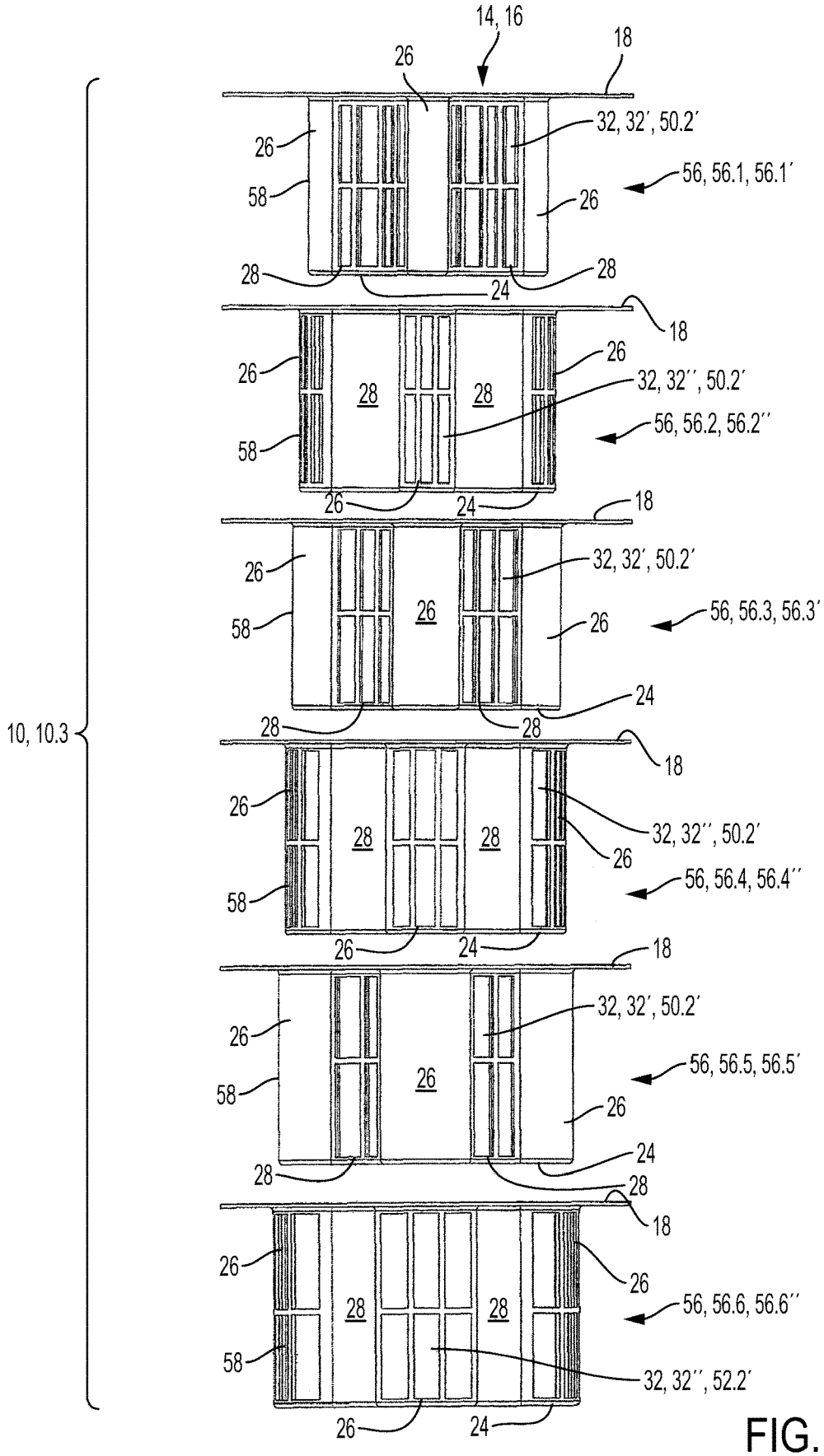
FIG. 22 illustrates a side, exploded view of a third aspect of an acoustic-baffle assembly.
Figure 23:
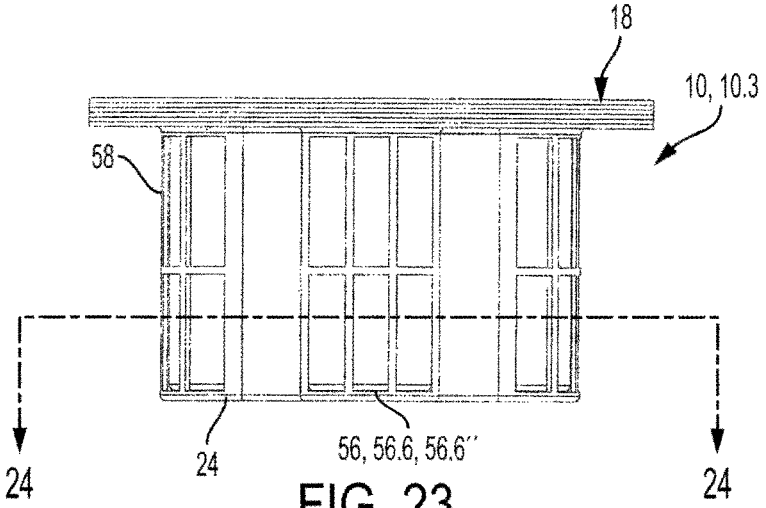
FIG. 23 illustrates a side view of the third-aspect acoustic-baffle assembly.

Referring to FIG. 21, a plurality of second-aspect acoustic-baffle assemblies 10, 10.2 are incorporated in a second embodiment of the second aspect of an acoustic-absorber system 100, 100.2', in what is also referred to as a silencer panel 100.2', wherein each of the acoustic inlets 16 are located on an active acoustically opaque face panel 102 (not visible in FIG. 21), with a continuous opposing acoustically opaque wall 104 (illustrated generally in FIG. 2), wherein the silencer panel 100.2' is illustrated in FIG. 21 without the opposing acoustically opaque wall 104 in order to show the associated acoustic-baffle assemblies 10, 10.2. Alternatively, the silencer panel 100.2' could incorporate the first aspect of the acoustic-baffle assemblies 10 (i.e. incorporating fluted-frustoconical cups 12) instead of, or in addition to, the second-aspect acoustic-baffle assemblies 10, 10.2 incorporating fluted-conical cups 46. The acoustic cavity 106 of the silencer panel 100.2' is bounded around the perimeter 116 thereof by associated acoustically opaque end panels 118. The silencer panel 100.2' is intended to be either free-standing within a room, suspended from a ceiling or overhead support, or supported from a wall, or may be incorporated into a wall or door—for example, with the active acoustically opaque face panel 102 either flush with surface of the wall or door, or recessed relative thereto so as to provide for an associated acoustically-transparent covering 110.

Alternatively, a silencer panel could be constructed in accordance with the first aspect of acoustic-absorber system 100, 100.1 with acoustic inlets 16 of the associated acoustic-baffle assemblies 10, 10.1, 10.2 on both of the acoustically opaque face panels 102, 104, i.e. with both acoustically opaque face panels 102, 104 active. Furthermore, a relatively-deeper silencer panel could be constructed with acoustic inlets 16 of the associated acoustic-baffle assemblies 10, 10.1, 10.2 on one or more of the associated acoustically opaque end panels 118, either in addition to, or instead of, acoustic inlets 16 on one or both of the acoustically opaque face panels 102, 104.

Referring to FIGS. 22-26, in accordance with a third aspect 10.3, an acoustic-baffle assembly 10, 10.3 is similar in all respects to the first-aspect acoustic-baffle assembly 10, 10.1 illustrated in FIGS. 1-17*c*, except that the angle of inclination θ is nominally 90 degrees, so as to comprise a nested plurality of fluted-prismatic cups 56, 56.1, 56.2, 56.3, 56.4, 56.5, 56.6—instead of a plurality of fluted-frustoconical cups 12, 12.1, 12.2, 12.3, 12.4, 12.5, 12.6. Each fluted-prismatic cup 56 comprises an associated radially-extending flange portion 18 around an associated rim portion 20, a fluted-prismatic-side-wall portion 58, and a base portion 24. Each fluted-prismatic-side-wall portion 58 comprises radially-outwardly-extending ridged portions 26 and corresponding radially-inwardly-extending grooved portions 28 azimuthally interleaved therewith. Although FIGS. 22-26 illustrate an acoustic-baffle assembly 10, 10.3 having six radially-outwardly-extending ridged portions 26 and six radially-inwardly-extending grooved portions 28, generally, the number of radially-outwardly-extending ridged portions 26 and radially-inwardly-extending grooved portions 28 would each be typically between three and eight.

The plurality of fluted-prismatic cups 56, 56.1, 56.2, 56.3, 56.4, 56.5, 56.6 are nested with respect to one another in the acoustic-baffle assembly 10, 10.3. In one set of embodiments, the fluted-prismatic cups 56, 56.1, 56.2, 56.3, 56.4, 56.5, 56.6 are shaped and sized so that the gaps between adjacent fluted-prismatic cups 56, 56.1, 56.2, 56.3, 56.4, 56.5, 56.6—both between adjacent fluted-prismatic-side-wall portions 22 and between adjacent base portions 24—are substantially uniform, for example, between 0.5 mm (0.02 in.) depending upon other constraints, with the second fluted-prismatic cup 56.2 surrounding the innermost (first) fluted-prismatic cup 56.1 and surrounded by the third fluted-prismatic cup 56.3, with the fourth fluted-prismatic cup 56.4 surrounding the third fluted-prismatic cup 56.3 and surrounded by the fifth fluted-prismatic cup 56.5, and with the outermost (sixth) fluted-prismatic cup 56.6 surrounding the fifth fluted-prismatic cup 56.5. Although the embodiments of the acoustic-baffle assembly 10, 10.3 illustrated in FIGS. 22-26 each incorporate six fluted-prismatic cups 56, generally between three and six fluted-prismatic cups 56 will be sufficient, with five having been found to provide good overall performance.

The outside diameters of the flange portions 18 of each of the first 56.1, second 56.2, third 56.3, fourth 56.4, fifth 56.5 and sixth 56.6 fluted-prismatic cups are substantially the same so as to provide for readily centering the set of fluted-prismatic cups 56, 56.1, 56.2, 56.3, 56.4, 56.5, 56.6 with respect to one another when nested together. Furthermore, adjacent flange portions 18 may incorporate corresponding features that provide for azimuthally—and possibly also radially—keying adjacent fluted-prismatic cups 56, 56.1, 56.2, 56.3, 56.4, 56.5, 56.6 with respect to one another. For example, these features may be stamped as a combined plug and socket element into each of the flange portions 18 of each of the fluted-prismatic cups 56, 56.1, 56.2, 56.3, 56.4, 56.5, 56.6 that are formed by stamping, deep drawings, or additive manufacturing, wherein plug portions of one flange portion 18 of one fluted-frustoconical cups 12 would engage with corresponding mating socket portions of an adjacent flange portion 18 of an adjacent fluted-prismatic cup 56.

The fluted-prismatic-side-wall portion 58 of the fluted-prismatic cups 56 incorporate specifically-shaped orifices 32 therethrough at associated specific locations that contributes to the above-referenced scrambling action of the acoustic-baffle assembly 10, 10.3. More particularly, every other fluted-prismatic cup 56, 56.1, 56.3, 56.5 in the acoustic-baffle assembly 10, 10.3 incorporates a first class of orifices 32' of a longitudinally-oriented rectangular shape 50.2' at a first class of locations 36.1, and the remaining every other fluted-prismatic cup 56, 56.2, 56.4, 56.6 in the acoustic-baffle assembly 10, 10.3 incorporates a second class of orifices 32" of a longitudinally-oriented rectangular shape 50.2' at second class of locations 36.2, wherein the first 36.1 and second 36.2 classes of locations are azimuthally offset from one another so as to force the soundwaves 108 to travel along a serpentine path 38 in order to pass through the acoustic-baffle assembly 10, 10.3. In accordance with the first class of orifices 32', the associated first class of locations 36.1 are proximate to the centers of the radially-inwardly-extending grooved portions 28 of the fluted-prismatic side-wall-portion 58 of the associated fluted-prismatic cup 56, 56.1', 56.3', 56.5'. In accordance with the second class of orifices 32", the associated second class of locations 36.2 are proximate to the centers of the radially-outwardly-extending ridged portions 26 of the fluted-prismatic-side-wall portion 58 of the associated fluted-prismatic cup 56, 56.2", 56.4", 56.6". Alternatively, the orifices 32 could be shaped in accordance with the above-described first 10.1 or second 10.2 aspects, or relatively-simply shaped, for example, having either a circular, elliptical, square, or polygonal shape, or some other shape, for example, that can be punched, for example, after forming the fluted-prismatic cups 56, 56.1, 56.2, 56.3, 56.4, 56.5, 56.6 by a deep-drawing process, Generally, the first 34.1 and second 34.2 shapes could be either similar or different, the first shape 34.1 could be different for some or each associated every other fluted-prismatic cup 56, 56.1, 56.3, 56.5 in the acoustic-baffle assembly 10, 10.3, and the second shape 34.2 could be different for some or each associated remaining every other fluted-prismatic cup 56, 56.2, 56.4, 56.6 in the acoustic-baffle assembly 10, 10.3.

The number, depth, and shape of the outwardly-extending ridged portions 26 and corresponding radially-inwardly-extending grooved portions 28 are configured so as to cause the soundwaves 108 propagating therethrough to follow a myriad of tortuous paths therethrough that cause the soundwaves 108 therewithin, and exiting therefrom to an acoustic cavity 106 of the associated acoustic-absorber system 100, 100.1, 100.2, to become phase-scrambled, which in turn results in a substantial attenuation of the amplitudes of the soundwaves 108 within the acoustic cavity 106 of the acoustic-absorber system 100, 100.1, 100.2.

Figure 24:
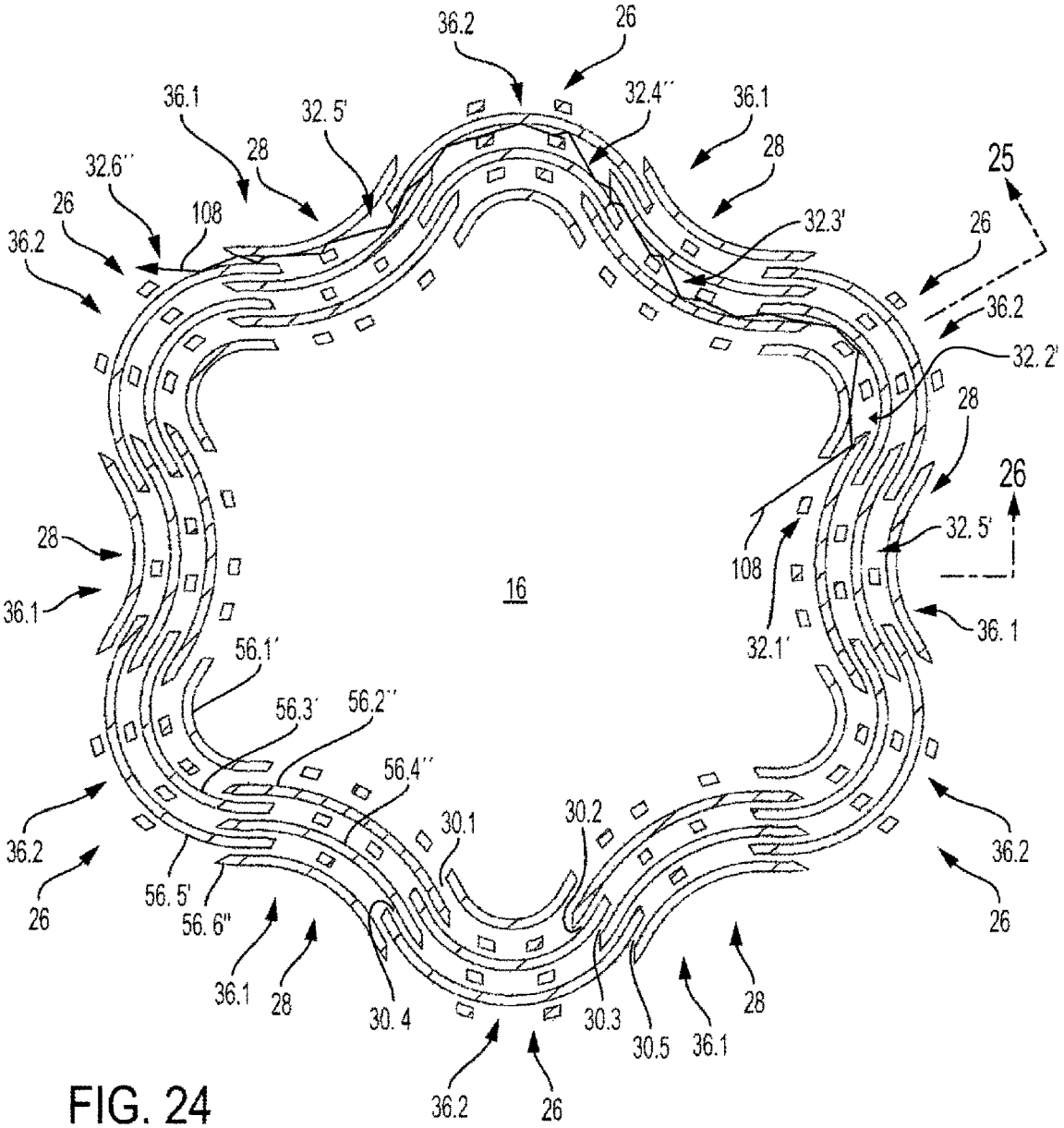
FIG. 24 illustrates an expanded transverse-cross-sectional view of the third-aspect acoustic-baffle assembly illustrated in FIGS. 22, 23, 25 and 26.
Figure 25:
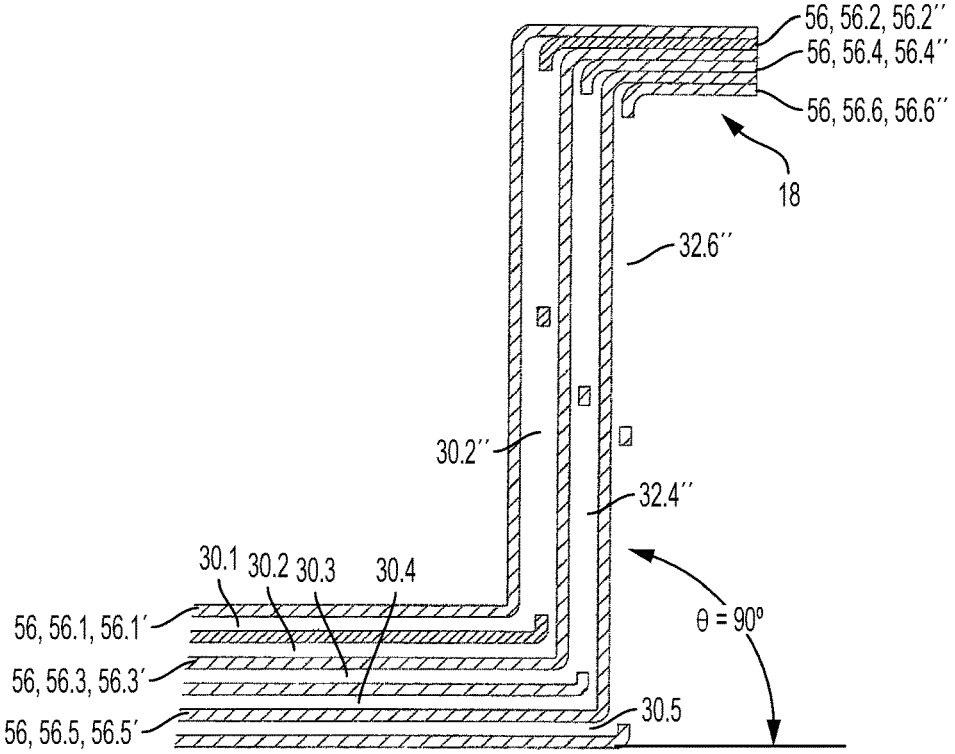
FIG. 25 illustrates a first expanded radial cross-section through a ridged portion of the third-aspect acoustic-baffle assembly illustrated in FIGS. 22-24.
Figure 26:
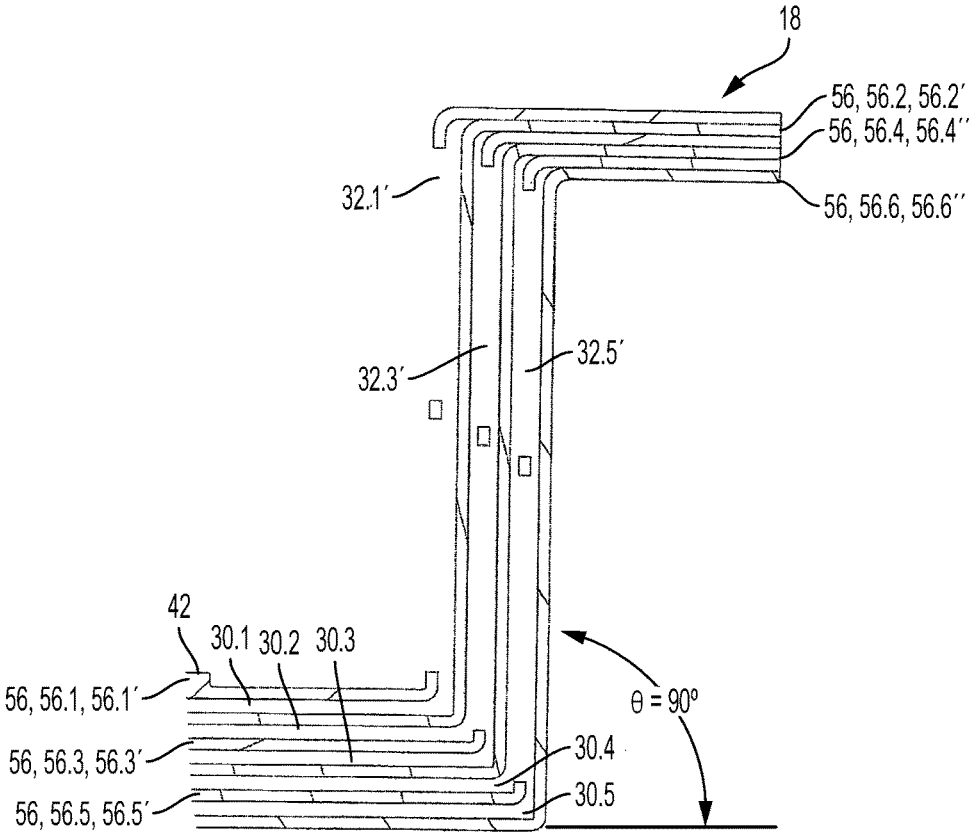
FIG. 26 illustrates a second expanded radial cross-section through a grooved portion of the third-aspect acoustic-baffle assembly illustrated in FIGS. 22-24.

Referring to FIG. 24, the operation of the acoustic-baffle assembly 10, 10.3 is the same as described hereinabove—with reference hereinabove to FIGS. 7, 3, 4 and 10*a*-10*d* through 15*a*-15*d*—for the first-aspect acoustic-baffle assembly 10, 10.1, except for references to a fluted-frustoconical cup 12 of the first-aspect acoustic-baffle assembly 10, 10.1 being replaced with references to corresponding fluted-prismatic cups 56 of the third-aspect acoustic-baffle assembly 10, 10.3.

Alternatively, the third aspect acoustic baffle assembly 10, 10.3 could incorporate a central, fluted-segmented-conical-concave reflector 42.4 depending the inside of the associated inside surface 24.1 of the base portion 24 of the innermost fluted prismatic cup 56, 56.1, for example, similar to that illustrated in FIGS. 16*a*-16*d* for the first aspect acoustic baffle assembly 10, 10.1.

Referring to FIGS. 27*a*-29, a fourth aspect 10.4 of an associated acoustic-baffle assembly 10, 10.4 incorporates a nested plurality of fluted-pyramidal cups 60, 60.1, 60.2, 60.3, 60.4, 60.5, each of which comprises an associated radially-extending flange portion 62 around an associated rim portion 64, and a plurality of planar side-wall portions 66 extending from the rim portion 64 to an associated apex 68. As used herein, the term apex refers to the location on the associated cup that is axially farthest from the associated rim of the cup, particularly for cups that do not incorporate a planar base portion (e.g. base portion 24). The planar side-wall portions 66 define a plurality of radially-outwardly-extending ridged portions 70 and corresponding plurality of radially-inwardly-extending grooved portions 72, each azimuthally interleaved with respect to each other, and which incorporate specifically-shaped orifices 74 therethrough at associated specific locations that provide for soundwaves 108 to propagate into and through the acoustic-baffle assembly 10, 10.4 along convoluted tortuous, serpentine paths 38 similar to that descripted hereinabove for the first aspect of the acoustic-baffle assembly 10, 10.1, so as to similarly provide for scrambling the soundwaves 108, 108' propagating therethrough. The number, depth, and shape of the radially-outwardly-extending ridged portions 70 and corresponding radially-inwardly-extending grooved portions 72 are configured so as to cause the soundwaves 108 propagating therethrough to follow a myriad of tortuous paths therethrough that cause the soundwaves 108 therewithin, and exiting therefrom to an acoustic cavity 106 of the associated acoustic-absorber system 100, 100.1, 100.2 to become phase-scrambled, which in turn results in a substantial attenuation of the amplitudes of the soundwaves 108 within the acoustic cavity 106 of the acoustic-absorber system 100, 100.1, 100.2. Although FIGS. 27*a*-29 illustrate an acoustic-baffle assembly 10, 10.4 having four radially-outwardly-extending ridged portions 70 and four radially-inwardly-extending grooved portions 72, generally, the number of radially-outwardly-extending ridged portions 70 and radially-inwardly-extending grooved portions 72 would each be typically between three and eight.

Figure 29:
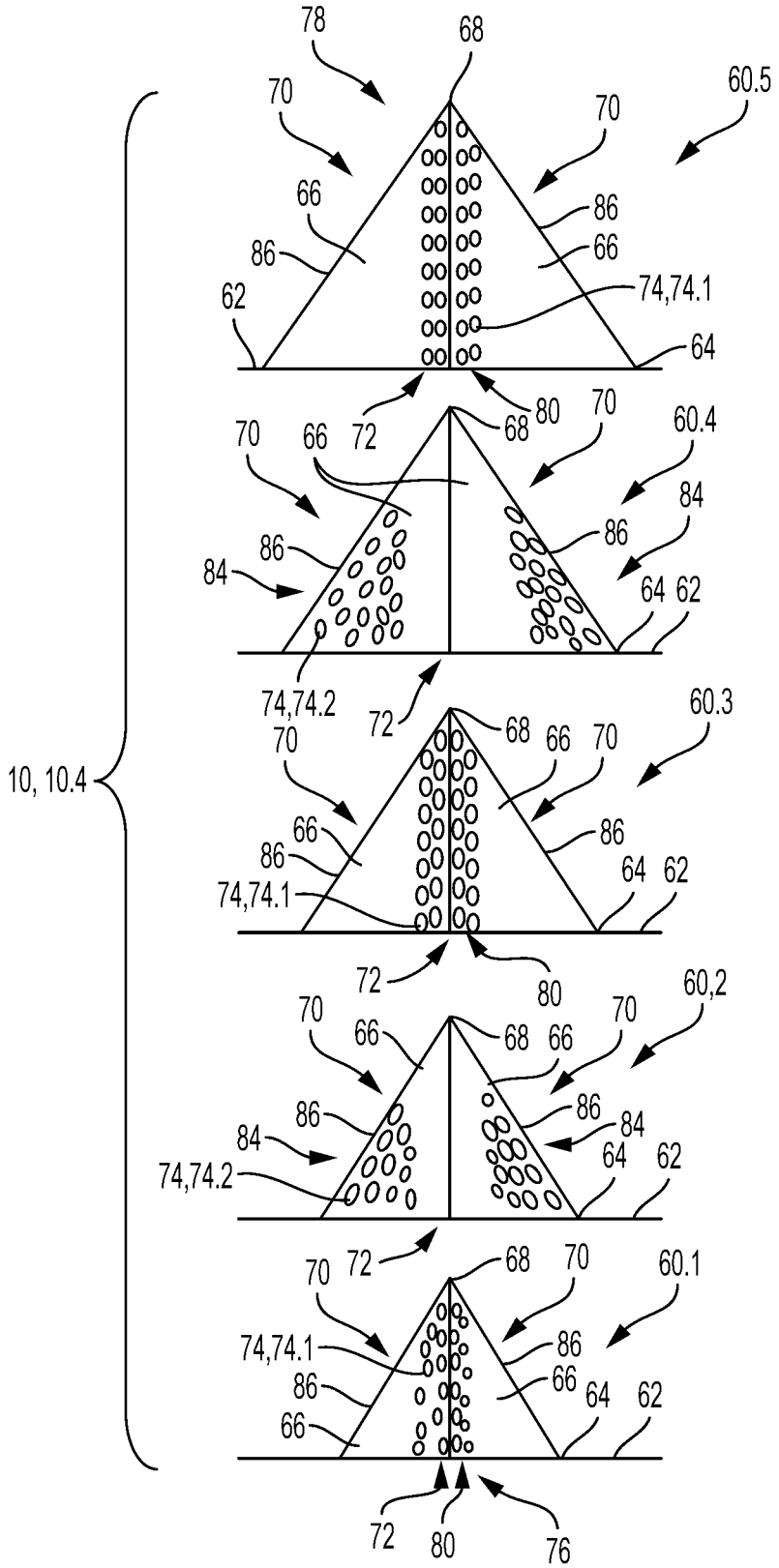
FIG. 29 illustrates a side, exploded view of a fourth aspect of an acoustic-baffle assembly comprising a plurality of fluted-pyramidal cups, wherein the second and third fluted-pyramidal cups of the fourth-aspect acoustic-baffle assembly are respectively the second and first embodiments of fluted-pyramidal cups illustrated in FIGS. 28*a-c* and 27*a-c*, respectively.

Referring to FIG. 29, in accordance with one set of embodiments, the innermost (first) fluted-pyramidal cup 60.1 defines an acoustic inlet 76 of the acoustic-baffle assembly 10, 10.4. The innermost (first) fluted-pyramidal cup 60.1 is nested in a second fluted-pyramidal cup 60.2, which in turn is nested in a third fluted-pyramidal cup 60.3, the latter of which in turn is nested in a fourth fluted-pyramidal cup 60.4, and finally, the latter of which in turn is nested in an outermost (fifth) fluted-pyramidal cup 60.5, the latter of which defines an acoustic outlet 78 that is in fluid communication with the associated acoustic cavity 106 of the acoustic-absorber system 100, 100.1, 100.2. Alternatively, the acoustic-baffle assembly 10, 10.4 could be oriented with respect to the associated acoustic cavity 106 with the locations of the acoustic inlet 76 and the acoustic outlet 78 juxtaposed with respect to one another relative to the acoustic-baffle assembly 10, 10.4.

Figure 27A:
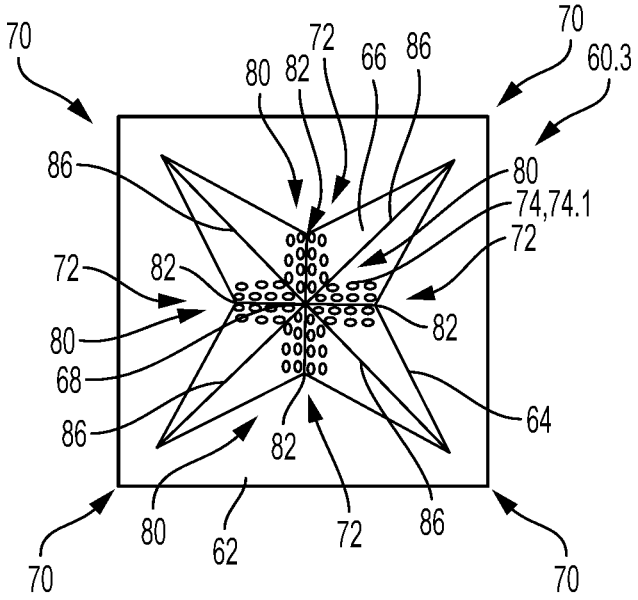
FIGS. 27*a*-27*c* respectively illustrate a top or bottom view, a first orthogonal side view, and a second orthogonal side view of a first embodiment of a fluted-pyramidal cup incorporating a first class of associated orifices.
Figure 27C:
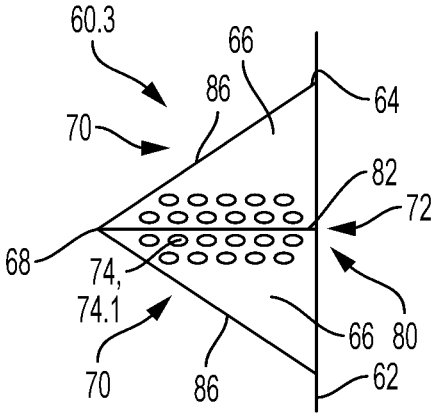
Figure 27B:
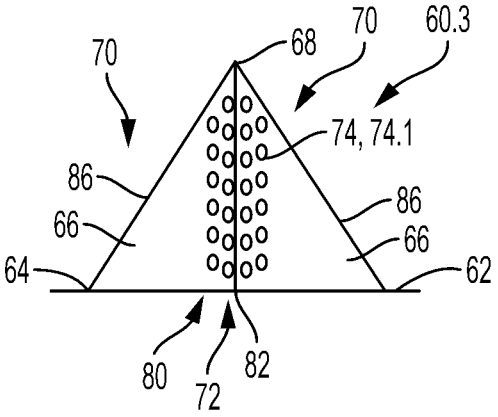

Referring to FIGS. 27*a*-27*c*, the third fluted-pyramidal cup 60.3 incorporates a first class of orifices 74.1—for example, of a generally circular shape—at a first class of locations 80 proximate to a valley 82 of each of the radially-inwardly-extending grooved portions 72. The first 60.1 and fifth 60.5 fluted-pyramidal cups are similarly constructed.

Figure 28A:
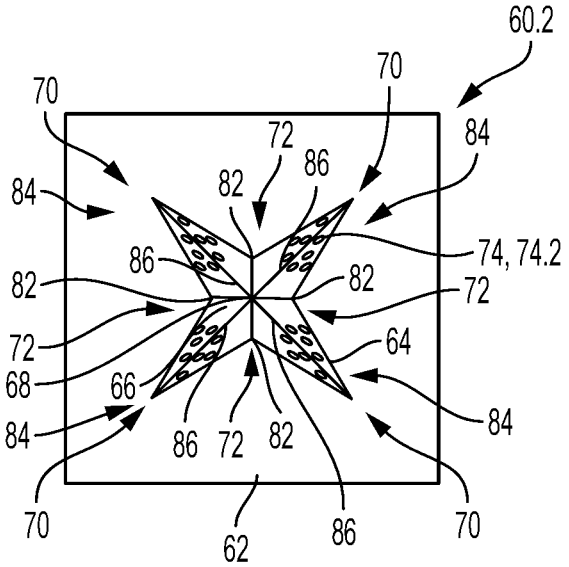
FIGS. 28*a*-28*c* respectively illustrate a top or bottom view, a first orthogonal side view, and a second orthogonal side view of a second embodiment of a fluted-pyramidal cup incorporating a second class of associated orifices.
Figure 28C:
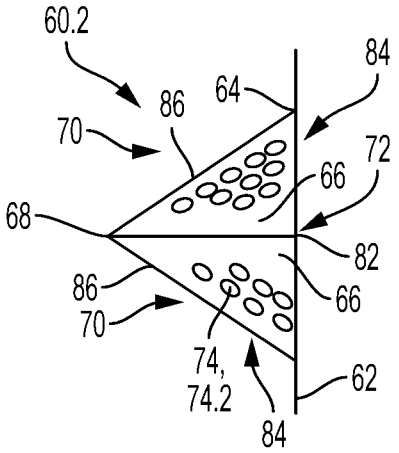
Figure 28B:
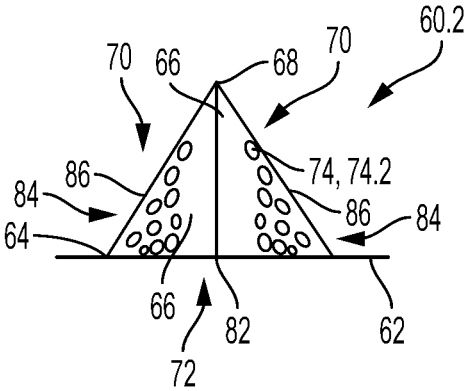

Referring to FIGS. 28*a*-28*c*, the second fluted-pyramidal cup 60.2 incorporates a second class of orifices 74.2—for example, of a generally circular shape—at a second class of locations 84 proximate to a ridge 86 of each of the radially-outwardly-extending ridged portions 70. The fourth fluted-pyramidal cup 60.4 is similarly constructed.

The first 80 and second 84 classes of locations are azimuthally offset relative to each other. More particularly, the associated first class of locations 80 are proximate to the azimuthal centers of the radially-inwardly-extending grooved portions 72 of the associated fluted-pyramidal cups 60, 60.1, 60.3, 60.5—i.e. proximate to the valleys 82, —and the associated second class of locations 84 are proximate to the azimuthal centers of the radially-outwardly-extending ridged portions 70 of the associated fluted-pyramidal cups 60, 60.2, 60.3—i.e. proximate to the ridges 86, —wherein the areas over which the first 80 and second 84 class of locations are distributed are sufficiently offset from one another so as to prevent a direct path of soundwaves 108 from the first class of orifices 74.1 to the second class of orifices 74.2, so that the soundwaves 108 propagating through the acoustic-baffle assembly 10, 10.4 follow a myriad of tortuous paths therethrough along a plurality of associated convoluted, serpentine paths 38 that cause the soundwaves 108 therewithin, and exiting therefrom to an acoustic cavity 106 of the associated acoustic-absorber system 100, 100.1, 100.2, to become phase-scrambled, which in turn results in a substantial attenuation of the amplitudes of the soundwaves 108 within the acoustic cavity 106 of the associated acoustic-absorber system 100, 100.1, 100.2.

For each of the above-described aspects, the acoustic baffle assemblies 10, 10.1, 10.2, 10.3, 10.4 may be assembled by nesting together associated individually-manufactured cups 12, 46, 56, 60. It should be understood that the acoustic baffle assembly 10 is not limited to above-described fluted frustoconical 12, fluted conical 46, fluted prismatic 56 or fluted pyramidal 60 cup shapes, but could be constructed as a shell of any fluted-solid shape for which associated cup elements thereof—of a range of sizes—are nestable with one another. For example, a fluted-ellipsoidal shape might be utilized, for which a region proximate to the apex thereof might be void of orifices 32, and therefore topologically similar to the base portion 24 of the above-described fluted frustoconical 12 and fluted prismatic 56 cups, and for which the remaining portion thereof is fluted and contains the associated orifices 32, so as to be topologically similar to the above-described conically-tapered fluted 22, fluted prismatic 58, planar 66. side-wall portions.

Referring to FIGS. 30-33, a first embodiment of a fifth aspect 10.5 of an acoustic-baffle assembly 10, 10.5, 10.5' is similar to the first-aspect acoustic-baffle assembly 10, 10.1 illustrated in FIGS. 1-17*c*, except that the angle of inclination θ is greater than 90 degrees, so as to comprise a nested plurality of fluted-inverted-frustoconical cups 88, 88.1, 88.2, 88.3, 88.4—instead of a nested plurality of corresponding fluted-frustoconical cups 12, 12.1, 12.2, 12.3, 12.4. The acoustic baffle assembly 10, 10.5, 10.5' comprises a flange portion 90 to which are either integrated, or operatively coupled, the associated rim portions 92 of each of the fluted-inverted-frustoconical cups 88, 88.1, 88.2, 88.3, 88.4. Each fluted-inverted-frustoconical cup 88 further comprises a fluted-inverted-frustoconical-side-wall portion 94, and a base portion 96.

Figure 30:
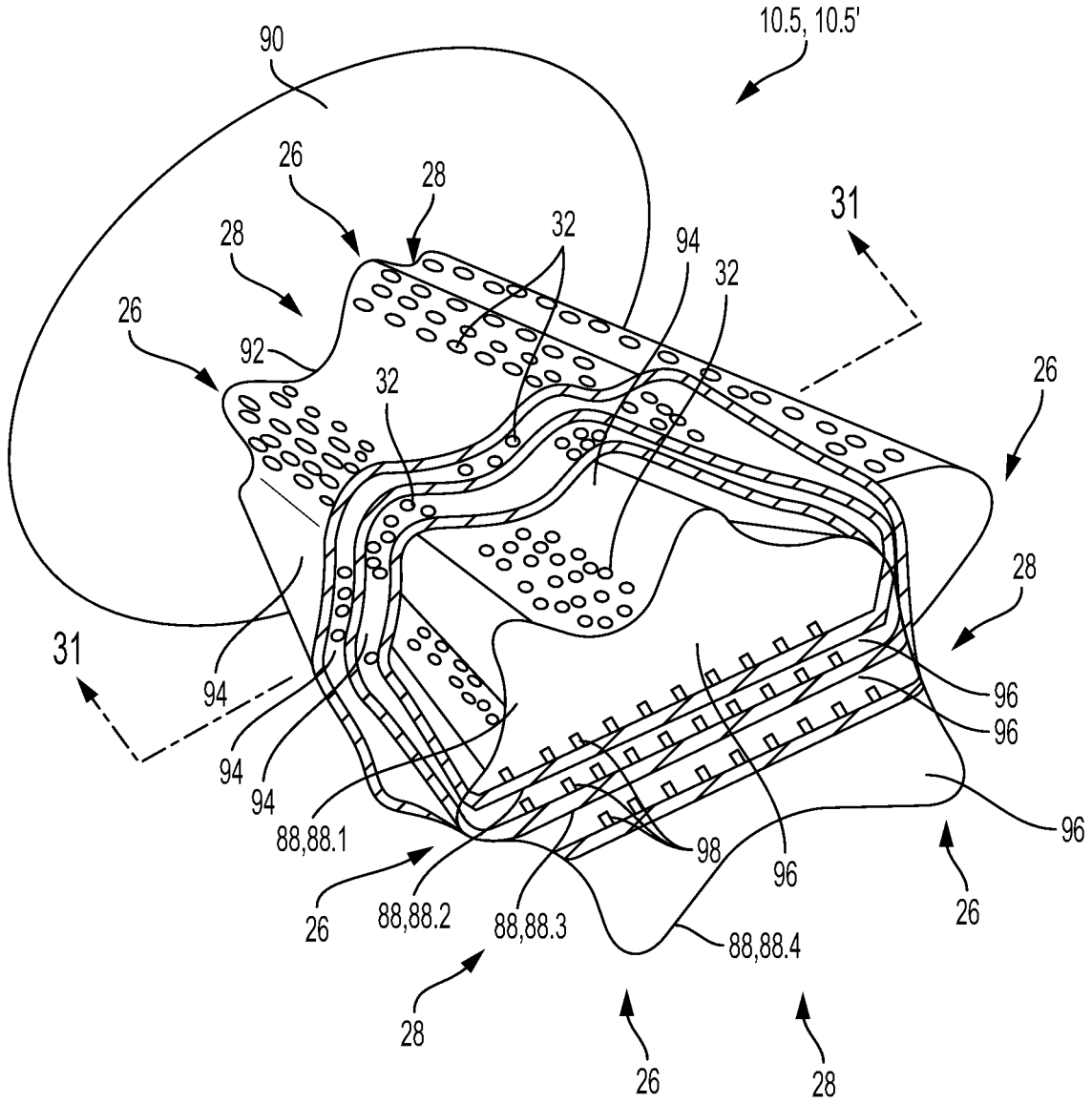
FIG. 30 illustrates an isometric view of a first embodiment of a fifth aspect of an acoustic-baffle assembly, a fragmentary portion of which illustrates a fragmentary cross-sectional view of the acoustic-baffle assembly.
Figure 31:
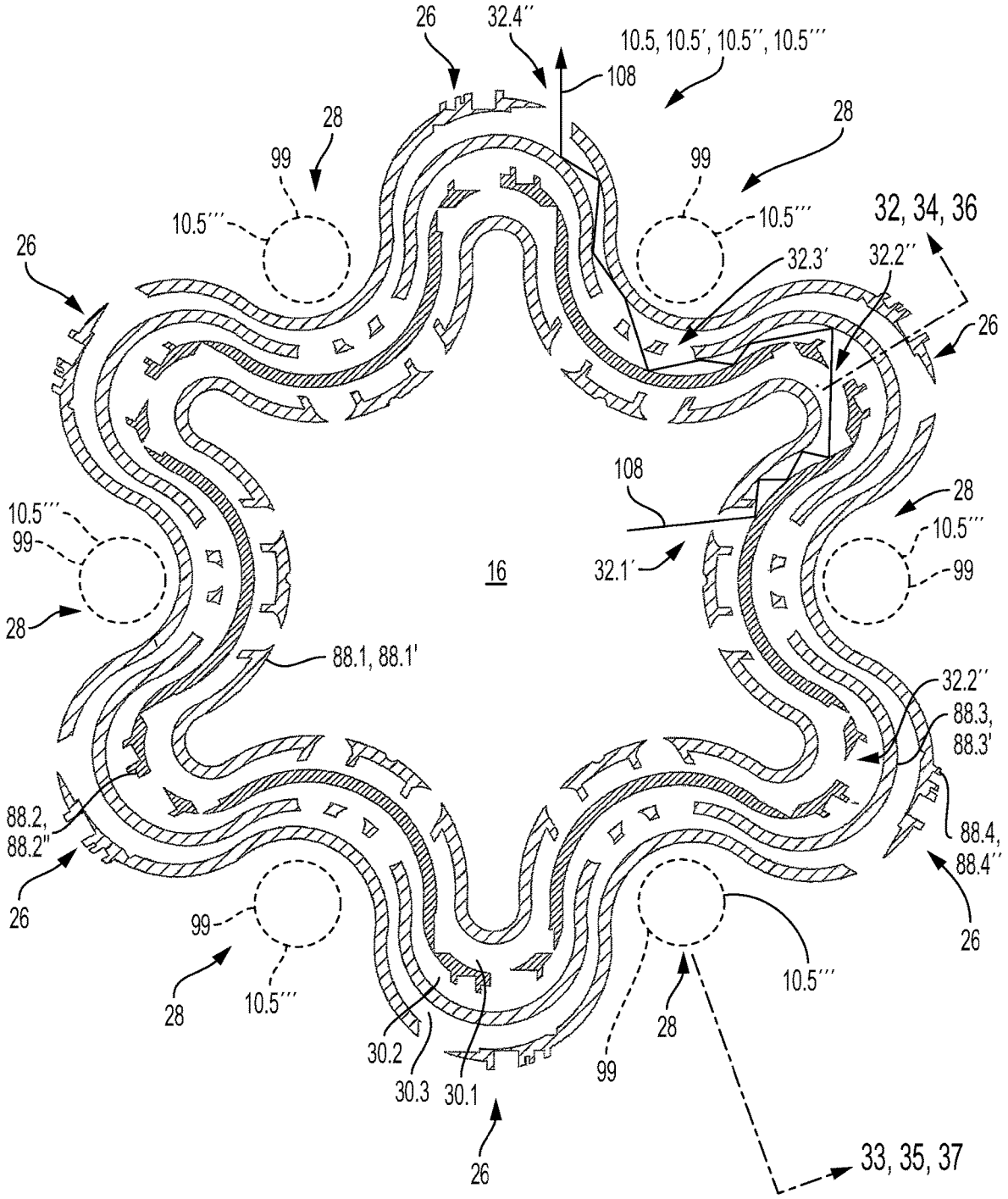
FIG. 31 illustrates an expanded transverse-cross-sectional view of the first, second and third embodiments of the fifth-aspect acoustic-baffle assembly illustrated in FIGS. 30 and 32-37.
Figure 32:
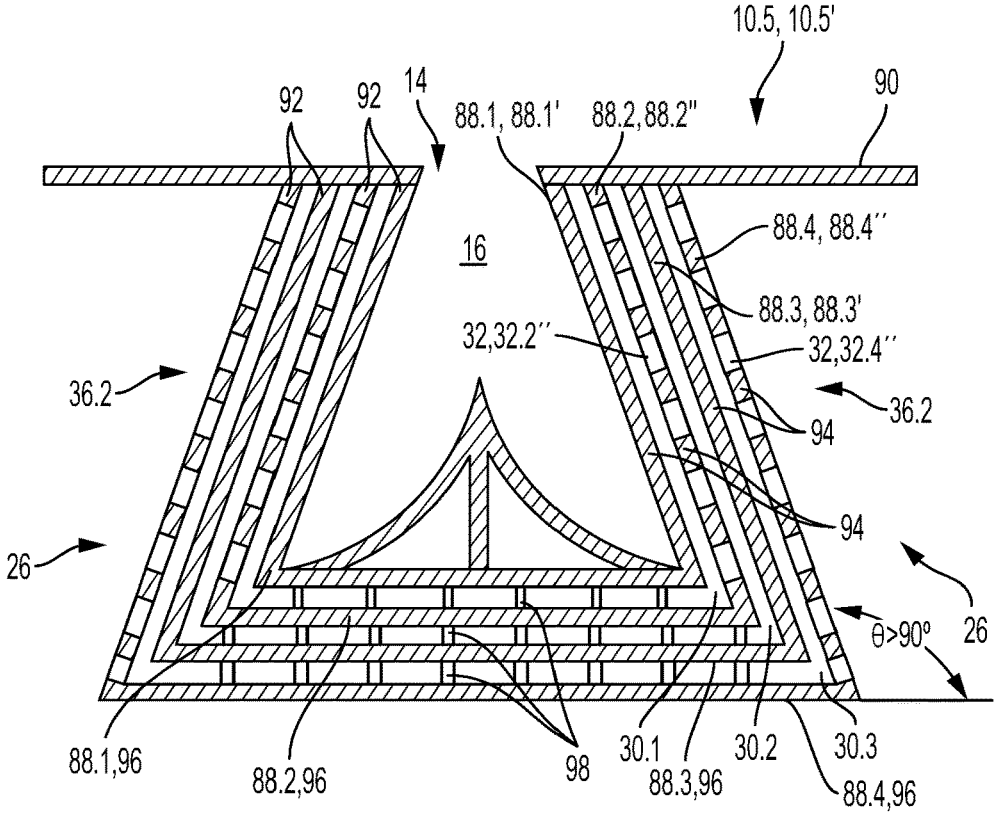
FIG. 32 illustrates a first expanded radial cross-section through opposing ridged portions of the first embodiment of the fifth-aspect acoustic-baffle assembly illustrated in FIGS. 30 and 31.
Figure 33:
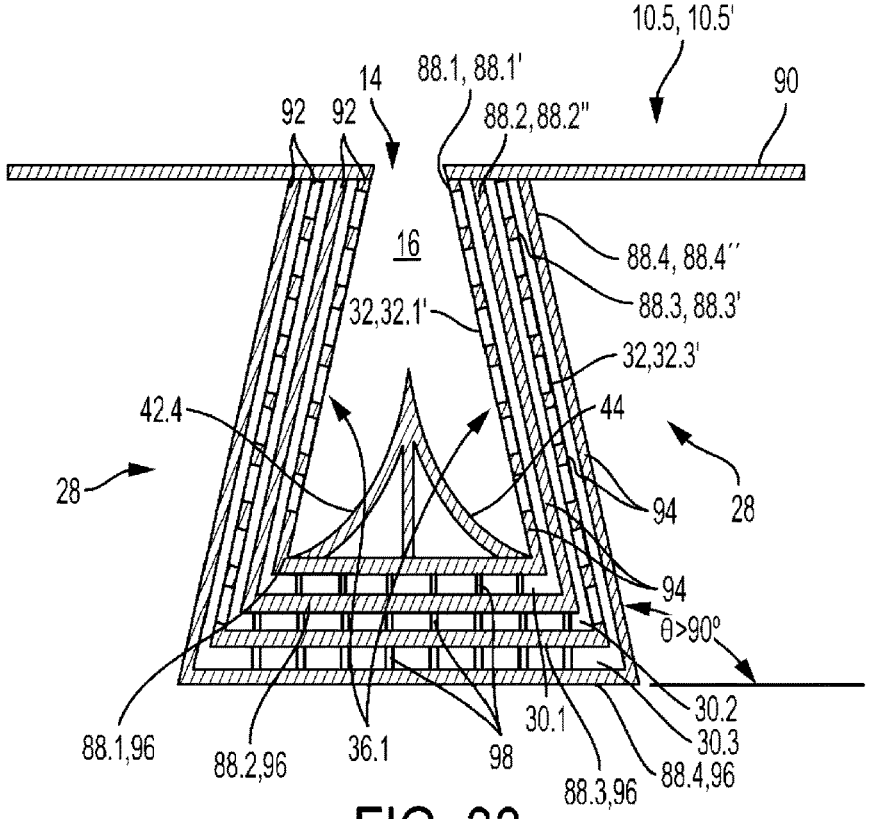
FIG. 33 illustrates a second expanded radial cross-section through opposing grooved portions of the first embodiment of the fifth-aspect acoustic-baffle assembly illustrated in FIGS. 30 and 31.

In contrast with the fluted-frustoconical cups 12 of the first aspect 100.1, as a result of the obtuse angle of inclination θ, each of the fluted-inverted-frustoconical cups 88 taper outwards from the rim portion 20 to the base portion 96—so that the mouth 14/open end 14' of each fluted-inverted-frustoconical cups 88 is located at the relatively narrower top of the underlying cone, rather than at the relatively wider base thereof, hence the term "inverted", —which has a substantial effect on the manner in which the associated fluted-inverted-frustoconical cups 88, 88.1, 88.2, 88.3, 88.4 can be individually constructed and collectively assembled to form the acoustic baffle assembly 10, 10.5, 10.5'. More particularly, if the acoustic baffle assembly 10, 10.5, 10.5' is to be assembled from preformed fluted-inverted-frustoconical-side-wall portion 94, then, for example, in accordance with one approach, except perhaps for the innermost (first) fluted-inverted-frustoconical cup 88.1, the base portion 96 and fluted-inverted-frustoconical-side-wall portion 94 of each fluted-inverted-frustoconical cup 88, 88.1, 88.2, 88.3, 88.4 would be assembled together during the assembly of the acoustic baffle assembly 10, 10.5, 10.5', and not before. Alternatively, as assumed for the first embodiment illustrated in FIGS. 30-33, the entire acoustic baffle assembly 10, 10.5, 10.5' may be integrally assembled, for example, by additive manufacturing—i.e. what is generally referred to as 3-D printing. Accordingly, FIGS. 30 and 32-33 illustrate a plurality of pedestals 98 between adjacent base portion 96 that provide for the supporting subsequent base portions 96 after the initially-formed base portion 96 is formed.

Each fluted-inverted-frustoconical-side-wall portion 94 comprises radially-outwardly-extending ridged portions 26 and corresponding radially-inwardly-extending grooved portions 28, each azimuthally interleaved with respect to each other. Although FIGS. 30 and 31 illustrate an acoustic-baffle assembly 10, 10.5, 10.5' having six radially-outwardly-extending ridged portions 26 and six radially-inwardly-extending grooved portions 28, generally, the number of radially-outwardly-extending ridged portions 26 and radially-inwardly-extending grooved portions 28 would each be typically between three and eight.

The plurality of fluted-inverted-frustoconical cups 88, 88.1, 88.2, 88.3, 88.4 are nested with respect to one another in the acoustic-baffle assembly 10, 10.5, 10.5'. In one set of embodiments, the fluted-inverted-frustoconical cups 88, 88.1, 88.2, 88.3, 88.4 are shaped and sized so that the gaps between adjacent fluted-inverted-frustoconical cups 88, 88.1, 88.2, 88.3, 88.4—both between adjacent fluted-inverted-frustoconical-side-wall portions 94 and between adjacent base portions 96—are substantially uniform, for example, 0.5 mm (0.02 in.) depending upon other constraints, with the second fluted-inverted-frustoconical cup 88.2 surrounding the innermost (first) fluted-inverted-frustoconical cup 88.1 and surrounded by the third fluted-inverted-frustoconical cup 88.3, and with the outermost (fourth) fluted-inverted-frustoconical cup 88.4 surrounding the third fluted-inverted-frustoconical cup 88.3. Although the embodiments of the acoustic-baffle assembly 10, 10.5, 10.5' illustrated in FIGS. 30-33 each incorporate six fluted-inverted-frustoconical cups 88, generally between three and six fluted-inverted-frustoconical cups 88 will be sufficient, with five having been found to provide good overall performance.

The fluted-inverted-frustoconical-side-wall portion 94 of the fluted-inverted-frustoconical cups 88 incorporate specifically-shaped orifices 32 therethrough at associated specific locations that contributes to the above-referenced scrambling action of the acoustic-baffle assembly 10, 10.5, 10.5'. More particularly, every other fluted-inverted-frustoconical cup 88, 88.1', 88.3'in the acoustic-baffle assembly 10, 10.5, 10.5' incorporates a first class of orifices 32' of a first shape 34.1 at a first class of locations 36.1, and the remaining every other fluted-inverted-frustoconical cup 88, 88.2", 88.4" in the acoustic-baffle assembly 10, 10.5, 10.5' incorporates a second class of orifices 32" of a second shape 34.2 at second class of locations 36.2, wherein the first 34.1 and second 34.2 shapes are different from one another, and the first 36.1 and second 36.2 classes of locations are azimuthally offset from one another so as to force the soundwaves 108 to travel along a serpentine path 38 in order to pass through the acoustic-baffle assembly 10, 10.5, 10.5'. In accordance with the first class of orifices 32', the associated first shape 34.1, for purposes of illustration, is generally a circular shape, and the associated first class of locations 36.1 are proximate to the centers of the radially-inwardly-extending grooved portions 28 of the fluted-inverted-frustoconical side-wall-portion 94 of the associated fluted-inverted-frustoconical cup 88, 88.1', 88.3'. In accordance with the second class of orifices 32", the associated second shape 34.2, for purposes of illustration, is also generally a circular shape, and the associated second class of locations 36.2 are proximate to the centers of the radially-outwardly-extending ridged portions 26 of the fluted-inverted-frustoconical-side-wall portion 94 of the associated fluted-inverted-frustoconical cup 88, 88.2", 88.4". Generally, the first 34.1 and second 34.2 shapes could be either similar or different, the first shape 34.1 could be different for some or each associated every other fluted-inverted-frustoconical cup 88, 88.1', 88.3' in the acoustic-baffle assembly 10, 10.5, 10.5', and the second shape 34.2 could be different for some or each associated remaining every other fluted-inverted-frustoconical cup 88, 88.2", 88.4" in the acoustic-baffle assembly 10, 10.5, 10.5'.

The innermost (first) fluted-inverted-frustoconical cup 88.1 incorporates a central, fluted-segmented-conical-concave reflector 42.4 incorporating a plurality of concave tapered surfaces 44 in one-to-one azimuthal correspondence with the associated first class of locations 36.1 of the associated first class of orifices 32.1' of the innermost (first) fluted-frustoconical cup 12.1, 12.1', wherein each concave tapered surface 44 provides for focusing incoming soundwaves 108 into a corresponding associated subset of first orifices 32.1' of the innermost (first) fluted-inverted-frustoconical cup 88.1, which also provides for mitigating against a direct reflection of incoming soundwaves 108 out of the acoustic inlet 16 of the acoustic-baffle assembly 10, 10.5, 10.5'.

The number, depth, and shape of the outwardly-extending ridged portions 26 and corresponding radially-inwardly-extending grooved portions 28 are configured so as to cause the soundwaves 108 propagating therethrough to follow a myriad of tortuous paths therethrough that cause the soundwaves 108 therewithin, and exiting therefrom to the acoustic cavity 106 of the associated acoustic-absorber system 100, 100.1, 100.2, to become phase-scrambled, which in turn results in a substantial attenuation of the amplitudes of the soundwaves 108 within the acoustic cavity 106 of the associated acoustic-absorber system 100, 100.1, 100.2.

Referring to FIG. 31, the operation of the acoustic-baffle assembly 10, 10.5, 10.5' is the same as described hereinabove—with reference hereinabove to FIGS. 7, 3, 4 and 10*a*-10*d* through 15*a*-15*d*—for the first-aspect acoustic-baffle assembly 10, 10.1, except for references to a fluted-frustoconical cup 12 of the first-aspect acoustic-baffle assembly 10, 10.1 being replaced with references to a corresponding fluted-inverted-frustoconical cups 88 of the fifth-aspect acoustic-baffle assembly 10, 10.5, 10.5'.

Figure 34:
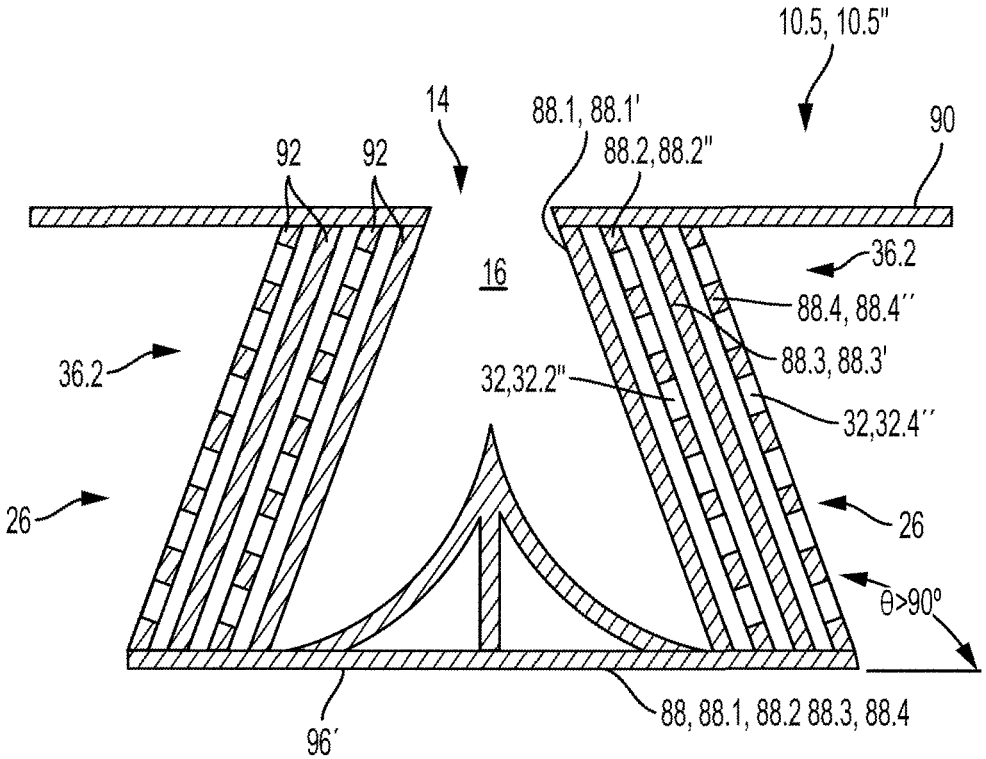
FIG. 34 illustrates a first expanded radial cross-section through opposing ridged portions of a second embodiment of the fifth aspect of the acoustic-baffle assembly illustrated in FIG. 31.
Figure 35:
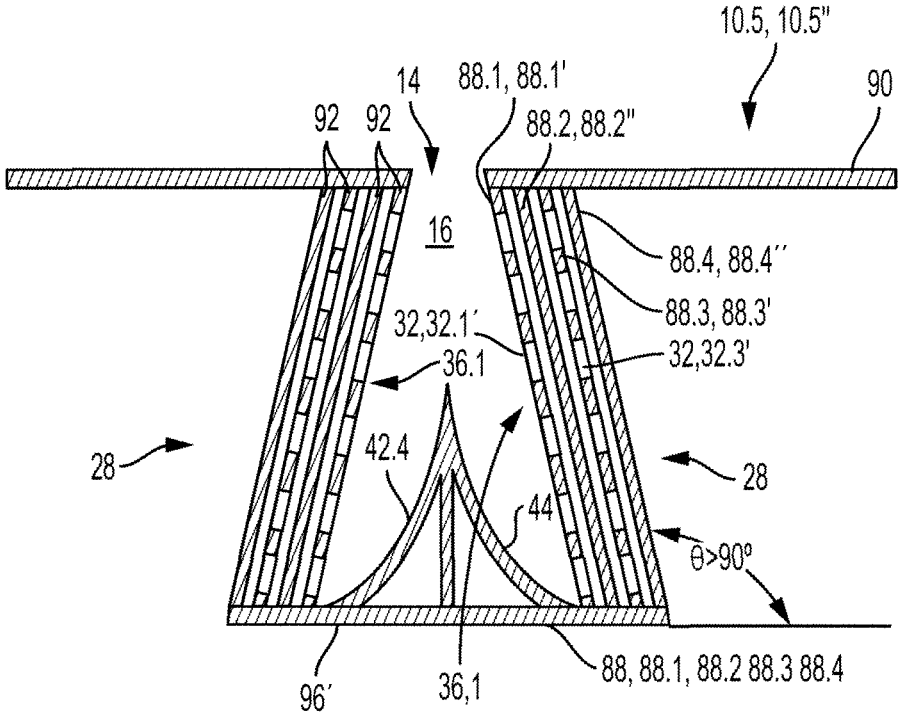
FIG. 35 illustrates a second expanded radial cross-section through opposing grooved portions of the second embodiment of the fifth-aspect of the acoustic-baffle assembly illustrated in FIG. 31.

Referring to FIGS. 31, 34 and 35, a second embodiment of the fifth aspect of an acoustic-baffle assembly 10, 10.5, 10.5" is similar in all respects to the first embodiment 10.5', except that the second embodiment 10.5" incorporates a single base portion 96' that extends across, and is integrated with, each of the associated nested plurality fluted-inverted-frustoconical cups 88, 88.1', 88.2", 88.3', 88.4", thereby precluding the need for the pedestals 98 of the first embodiment 10.5' that provided for manufacturing the associated separate base portions 96 by additive manufacturing.

It should be understood that any of the above aspects of the acoustic baffle assemblies 10, 10.1, 10.2, 10.3 or 10.4 could also be constructed by additive manufacturing as associated integral assemblies that incorporate either or both an integrated/shared flange portion 90 as illustrated in FIGS. 32-35 for the first or second embodiments of the fifth aspect of the acoustic baffle assembly 10.5, 10.5', 10.5"; or an integrated/shared base portion 96' as illustrated in FIGS. 34-35 for the second embodiment of the fifth aspect of the acoustic baffle assembly 10.5, 10.5".

Figure 36:
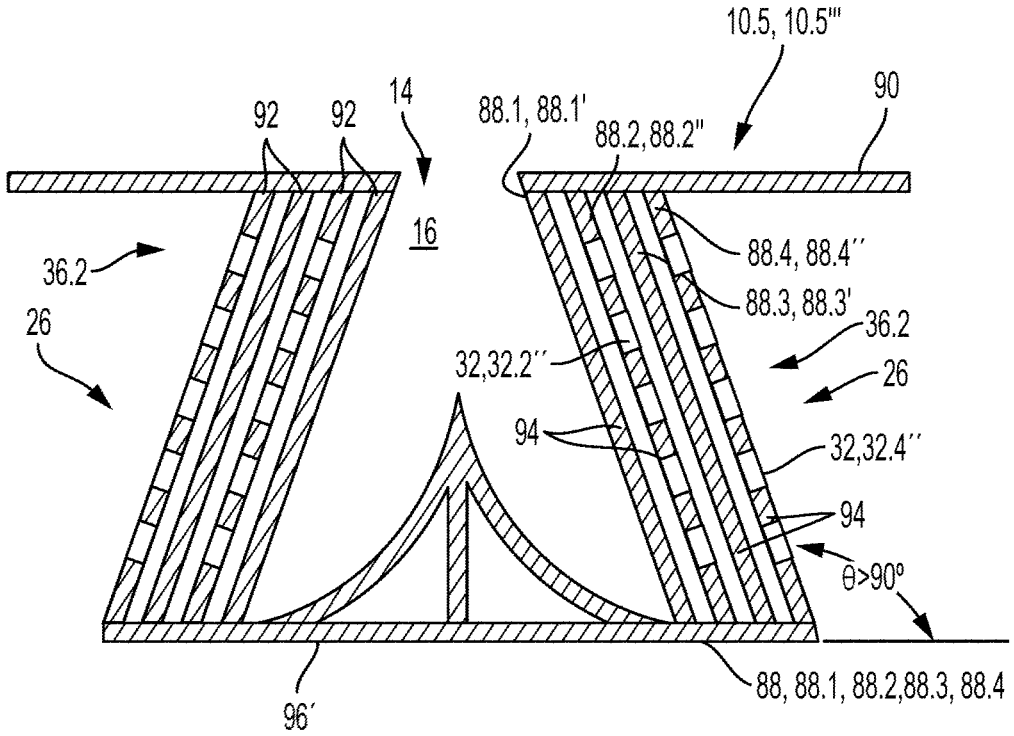
FIG. 36 illustrates a first expanded radial cross-section through opposing ridged portions of a third embodiment of the fifth aspect of the acoustic-baffle assembly illustrated in FIG. 31.
Figure 37:
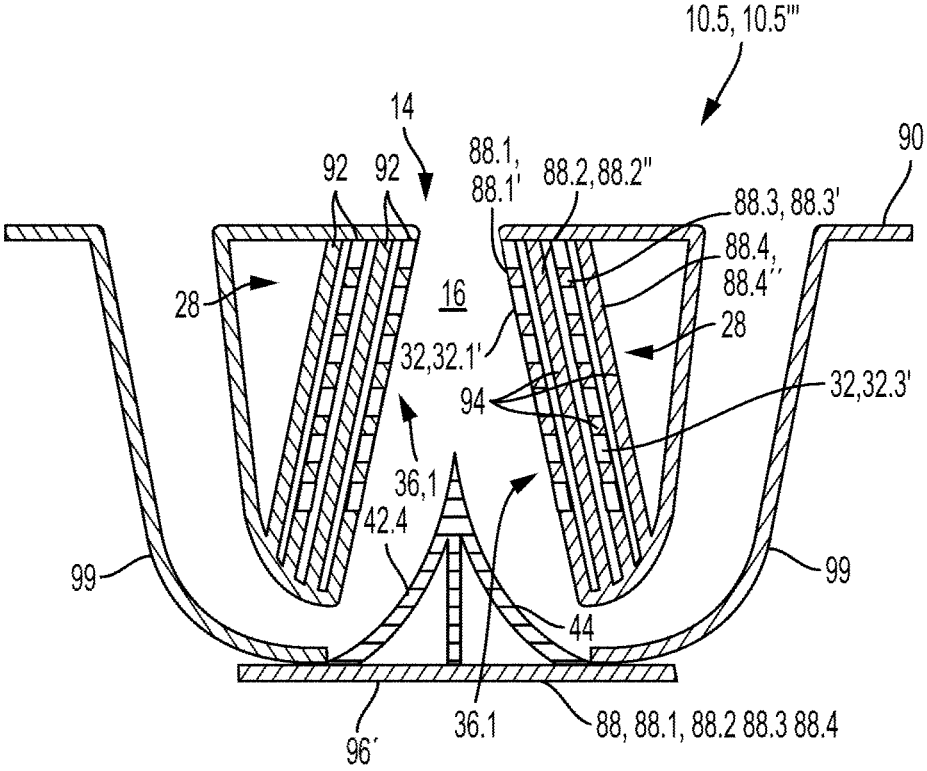
FIG. 37 illustrates a second expanded radial cross-section through opposing grooved portions of the third embodiment of the fifth-aspect acoustic-baffle assembly illustrated in FIG. 31.

Referring to FIGS. 31, 36 and 37, a third embodiment of the fifth aspect of an acoustic-baffle assembly 10, 10.5, 10.5'" is similar in all respects to the second embodiment 10.5", except that the third embodiment 10.5'" incorporates a plurality of acoustic conduits 99 that are azimuthally aligned with the associated radially-inwardly-extending grooved portions 28 of the fluted-inverted-frustoconical-side-wall portion 94, which provide for increasing the acoustic footprint area of the acoustic baffle assembly 10, 10.5, 10.5'" relative to that of the first 10.5' or second 10.5" embodiments, and thereby increase the amount of sound that would be subject to attenuation by an associated acoustic absorber system 100, 100.1, 10.2, which compensates for the relatively smaller area of the mouth 14 of the acoustic baffle assembly 10, 10.5, 10.5', 10.5", 10.5'" as a result of the associated obtuse angle of inclination θ.

Figure 38:
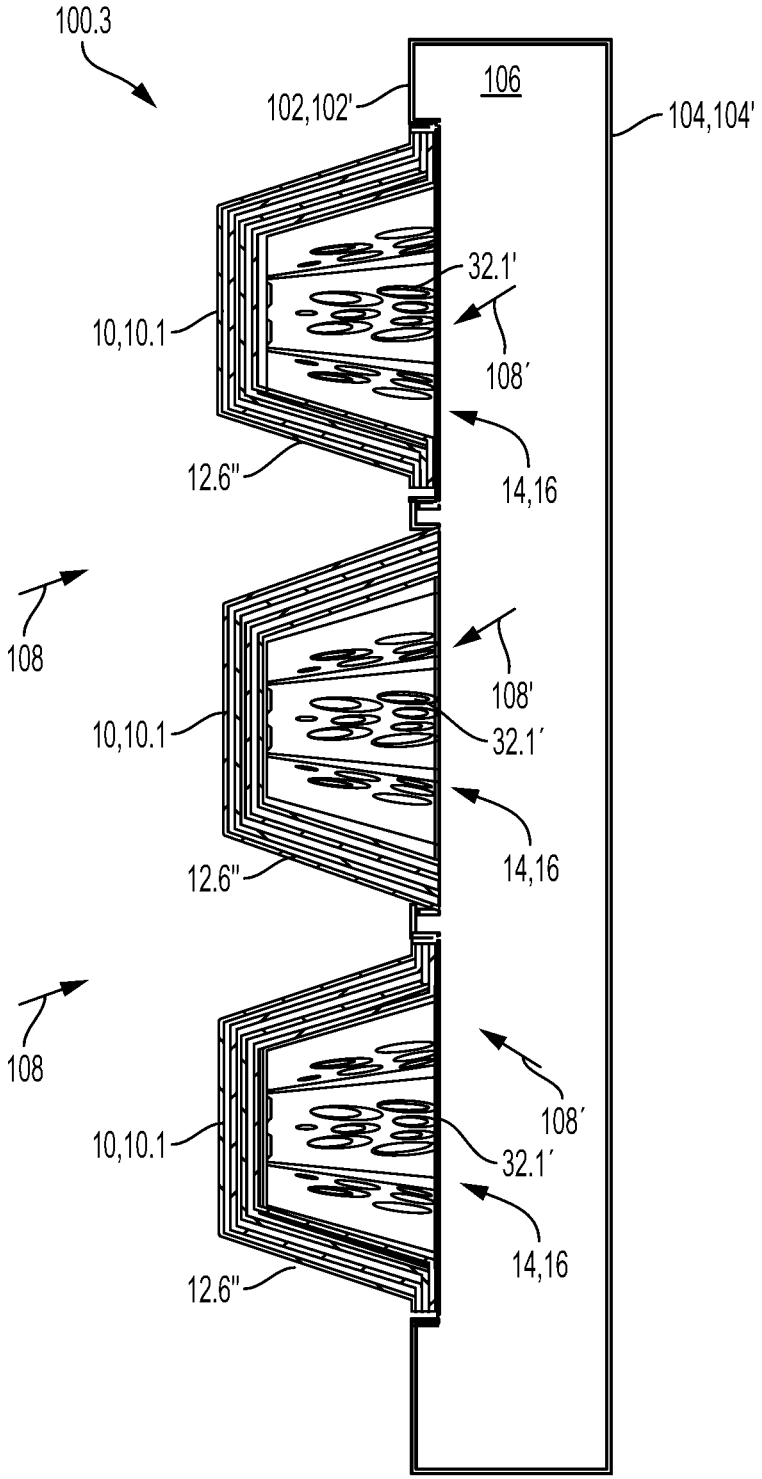
FIG. 38 illustrates a third aspect of an acoustic-absorber system incorporating a plurality of acoustic-baffle assemblies in cooperation with an associated acoustic cavity, wherein each acoustic-baffle assembly is in accordance with the first aspect, and the third aspect of the acoustic-absorber system provides for absorbing soundwaves impinging upon one of the opposing faces thereof.

The acoustic impedance of the acoustic baffle assembly 10, 10.1 is substantially independent of the direction of soundwaves 108 therethrough, i.e. substantially independent of whether the soundwaves 108 propagate from the previously-defined inlet 16 of the innermost (first) fluted-frustoconical cup 12.1 to an outlet of the outermost (sixth) fluted-frustoconical cup 12.6, or propagate from an alternative inlet of the outside of the outermost (sixth) fluted-frustoconical cup 12.6 to an alternative outlet of the mouth 14 of the innermost (first) fluted-frustoconical cup 12.1. Accordingly, referring to FIG. 38, in accordance with a third aspect of an acoustic absorber system 100, 100.3—as an alternative to the above-described second-aspect acoustic absorber system 100, 100.2—the associated acoustic baffle assemblies 10, 10.1 may be mounted on one of the acoustically opaque face panels 102 so that the exterior thereof is exposed to, and receives, the incident soundwaves 108 from outside an associated acoustic cavity 106, with the previously-defined inlets 16 (or mouths 14) thereof in direct acoustic communication with the associated cavity 106 of the acoustic absorber system 100, 100.3. Accordingly, soundwaves 108 from outside an associated acoustic cavity 106 enter the outermost (sixth) fluted-frustoconical cup 12.6, propagate through the various orifices 32 gaps 30 of the acoustic baffle assemblies 10, 10.1, and after being scrambled thereby, exit the acoustic absorber system 100, 100.3 through the previously-designated inlet 16 (mouth 14) of the innermost (first) fluted-frustoconical cup 12.1 of the acoustic absorber system 100, 100.3 into the associated acoustic cavity 106 of the acoustic absorber system 100, 100.3 for subsequent attenuation therewithin.

Similarly, referring to FIG. 39, in accordance with a first embodiment of a fourth aspect of an acoustic absorber system 100, 100.4—as an alternative to the above-described first-aspect acoustic absorber system 100, 100.1—the associated acoustic baffle assemblies 10, 10.1 may be mounted on both acoustically opaque face panels 102, 104, but otherwise function as described hereinabove for the third aspect of an acoustic absorber system 100, 100.3. The first embodiment of the fourth aspect of an acoustic absorber system 100, 100.4 may also incorporate an internal baffle 120 that provides for decoupling the acoustic baffle assemblies 10, 10.1 on opposing acoustically opaque face panels 102, 104, so as to prevent soundwaves 108 that enter the acoustic cavity 106 from acoustic baffle assemblies 10, 10.1 on one of the acoustically opaque face panels 102, 104 from propagating directly across the acoustic cavity 106 towards the acoustic baffle assemblies 10, 10.1 on the other of the acoustically opaque face panels 104, 102.

It is generally beneficial to the acoustic absorption performance of the acoustic-absorber system 100, 100.1, 100.1', 100.2, 100.2', 100.3, 100.4 to pack the associated acoustic-baffle assemblies 10, 10.1, 10.2, 10.3 as densely as possible in order to increase the total series area of the collective set of orifices 32 of the acoustic-baffle assemblies 10, 10.1, 10.2, 10.3.

Figure 39:
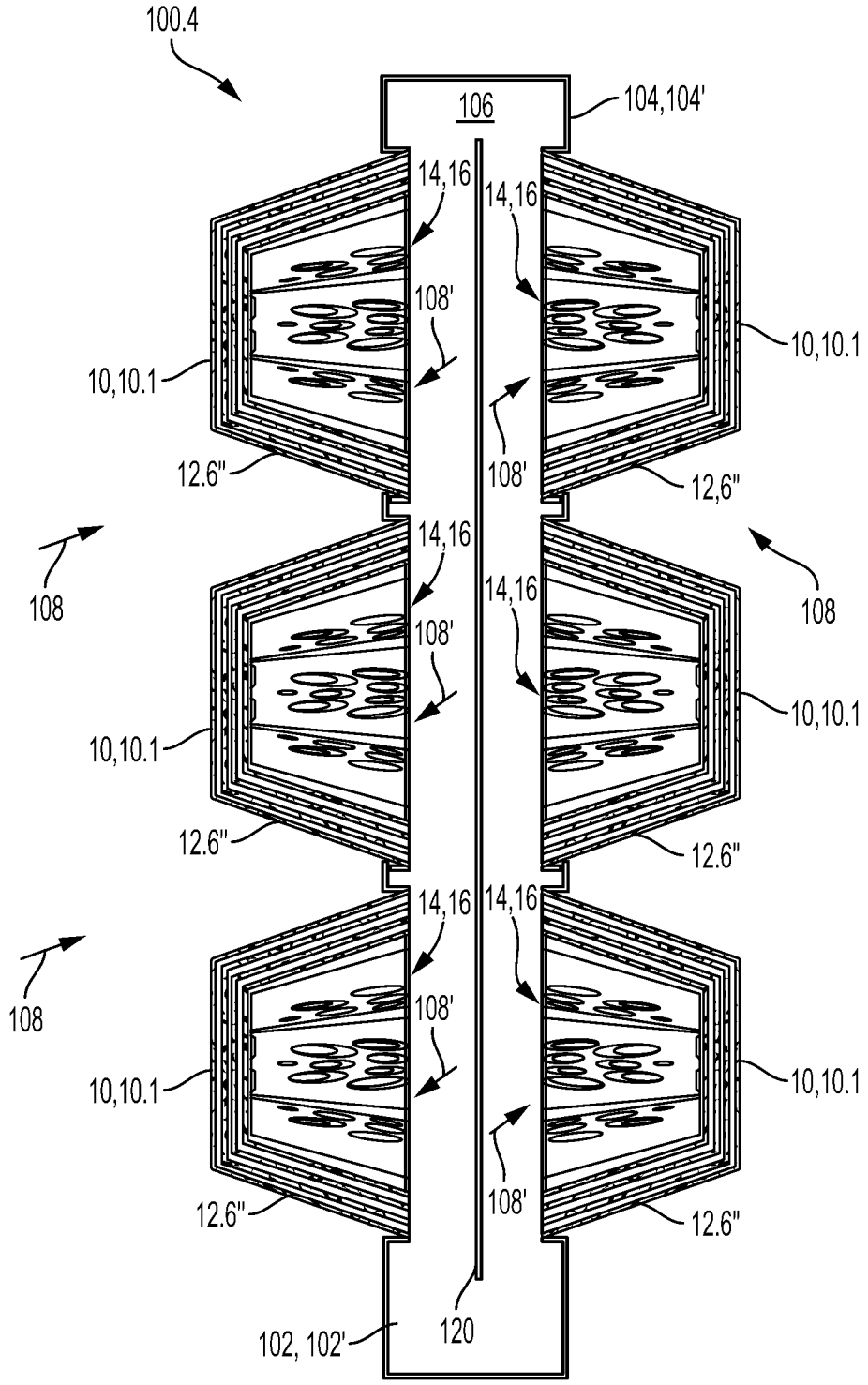
FIG. 39 illustrates a first embodiment of a fourth aspect of an acoustic-absorber system incorporating a plurality of acoustic-baffle assemblies in cooperation with an associated acoustic cavity with an internal baffle, wherein each acoustic-baffle assembly is in accordance with the first aspect, and the fourth aspect of the acoustic-absorber system provides for absorbing soundwaves impinging upon either of the opposing faces thereof.
Figure 40A:
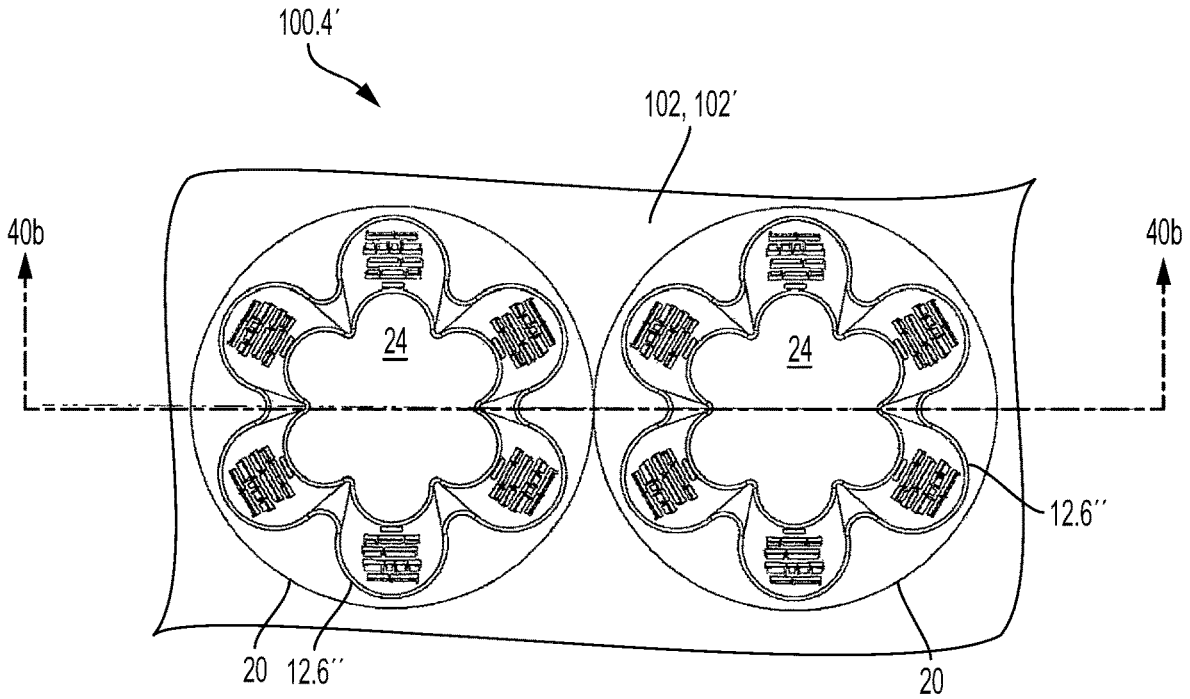
FIGS. 40*a* and 40*b* respectively illustrate a plan view, and a cross-sectional view that extends radially through grooved portions of the associated acoustic baffle assemblies, of a second embodiment of the fourth aspect of an acoustic-absorber system incorporating a plurality of acoustic-baffle assemblies in cooperation with an associated acoustic cavity, but without the internal baffle of the first embodiment illustrated in FIG. 39, wherein each acoustic-baffle assembly is in accordance with the first aspect.
Figure 40B:
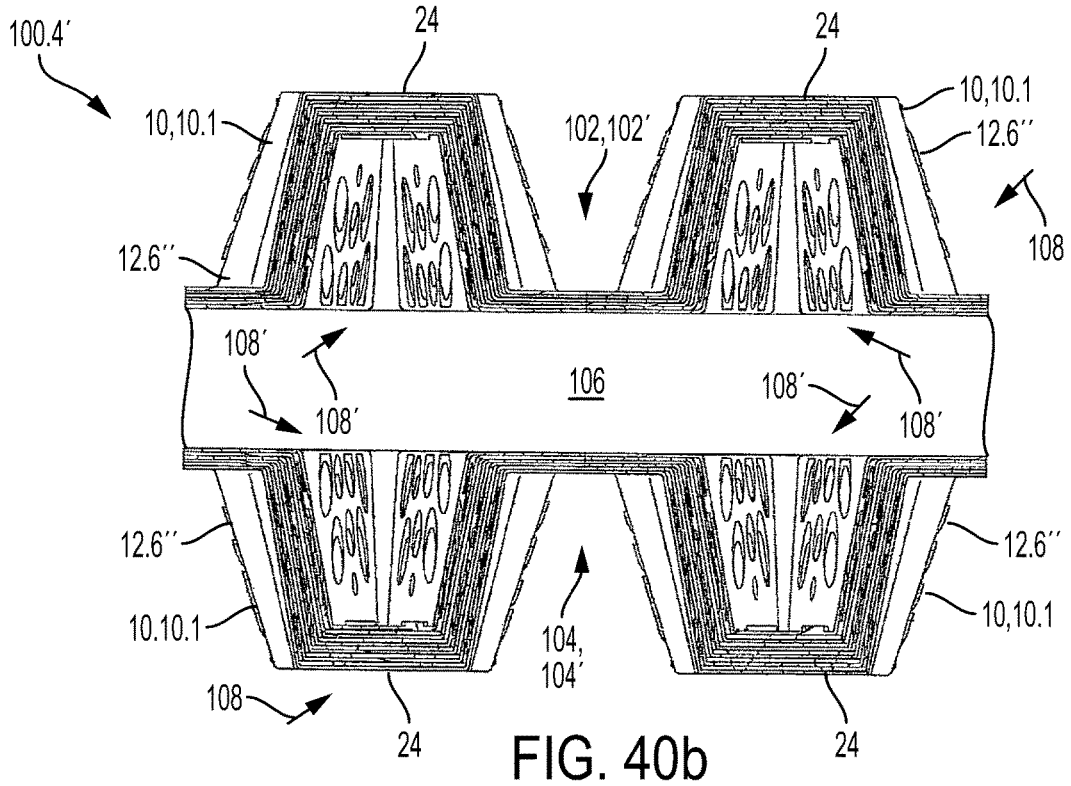

Referring to FIGS. 40*a* and 40*b*, a second embodiment of the fourth aspect of an acoustic absorber system 100, 100.4' is similar to the above-described first embodiment of the fourth aspect of the acoustic absorber system 100, 100.4 illustrated in FIG. 39, but without the associated internal baffle 120, wherein the soundwaves 108 within the acoustic cavity 106 would not be expected to propagate directly across the acoustic cavity 106 from one acoustic baffle assembly 10, 10.1 to another, or at least not without substantial attenuation therebetween as a result of interference or phase cancellation within the acoustic cavity 106. Notwithstanding that FIGS. 40*a*-40*b* illustrates acoustic baffle assemblies 10, 10.1 on each of the faces 102', 104' of the acoustic cavity 106 arranged in an associated "square" unit cell, with the rim portions 20 of adjacent acoustic baffle assemblies 10, 10.1 abutting one another, alternatively, the acoustic baffle assemblies 10, 10.1 could be closely packed, with an associated "hexagonal" unit cell.

Figure 41B:
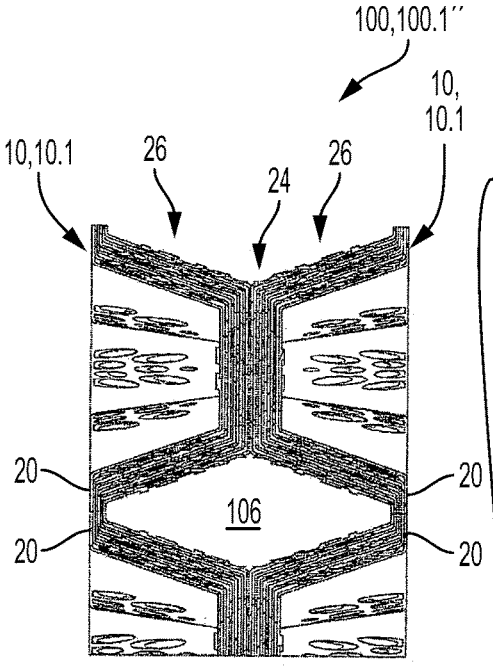
FIGS. 41*a*-41*c* respectively illustrate a plan view, and first and second cross-sectional views that extend radially through ridged and grooved portions, respectively, of the associated acoustic baffle assemblies, of a third embodiment of the first aspect of an acoustic-absorber system, wherein each acoustic-baffle assembly is in accordance with the first aspect, the acoustic baffle assemblies associated with opposing faces of the associated acoustic cavity are aligned with one another, and the associated base portions of the outermost frustoconical cups thereof abut one another.
Figure 41A:
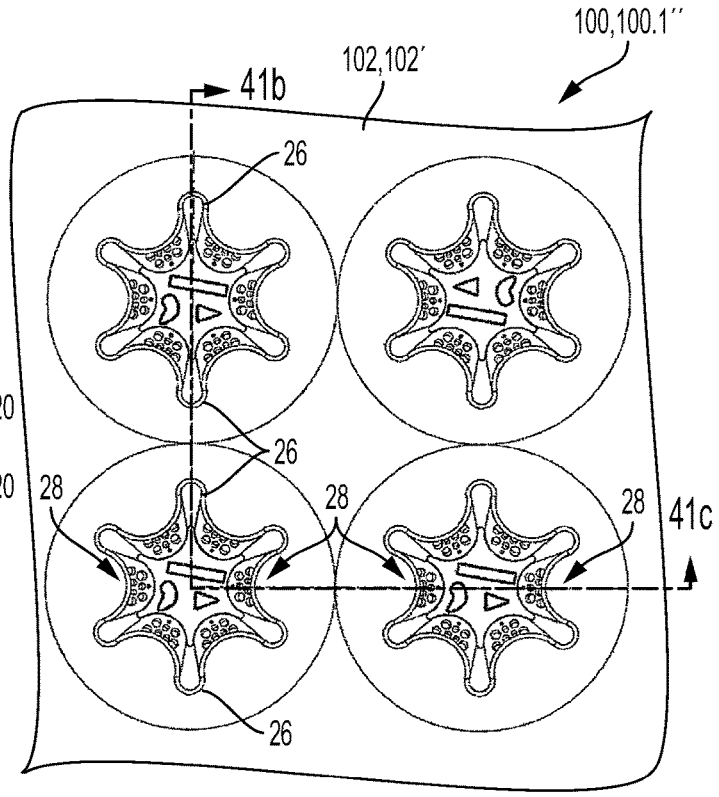
Figure 41C:
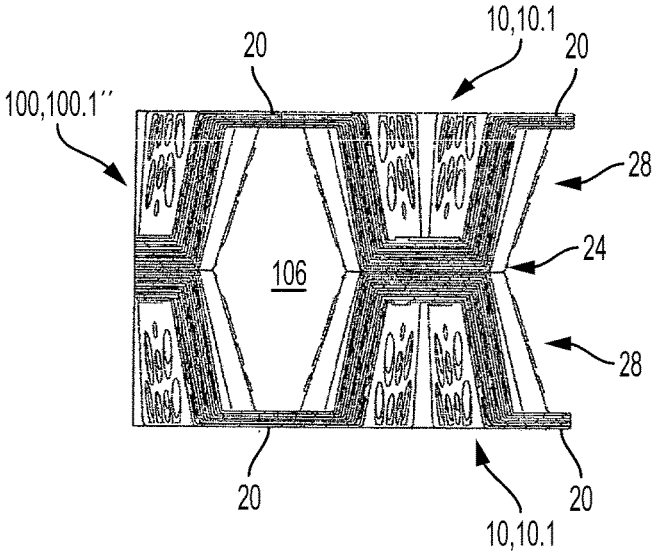

Referring to FIGS. 41*a*-41*c*, a third embodiment of the first aspect of an acoustic-absorber system 100, 100.1" is similar to the second embodiment of the first aspect of an acoustic-absorber system 100, 100.1' illustrated in FIGS. 17*a*-17*c*, except that opposing faces 102', 104' of the acoustic cavity 106 are sufficiently separated so that each acoustic baffle assembly 10, 10.1 on one of the opposing faces 102', 104' of the acoustic cavity 106 can be aligned with a corresponding acoustic baffle assembly 10, 10.1 on the other of the opposing faces 104', 102', with the base portions 24 of opposing acoustic baffle assemblies 10, 10.1 abutting one another. Notwithstanding that FIG. 41*a* illustrates acoustic baffle assemblies 10, 10.1 on each of the faces 102', 104' of the acoustic cavity 106 arranged in a rectangular grid with an associated "square" unit cell, with the rim portions 20 of adjacent acoustic baffle assemblies 10, 10.1 abutting one another, alternatively, the acoustic baffle assemblies 10, 10.1 could be closely packed, with an associated "hexagonal" unit cell.

Figure 42:
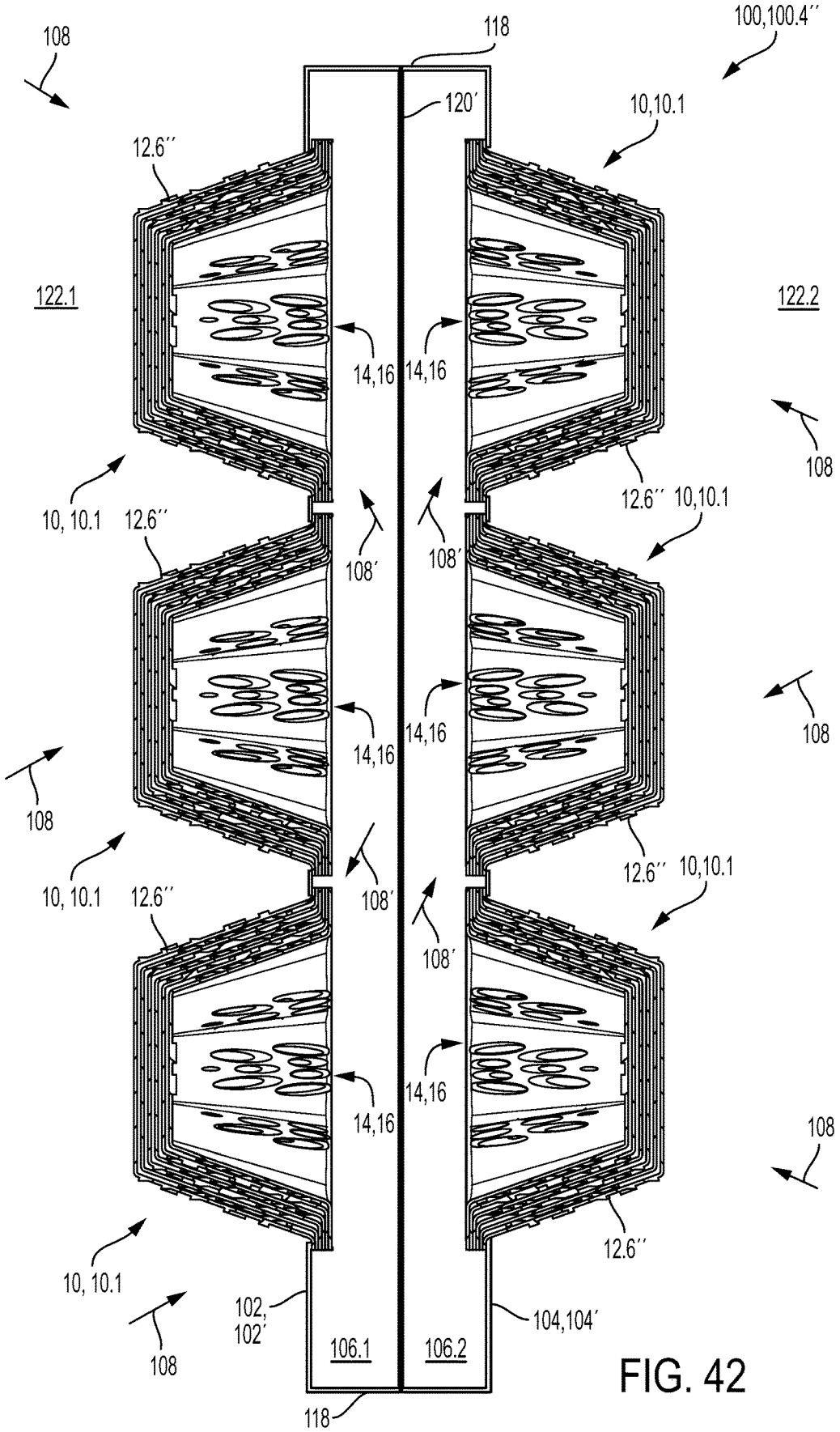
FIG. 42 illustrates a third embodiment of the fourth aspect of an acoustic-absorber system incorporating a plurality of acoustic-baffle assemblies on each of the opposing faces of a partitioned acoustic cavity, wherein each acoustic-baffle assembly is in accordance with the first aspect, and the partitioned acoustic cavity is partitioned into first and second acoustic cavity portions that are isolated from one another by an internal baffle.

Referring to FIG. 42, a third embodiment of the fourth aspect of an acoustic absorber system 100, 100.4" is similar to the above-described first embodiment of the fourth aspect of the acoustic absorber system 100, 100.4 illustrated in FIG. 39, except that the associated internal baffle 120' provides for partitioning the associated acoustic cavity 106 into first 106.1 and second 106.2 acoustic cavity portions that are isolated from one another so as to prevent soundwaves 108 from propagating directly from one acoustic cavity potion 106.1, 106.2 to the other acoustic cavity potion 106.2, 106.1, thereby providing for further acoustically isolating the sound-space on a first side 122.1 of the acoustic absorber system 100, 100.4" from the sound-space on the opposite, second side 122.2 of the acoustic absorber system 100, 100.4".

Figure 43:
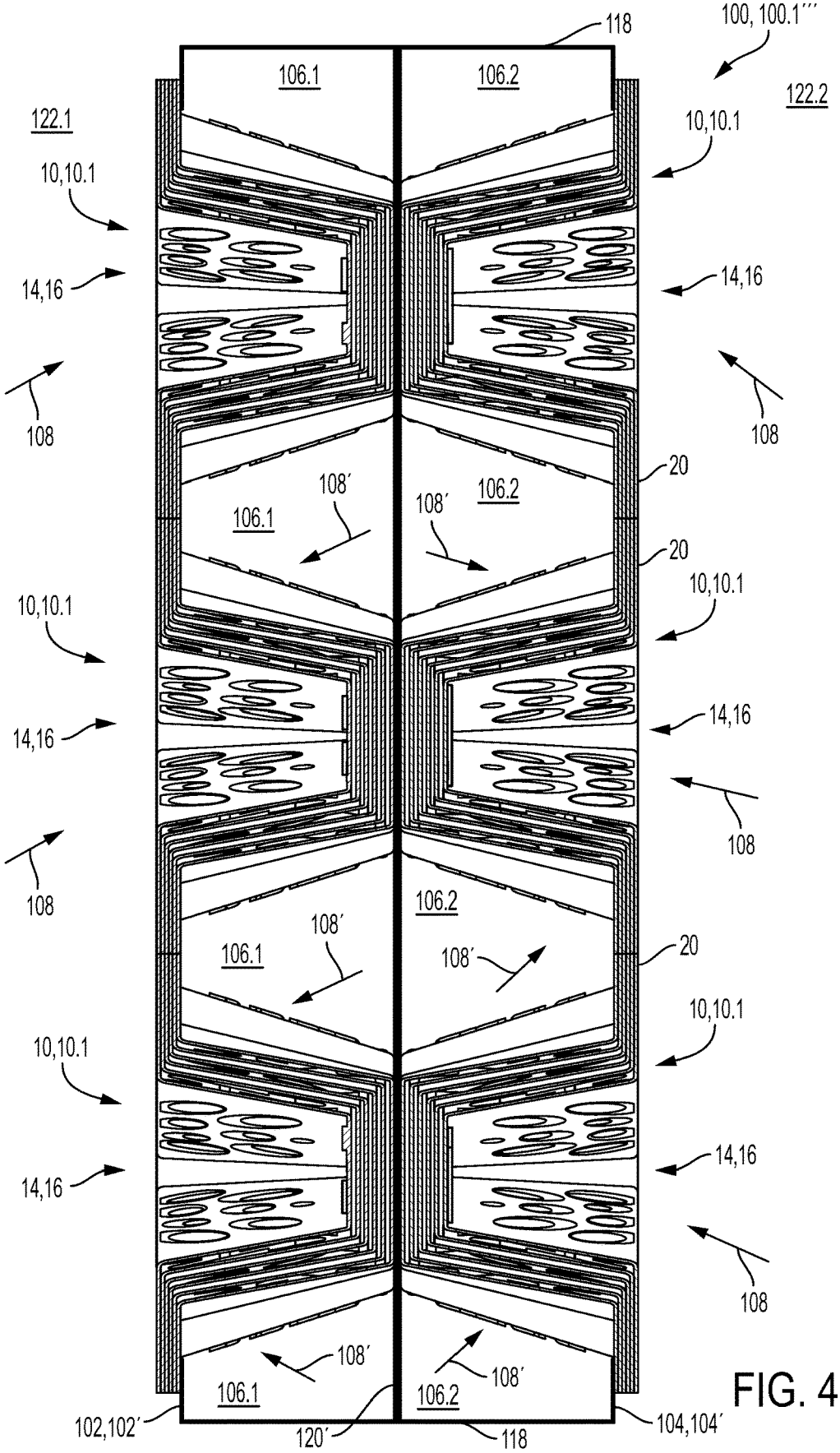
FIG. 43 illustrates a cross-sectional view that extends radially through grooved portions of associated acoustic baffle assemblies of a fourth embodiment of the first aspect of an acoustic-absorber system, wherein each acoustic-baffle assembly is in accordance with the first aspect, the acoustic baffle assemblies associated with opposing faces of an associated partitioned acoustic cavity are aligned with one another, and the associated base portions of the outermost frustoconical cups abut an internal baffle that partitions the partitioned acoustic cavity into isolated first and second acoustic cavity portions.

Similarly, referring to FIG. 43, a fourth embodiment of the first aspect of an acoustic-absorber system 100, 100.1'" is similar to the above described third embodiment of the first aspect of an acoustic-absorber system 100, 100.1 illustrated in FIGS. 41*a*-41*c*, except for further incorporating an associated internal baffle 120' that provides for partitioning the associated acoustic cavity 106 into first 106.1 and second 106.2 acoustic cavity portions that are isolated from one another so as to prevent soundwaves 108 from propagating directly from one acoustic cavity potion 106.1, 106.2 to the other acoustic cavity potion 106.2, 106.1, thereby providing for further acoustically isolating the sound-space on a first side 122.1 of the acoustic absorber system 100, 100.4" from the sound-space on the opposite, second side 122.2 of the acoustic absorber system 100, 100.4".

The acoustic-absorber system 100, 100.1, 100.1', 100.1", 100.1'", 100.2, 100.2', 100.3, 100.4, 100.4', 100.4" provides for attenuating the amplitude of incident soundwaves 108 principally by action of acoustic reflection and resulting phase scrambling or smearing and resulting destructive interference from phase cancellation. The acoustic-absorber system 100, 100.1, 100.1', 100.1", 100.1'", 100.2, 100.2', 100.3, 100.4, 100.4', 100.4" can be constructed of various acoustically-reflective materials, including metals, polymers, ceramics or composites. For example, the associated fluted-frustoconical cups 12 or fluted-conical cups 46 of the acoustic-baffle assemblies 10, 10.1, 10.2 could be formed by either additive manufacturing (e.g. what is generally referred to as 3-D printing), by stamping and/or deep-drawing of associated sheet metal parts, or by conventional fabrication techniques involving one or more of machining, casting, molding, welding, bonding or laminating. The material of construction may also contribute to attenuating the amplitude of incident soundwaves 108 by absorption of associated acoustic energy. Generally, the stiffer the material, the more acoustic energy that will reach the acoustic cavity 106, whereas the softer the material, less acoustic energy will enter the acoustic cavity 106. Typically, the higher frequencies will be absorbed by the material of construction, where the lower frequencies will be eliminated by destructive interference from phase-cancellation.

The acoustic-absorber system 100, 100.1, 100.1', 100.1", 100.1''', 100.2, 100.2', 100.3, 100.4, 100.4', 100.4" provides for a relatively linear absorption characteristic over a relatively wide range of frequencies with a package size that is relatively compact in comparison a system that would otherwise rely strictly upon absorption by sound-absorptive materials.

In one set of embodiments, one or more acoustic baffle assemblies 10 of an acoustic absorber system 100 comprise an odd number of layers, or cups 12, 46, 56, 60, 88, with the orifices 32 of the outermost layer, or cup 12, 46, 56, 60, 88, located on associated external radially-outwardly-extending ridged portions 26 thereof, i.e. associated externally-exposed convex portions thereof; and with the orifices 32 of the innermost layer or cup 12, 46, 56, 60, 88 located on associated internal radially-outwardly-extending grooved portion 26', i.e. associated internally-exposed concave portions thereof, The acoustic baffle assemblies 10 of an acoustic absorber system 100 function as acoustic scramblers to scramble the phase of the incident soundwaves 108, so as to provide for attenuation thereof within the acoustic cavity 106 as a result of interference and phase cancellation.

While specific embodiments have been described in detail in the foregoing detailed description and illustrated in the accompanying drawings, those with ordinary skill in the art will appreciate that various modifications and alternatives to those details could be developed in light of the overall teachings of the disclosure. It should be understood, that any reference herein to the term "or" is intended to mean an "inclusive or" or what is also known as a "logical OR", wherein when used as a logic statement, the expression "A or B" is true if either A or B is true, or if both A and B are true, and when used as a list of elements, the expression "A, B or C" is intended to include all combinations of the elements recited in the expression, for example, any of the elements selected from the group consisting of A, B, C, (A, B), (A, C), (B, C), and (A, B, C); and so on if additional elements are listed. Furthermore, it should also be understood that the indefinite articles "a" or "an", and the corresponding associated definite articles "the' or "said", are each intended to mean one or more unless otherwise stated, implied, or physically impossible. Yet further, it should be understood that the expressions "at least one of A and B, etc.", "at least one of A or B, etc.", "selected from A and B, etc." and "selected from A or B, etc." are each intended to mean either any recited element individually or any combination of two or more elements, for example, any of the elements from the group consisting of "A", "B", and "A AND B together", etc. Yet further, it should be understood that the expressions "one of A and B, etc." and "one of A or B, etc." are each intended to mean any of the recited elements individually alone, for example, either A alone or B alone, etc., but not A AND B together. Furthermore, it should also be understood that unless indicated otherwise or unless physically impossible, that the above-described embodiments and aspects can be used in combination with one another and are not mutually exclusive. Accordingly, the particular arrangements disclosed are meant to be illustrative only and not limiting as to the scope of the invention, which is to be given the full breadth of the appended claims, and any and all equivalents thereof.

What is claimed is:

1. An acoustic baffle assembly, comprising: a plurality of fluted-cup-side-wall portions, wherein said plurality of fluted-cup-side-wall portions are nested with respect to one another so that each fluted-cup-side-wall portion of said plurality of fluted-cup-side-wall portions is either surrounded by, or surrounds, at least one other said fluted-cup-side-wall portion, with a corresponding gap therebetween, each said fluted-cup-side-wall portion extends in an axial direction between a rim at a first end of said fluted-cup-side-wall portion, and either a corresponding base or a corresponding apex at a second end of said fluted-cup-side-wall portion, said corresponding base or said corresponding apex provide for closing said second end of said fluted-cup-side-wall portion, said rim of an innermost fluted-cup-side-wall portion defines a perimeter of a mouth of the acoustic baffle assembly, said fluted-cup-side-wall portion incorporates a plurality of grooved portions that are azimuthally interleaved with a corresponding plurality of ridged portions, said plurality of fluted-cup-side-wall portions comprise at least one fluted-cup-side-wall portion of a first type and at least one fluted-cup-side-wall portion of a second type, each said at least one fluted-cup-side-wall portion of said first type incorporates at least one first orifice through said fluted-cup-side-wall portion, wherein said at least one first orifice is located proximate to at least one grooved portion of said plurality of grooved portions of said fluted-cup-side-wall portion, and each said at least one fluted-cup-side-wall portion of said second type incorporates at least one second orifice through said fluted-cup-side-wall portion, wherein said at least one second orifice is located proximate to at least one said ridged portion of said plurality of ridged portions of said fluted-cup-side-wall portion.

2. An acoustic baffle assembly as recited in claim 1, wherein each said fluted-cup-side-wall portion comprises a fluted-frustoconical surface for which an interior angle between said fluted-cup-side-wall portion and a first plane containing said rim thereof, within a second plane containing the longitudinal axis of said fluted-frustoconical surface, is less than ninety degrees, and said second end of said fluted-cup-side-wall portion terminates at said corresponding base.

3. An acoustic baffle assembly as recited in claim 1, wherein each said fluted-cup-side-wall portion comprises a fluted-conical surface for which an interior angle between said fluted-cup-side-wall portion and a first plane containing said rim thereof, within a second plane containing the longitudinal axis of said fluted-conical surface, is less than ninety degrees, and said second end of said fluted-cup-side-wall portion terminates at said corresponding apex.

4. An acoustic baffle assembly as recited in claim 1, wherein each said fluted-cup-side-wall portion comprises a fluted-prismatic surface for which an interior angle between said fluted-cup-side-wall portion and a first plane containing said rim thereof, within a second plane containing the longitudinal axis of said fluted-prismatic surface, is nominally ninety degrees, and said second end of said fluted-cup-side-wall portion terminates at said corresponding base.

5. An acoustic baffle assembly as recited in claim 1, wherein each said fluted-cup-side-wall portion comprises a fluted-pyramidal surface.

6. An acoustic baffle assembly as recited in claim 1, wherein each said fluted-cup-side-wall portion comprises a fluted-inverted-frustoconical surface for which an interior angle between said fluted-cup-side-wall portion and a first plane containing said rim thereof, within a second plane containing the longitudinal axis of said fluted-inverted-frustoconical surface, is greater than ninety degrees, and said second end of said fluted-cup-side-wall portion terminates at said corresponding base.

7. An acoustic baffle assembly as recited in claim 6, further comprising at least one inlet port azimuthally aligned with a corresponding at least one grooved portion of said fluted-inverted-frustoconical surface, located outside an outermost fluted-cup-side-wall portion of said acoustic baffle assembly, wherein said at least one inlet port provides for fluid communication between a region exterior of said mouth of said acoustic baffle assembly and an interior of an innermost fluted-cup-side-wall portion proximate to said corresponding base thereof.

8. An acoustic baffle assembly as recited in claim 1, wherein an interior angle between said fluted-cup-side-wall portion and a first plane containing said rim of said fluted-cup-side-wall portion, within a second plane containing the longitudinal axis of said fluted-cup-side-wall portion, is greater than forty-five degrees.

9. An acoustic baffle assembly as recited in claim 8, wherein said interior angle between said fluted-cup-side-wall portion and said first plane containing said rim of said fluted-cup-side-wall portion, within said second plane containing said longitudinal axis of said fluted-cup-side-wall portion, is in a range of 65 to 80 degrees.

10. An acoustic baffle assembly as recited in claim 1, wherein count of said plurality of fluted-cup-side-wall portions is within a range of three to six in number.

11. An acoustic baffle assembly as recited in claim 1, wherein each said corresponding gap is within a range of 0.5 mm to 2.5 mm.

12. An acoustic baffle assembly as recited in claim 1, wherein a height of said acoustic baffle assembly from said mouth of said acoustic baffle assembly to said corresponding base or to said corresponding apex of said outermost fluted-cup-side-wall portion is within a range of 10 mm to 200 mm.

13. An acoustic baffle assembly as recited in claim 1, wherein said corresponding base of one of said plurality of fluted-cup-side-wall portions is distinct from said corresponding base of at least one other of said plurality of fluted-cup-side-wall portions.

14. An acoustic baffle assembly as recited in claim 1, wherein said corresponding base of one said plurality of fluted-cup-side-wall portions is integral with said corresponding base of at least one other of said plurality of fluted-cup-side-wall portions.

15. An acoustic baffle assembly as recited in claim 1, wherein an innermost said fluted-cup-side-wall portion extends to said corresponding base at said second end thereof, further comprising an acoustic reflector with an interior of said innermost said fluted-cup-side-wall portion proximate to said corresponding base and configured to reflect externally-generated soundwaves towards at least one said at least one first orifice or at least one said at least one second orifice associated with said innermost said fluted-cup-side-wall portion.

16. An acoustic baffle assembly as recited in claim 1, further comprising at least one flange extending radially outwards from said rim of at least one said fluted-cup-side-wall portion.

17. An acoustic baffle assembly as recited in claim 16, wherein said at least one flange comprises a plurality of flanges in correspondence with said plurality of fluted-cup-side-wall portions, wherein an exterior profile of each said at least one flange is substantially the same and configured so as to provide for locating said plurality of fluted-cup-side-wall portions substantially concentrically with respect to one another.

18. An acoustic baffle assembly as recited in claim 17, wherein at least two of said plurality of flanges associated with adjacent fluted-cup-side-wall portions of said plurality of fluted-cup-side-wall portions incorporate at least one feature that provides for azimuthally indexing said adjacent fluted-cup-side-wall portions with respect to one another.

19. An acoustic baffle assembly as recited in claim 16, wherein said at least one flange comprises an integral flange that is operatively coupled to each said rim of a plurality of said plurality of fluted-cup-side-wall portions.

20. An acoustic baffle assembly as recited in claim 1, wherein a count of said plurality of grooved portions, and a corresponding count of said plurality of ridged portions, are each within a range of three to eight in number.

21. An acoustic baffle assembly as recited in claim 1, wherein at least one said at least one first orifice is located proximate to each grooved portion of said plurality of grooved portions of said fluted-cup-side-wall portion, and at least one said at least one second orifice is located proximate to each ridged portion of said plurality of ridged portions of said fluted-cup-side-wall portion.

22. An acoustic baffle assembly as recited in claim 1, wherein at least one said at least one first orifice is shaped differently from at least one said at least one second orifice.

23. An acoustic baffle assembly as recited in claim 1, wherein at least one said at least one first orifice of at least one of said fluted-cup-side-wall portion is shaped differently from at least one said at least one first orifice of at least one other said fluted-cup-side-wall portion.

24. An acoustic baffle assembly as recited in claim 1, wherein at least one said at least one second orifice of at least one of said fluted-cup-side-wall portion is shaped differently from at least one said at least one second orifice of at least one other said fluted-cup-side-wall portion.

25. An acoustic baffle assembly as recited in claim 1, wherein for each said fluted-cup-side-wall portion of said plurality of fluted-cup-side-wall portions, a total area of said at least one first orifice, or a total area of said at least one second orifice, is within a range of 20% to 50% of an associated footprint area, and said associated footprint area is an area of a square that circumscribes a maximum diameter of said acoustic baffle assembly.

26. An acoustic baffle assembly as recited in claim 1, wherein the acoustic baffle assembly and at least one other acoustic baffle assembly are in cooperation with at least one acoustic cavity, each said at least one other acoustic baffle assembly is also configured in accordance with claim 1, said acoustic baffle assembly and said at least one other acoustic baffle assembly constitute a plurality of acoustic baffle assemblies, and each said acoustic baffle assembly is located on, or extends through, at least one wall of said at least one acoustic cavity so as to provide for fluid communication therethrough between an interior of said at least one acoustic cavity and an exterior of said at least one acoustic cavity.

27. An acoustic baffle assembly as recited in claim 26, wherein at least one said acoustic baffle assembly extends through a corresponding said at least one wall of said at least one acoustic cavity, and a corresponding mouth of said at least one said acoustic baffle assembly faces outward from of said at least one acoustic cavity so as to provide for receiving externally-generated soundwaves.

28. An acoustic baffle assembly as recited in claim 27, wherein at least one first said acoustic baffle assembly extends through a first wall of said at least one wall of said at least one acoustic cavity, at least one second said acoustic baffle assembly extends through an opposing second wall of said at least one wall of said at least one acoustic cavity, a corresponding mouth of said at least one first said acoustic baffle assembly faces outward from of said at least one acoustic cavity so as to provide for receiving a first portion of said externally-generated soundwaves external to said first wall of said at least one acoustic cavity, and a corresponding mouth of said at least one second said acoustic baffle assembly faces outward from of said at least one acoustic cavity so as to provide for receiving a second portion of said externally-generated soundwaves external to said second wall of said at least one acoustic cavity.

29. An acoustic baffle assembly as recited in claim 28, wherein said at least one first said acoustic baffle assembly and said at least one second said acoustic baffle assembly are interleaved with respect to one another within said at least one acoustic cavity.

30. An acoustic baffle assembly as recited in claim 27, wherein said at least one first said acoustic baffle assembly and said at least one second said acoustic baffle assembly are substantially aligned with respect to one another.

31. An acoustic baffle assembly as recited in claim 28, wherein said at least one acoustic cavity is partitioned into first and second acoustic cavities by an internal baffle that isolates said at least one first said acoustic baffle assembly from said at least one second said acoustic baffle assembly.

32. An acoustic baffle assembly as recited in claim 26, wherein at least one said acoustic baffle assembly is located on a corresponding said at least one wall of said at least one acoustic cavity, and a corresponding mouth of said at least one said acoustic baffle assembly faces inwards towards an interior of said at least one acoustic cavity so as to be in acoustic communication therewith.

33. An acoustic baffle assembly as recited in claim 32, wherein at least one first said acoustic baffle assembly is located on a first wall of said at least one wall of said at least one acoustic cavity, at least one second said acoustic baffle assembly is located on an opposing second wall of said at least one acoustic cavity, a corresponding mouth of said at least one first said acoustic baffle assembly faces inwards towards said interior of said at least one acoustic cavity so as to so as to be in acoustic communication therewith, and a corresponding mouth of said at least one second said acoustic baffle assembly faces inwards towards said interior of said at least one acoustic cavity so as to be in acoustic communication therewith.

34. An acoustic baffle assembly as recited in claim 33, wherein said at least one acoustic cavity is partitioned into first and second acoustic cavities by an internal baffle that isolates said at least one first said acoustic baffle assembly from said at least one second said acoustic baffle assembly.

35. An acoustic baffle assembly as recited in claim 33, wherein said at least one acoustic cavity is partitioned into first and second acoustic cavity portions by an internal baffle between said at least one first said acoustic baffle assembly and said at least one second said acoustic baffle assembly, wherein said first and second acoustic cavity portions are in fluid communication with one another.

36. A method of attenuating sound, comprising:

a. communicating externally-generated soundwaves into an interior of an acoustic cavity through at least one acoustic baffle assembly located on, or extending through, at least one wall of said acoustic cavity, wherein each said at least one acoustic baffle assembly comprises: a plurality of fluted-cup-side-wall portions, wherein said plurality of fluted-cup-side-wall portions are nested with respect to one another, so that each fluted-cup-side-wall portion of said plurality of fluted-cup-side-wall portions is either surrounded by, or surrounds, at least one other said fluted-cup-side-wall portion, with a corresponding gap therebetween, each said fluted-cup-side-wall portion extends in an axial direction between a rim at a first end of said fluted-cup-side-wall portion, and either a corresponding base or a corresponding apex at a second end of said fluted-cup-side-wall portion, said corresponding base or said corresponding apex provide for closing said second end of said fluted-cup-side-wall portion, said rim of an innermost fluted-cup-side-wall portion defines a perimeter of a mouth of said at least one acoustic baffle assembly, and said fluted-cup-side-wall portion incorporates a plurality of grooved portions that are azimuthally interleaved with a corresponding plurality of ridged portions, b. wherein the operation of communicating said externally-generated soundwaves through said at least one acoustic baffle assembly comprises: communicating said externally-generated soundwaves along a plurality of tortuous, serpentine paths between and through said plurality of fluted-cup-side-wall portions.

37. A method of attenuating sound as recited in claim 36, wherein said gap between adjacent said fluted-cup-side-wall portions of said plurality of fluted-cup-side-wall portions is configured in cooperation with a size, a shape and a location of at least one orifice through each of said adjacent said fluted-cup-side-wall portions so as to provide for a direction of said externally-generated soundwaves entering said gap from a first orifice on one of said adjacent said fluted-cup-side-wall portions to change by at least 60 degrees within said gap before exiting said gap through a second orifice through an adjacent other of said adjacent said fluted-cup-side-wall portions.

38. A method of attenuating sound as recited in claim 36, wherein the operation of communicating said externally-generated soundwaves into said interior of said acoustic cavity comprises communicating said externally-generated soundwaves into said interior of said acoustic cavity from each of opposing faces of said acoustic cavity via at least one said at least one acoustic baffle assembly located on, or extending through, each of said opposing faces of said acoustic cavity.

39. A method of attenuating sound as recited in claim 38, further comprising isolating a first portion of said externally-generated soundwaves received from a first of said opposing faces of said acoustic cavity from a second portion of said externally-generated soundwaves received from a second of said opposing faces of acoustic cavity, with an internal baffle within said acoustic cavity.

* * * * *